US011333019B2

(12) United States Patent
Baker

(10) Patent No.: US 11,333,019 B2
(45) Date of Patent: May 17, 2022

(54) PRESSURE DIFFERENTIAL ENGINE

(71) Applicant: The Centripetal Energy Company II, Lake Forest Park, WA (US)

(72) Inventor: Raymond Howard Baker, Lake Forest Park, WA (US)

(73) Assignee: The Centripetal Energy Company II, Lake Forest Park, WA (US)

( * ) Notice: Subject to any disclaimer, the term of this patent is extended or adjusted under 35 U.S.C. 154(b) by 23 days.

(21) Appl. No.: 16/755,119

(22) PCT Filed: Oct. 11, 2018

(86) PCT No.: PCT/US2018/055498

§ 371 (c)(1),
(2) Date: Apr. 9, 2020

(87) PCT Pub. No.: WO2019/075262

PCT Pub. Date: Apr. 18, 2019

(65) Prior Publication Data

US 2020/0318660 A1 Oct. 8, 2020

Related U.S. Application Data

(60) Provisional application No. 62/571,648, filed on Oct. 12, 2017.

(51) Int. Cl.
*F01B 13/06* (2006.01)

(52) U.S. Cl.
CPC ..... *F01B 13/062* (2013.01); *F01B 13/067* (2013.01)

(58) Field of Classification Search
CPC ..... F01B 13/062; F01B 13/067; F01B 13/068
See application file for complete search history.

(56) References Cited

U.S. PATENT DOCUMENTS

| | | | |
|---|---|---|---|
| 9,605,708 | B2 | 3/2017 | Durrett et al. |
| 2009/0199811 | A1 | 8/2009 | Fisher |

FOREIGN PATENT DOCUMENTS

| | | | |
|---|---|---|---|
| JP | 5393907 | B1 | 1/2014 |
| JP | 2017-106335 | A | 6/2017 |
| WO | 2016/164825 | A1 | 10/2016 |

OTHER PUBLICATIONS

International Search Report and Written Opinion of the International Searching Authority, dated Feb. 22, 2019, issued in corresponding International Application No. PCT/US2018/055498, filed Oct. 11, 2018, 8 pages.

*Primary Examiner* — F Daniel Lopez
(74) *Attorney, Agent, or Firm* — Cozen O'Connor

(57) ABSTRACT

Highly efficient pressure differential rotary engines can include rotatable cylinders arranged radially around a central stationary shaft. Each of the cylinders can house one or more pistons, and the cylinders and pistons can rotate together about the central stationary shaft. Pressure differentials within the cylinders can be used to power the rotation of the cylinders about the central stationary shaft.

19 Claims, 43 Drawing Sheets

PRESSURE DIFFERENTIAL ENGINE

BACKGROUND

Technical Field

The present disclosure generally relates to highly efficient pressure differential rotary engines.

Description of the Related Art

In rotary engines, cylinders are arranged radially around a central shaft. The central shaft can be stationary and the cylinders can rotate around the central stationary shaft. One early example was the gnome rotary engine, which was used to power aircraft many years ago.

BRIEF SUMMARY

A pressure differential engine may be summarized as including: a chassis rotatable around a first axis; a guide rail mounted to the chassis offset and rotatable around the first axis; a shaft fixed parallel to and offset from the first axis; a cylinder assembly slidably mounted on the guide rail rotatable about the first axis; a first rod rotatably mounted to the shaft offset by a first eccentric rotatable around a third axis parallel to but offset from the second axis; the first rod connected to the cylinder rotatable about the third axis; and a second rod rotatably mounted to the shaft offset by a second eccentric rotatable around a forth axis parallel to but offset from the second axis.

The pressure differential engine may further include: a first piston slidably mounted within the cylinder parallel to the first axis; the second rod connected to the first piston rotatable about the forth axis; a second piston slidably mounted within the cylinder parallel to and offset from the first piston; a third piston slidably mounted within the cylinder parallel to and offset from the second piston; a third rod connected to the second piston that extends through the third piston; a first chamber within the cylinder between the first piston and the second piston of variable volume defined by the position of the first piston and the second piston; and a second chamber within the cylinder between the second piston and the third piston of variable volume defined by the position of the second piston and the third piston. The pressure differential engine may further include: a cam assembly mounted to the exterior of the cylinder rotatable about the first axis, comprising: a first cam engaged with the third rod when the movement of the second piston and the third rod is in the direction of the first cam; where the first cam profile describes a parabolic decline; a second cam engaged with the third rod when the movement of the second piston and third rod is in the direction of the second cam; where the second cam profile describes a parabolic decline; a first link mechanism attached to the cams such that they rotate in a synchronous manner; an output gear mounted on the cam assembly and linked to the rotation of the cams; and a second link mechanism attached to the output gear that locks the cam assembly to the shaft rotatable about the second axis, A method of operating a pressure differential engine may include: a fluid pressure in the form of gas or liquid can be injected into the first chamber such that a force is applied to the first piston allowing it to slide axially; and an equal and opposite force is applied to the second piston allowing it to slide axially; the force from the first piston is transferred by the second rod such that the angle created by the offset of the first axis and the second axis and the incline plane of the second eccentric rotates the cylinder assembly about the first axis; the force from the second piston is transferred by the third rod such that it is applied to the cam; the cam will rotate to follow the incline plane of the cam defined by the profile rotating the output gear of the cam assembly; the output gear and the second link mechanism will drive the cam assembly to rotate about the second axis; and the fluid pressure in chamber one without exhausting externally is allowed to equalize with the pressure in the second chamber by a valve mechanism either internal or external to the cylinder before a complete 360 degree rotation is achieved.

A further method of operating the pressure differential engine may include: the forces generated by the pistons are such that they follow an infinite incline plane.

A further method of operating the pressure differential engine may include: the fluid pressure in chamber one is allowed to exhaust to an external recovery systems and fluid pressure is injected into the second chamber to provide for a more linear power output; and a pressure recovery system attached to the cylinder assembly using the linear movement of the cylinder and pistons to recompress the fluid pressure.

A further method of operating the pressure differential engine may include: a second pressure differential engine assembly mounted 180 degrees from the first utilizing the method of operation to provide engine output for the complete 360 degree cycle, A further method of operating the pressure differential engine may include: multiple pressure differential engine assemblies mounted radially or axially around the first axis to provide larger and a more linear output power curve.

A pressure differential engine may be summarized as including: a cylinder rotatable about a first axis; a first piston slidably mounted within the cylinder, the first piston rotatable about a second axis parallel to and offset from the first axis; and a second piston slidably mounted within the cylinder, The pressure differential engine may further include: a first inner chamber within the cylinder between the first piston and the second piston; and a second inner chamber within the cylinder between the second piston and an end portion of the cylinder. The pressure differential engine may further include a rod coupled to the second piston that extends through a third piston slidably mounted within the cylinder, A pressure differential engine may be summarized as including: a cylinder rotatable about a stationary shaft; a piston positioned within the cylinder; a rod coupled to the piston that extends through an end portion of the cylinder; a cam engaged with the rod; and a chain that rotationally locks the cam to the stationary shaft.

Reciprocation of the piston within the cylinder may cause rotation of the cam with respect to the cylinder, Rotation of the cam with respect to the cylinder may cause rotation of the cylinder with respect to the stationary shaft.

A method may be summarized as including: introducing a pressurized fluid into a chamber within a cylinder, the pressurized fluid causing a piston to slide axially through the cylinder to increase the volume of the chamber; and converting axial motion of the piston with respect to the cylinder into rotational motion of a rotatable element with respect to the cylinder, the rotatable element rotationally locked to a stationary shaft, the rotation of the rotatable element with respect to the cylinder causing the cylinder to rotate about the stationary shaft.

The method may further include converting axial motion of the piston with respect to the cylinder into rotational motion of a rotatable element with respect to the cylinder for 360° of the rotation of the cylinder about the stationary shaft.

A pressure differential engine may be summarized as including: a cylinder rotatable about a central stationary shaft; a piston positioned to reciprocate within the cylinder; a rod coupled to the piston that extends through an end portion of the cylinder; a first cam engaged with the rod so that reciprocation of the piston within the cylinder causes rotation of the first cam; a second cam engaged with the rod so that reciprocation of the piston within the cylinder causes rotation of second cam; a first chain that rotationally locks the first cam to the second cam; and a second chain that rotationally locks the first cam and the second cam to the central stationary shaft.

Reciprocation of the piston within the cylinder may cause rotation of the first cam and the second cam with respect to the cylinder. Rotation of the first cam and the second cam may cause the cylinder to rotate about the central stationary shaft. Reciprocation of the piston within the cylinder may cause rotation of the first cam and the second cam with respect to the cylinder for 360° of the rotation of the cylinder about the central stationary shaft. Rotation of the first cam and the second cam may cause the cylinder to rotate about the central stationary shaft for 360° of the rotation of the cylinder about the central stationary shaft. The first cam may be engaged with the rod so that a first stroke of the piston in a first direction causes rotation of the first cam in a first direction about a first axis and so that a second stroke of the piston in a second direction opposite to the first direction causes rotation of the first cam in the first direction about the first axis, and the second cam may be engaged with the rod so that the first stroke of the piston in the first direction causes rotation of the second cam in the first direction about a second axis and so that the second stroke of the piston in the second direction causes rotation of the second cam in the first direction about the second axis. The first cam and the second cam may provide an infinite inclined plane engaged with the rod. The pressure differential engine may further include a second piston slidably mounted within the cylinder, the second piston rotatable about an axis parallel to and offset from the central stationary shaft.

A method may be summarized as including: reciprocating a piston within a cylinder; rotating a first cam by engaging a rod coupled to the piston with the first cam while the piston reciprocates; rotating a second cam by engaging the rod with the second cam while the piston reciprocates; rotationally locking the first cam to the second cam with a first chain; and rotating the cylinder about a central stationary shaft by rotationally locking the first cam and the second cam to the central stationary shaft with a second chain, Rotating the first cam may include rotating the first cam with respect to the cylinder and rotating the second cam includes rotating the second cam with respect to the cylinder. Rotating the first cam and rotating the second cam may include engaging the rod with the first cam and with the second cam for 360° of the rotation of the cylinder about the central stationary shaft. Rotating the first cam may include engaging the rod with the first cam so that a first stroke of the piston in a first direction causes rotation of the first cam in a first direction about a first axis and so that a second stroke of the piston in a second direction opposite to the first direction causes rotation of the first cam in the first direction about the first axis, and wherein rotating the second cam includes engaging the rod with the second cam so that the first stroke of the piston in the first direction causes rotation of the second cam in the first direction about a second axis and so that the second stroke of the piston in the second direction causes rotation of the second cam in the first direction about the second axis. Engaging the rod with the first cam and with the second cam may include engaging the rod with an infinite inclined plane formed by the first cam and the second cam.

A pressure differential engine may be summarized as comprising: a primary cylinder rotatable about a central stationary shaft; a piston positioned to reciprocate within the primary cylinder; a rod coupled to the piston that extends through an end portion of the primary cylinder; a first cam engaged with the rod so that reciprocation of the piston within the primary cylinder causes rotation of the first cam; a second cam engaged with the rod so that reciprocation of the piston within the primary cylinder causes rotation of second cam; a first chain that rotationally locks the first cam to the second cam; a second chain that rotationally locks the first cam and the second cam to the central stationary shaft; a secondary pneumatic cylinder rotatably coupled to the primary cylinder; a first rigid linkage rotatably coupled to the secondary pneumatic cylinder; a second rigid linkage rotatably coupled to the first rigid linkage; a connecting rod rotatably coupled to the second rigid linkage; a crankshaft having a crankpin physically engaged with the connecting rod; and a third chain that rotationally locks the crankshaft to the central stationary shaft.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements, and may have been solely selected for ease of recognition in the drawings.

DETAILED DESCRIPTION

Figure 1A:
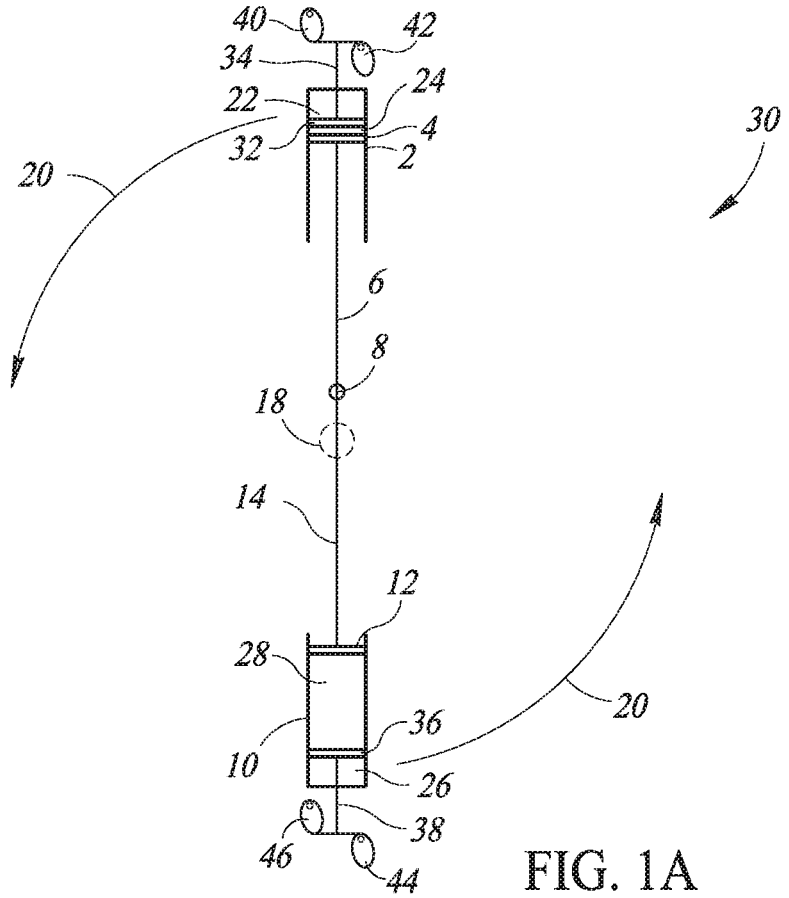
FIG. 1A is a schematic illustration of a pressure differential engine in one configuration, according to at least one illustrated embodiment.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its broadest sense, that is, as meaning "and/or" unless the context clearly dictates otherwise.

The headings and Abstract of the Disclosure provided herein are for convenience only and do not limit the scope or meaning of the embodiments.

As used herein, the terms "proximal" and "distal" refer to the relative locations of elements with respect to a central point of an engine, such as a central point of the engine those elements rotate about. A "proximal" element is closer to the central point than a corresponding "distal" element. The central point can be any point located near the center of the engine, and these terms are not intended to convey mathematically precise information. Rather, they are used in a general sense for purposes of increased clarity of this description. As used herein, "horizontal," "vertical," "upper," "lower," and other similar spatial terminology is used in a general sense only for purposes of increased clarity of this description.

FIGS. 1A-1D schematically illustrate a first embodiment of a rotary engine 30. Rotary engine 30 includes a first proximal piston 4 housed within a first cylinder 2 and a second proximal piston 12 housed within a second cylinder 10. A first proximal connecting rod 6 is rotatably coupled to the first proximal piston 4 and rotatably coupled to a central stationary shaft 8. A second proximal connecting rod 14 is rotatably coupled to the second proximal piston 12 and rotatably coupled to the central stationary shaft 8. The cylinders 2, 10 are confined to follow an orbit defined by the geometry of the system, such as a circular or elliptical orbit, such as in the direction indicated by the arrows 20. The cylinders 2, 10 can be coupled to one another so they are spaced 180° apart from one another around the orbit. A geometric center 18 of the orbit, shown in the dashed line indicated by reference numeral 18, is offset by a distance from the central stationary shaft 8.

Figure 1B:
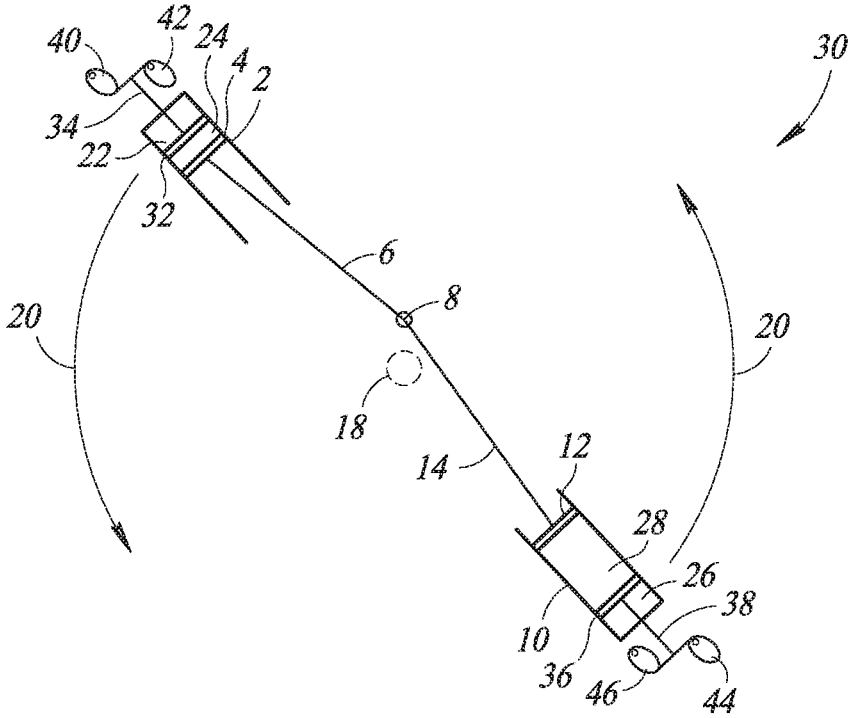
FIG. 1B is another schematic illustration of the pressure differential engine of FIG. 1A in another configuration, according to at least one illustrated embodiment.
Figure 1C:
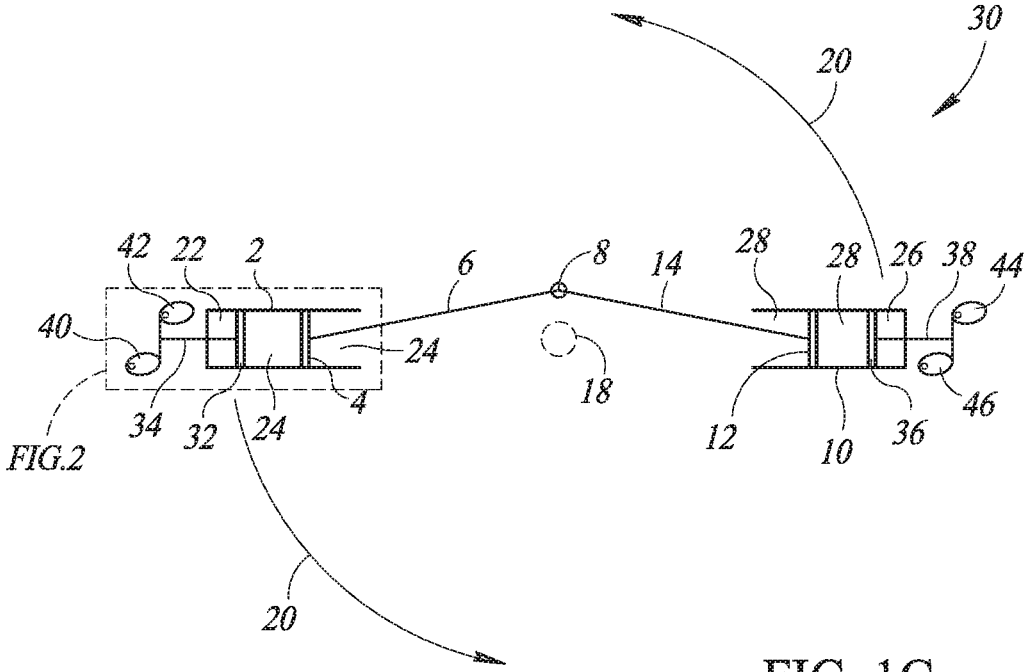
FIG. 1C is another schematic illustration of the pressure differential engine of FIG. 1A in another configuration, according to at least one illustrated embodiment.
Figure 1D:
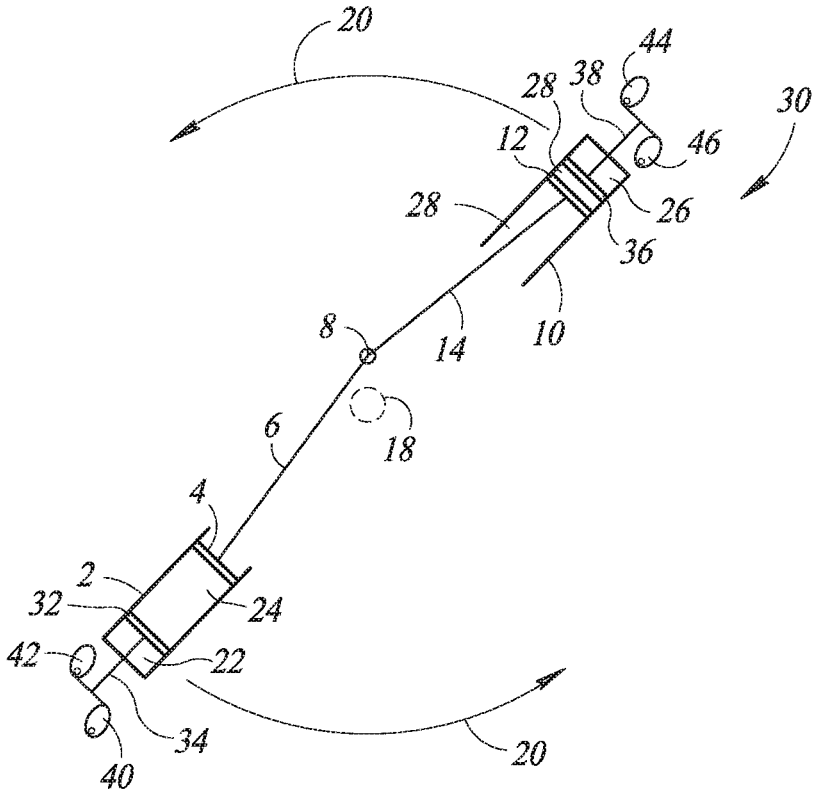
FIG. 1D is another schematic illustration of the pressure differential engine of FIG. 1A in another configuration, according to at least one illustrated embodiment.

FIG. 1A illustrates the engine 30 in a first configuration, which can be referred to as a 0-degree configuration. FIG. 1B illustrates the engine 30 in a second configuration, which can be referred to as a 45-degree configuration. FIG. 1C illustrates the engine 30 in a third configuration, which can be referred to as a 90-degree configuration. FIG. 1D illustrates the engine 30 in a fourth configuration, which can be referred to as a 135-degree configuration. When the engine 30 is in operation, the cylinders 2, 10 can be confined to follow the orbit from the 0-degree configuration to the 45-degree configuration, to the 90-degree configuration, to the 135-degree configuration, and to a 180-degree configuration (not illustrated). The 180-degree configuration is identical to the 0-degree configuration except that the first cylinder 2, first proximal piston 4, and first proximal connecting rod 6 have switched places with the second cylinder 10, second proximal piston 12, and second proximal connecting rod 14.

The rotary engine 30 can be powered by pressure differentials within distinct internal chambers within the cylinders 2, 10 to cause the cylinders 2, 10 to rotate along the orbit. For example, the first cylinder 2 includes a first distal chamber 22 and a first proximal chamber 24, and the second cylinder 10 includes a second distal chamber 26 and a second proximal chamber 28. The first proximal chamber 24 is defined at a proximal end thereof by the first proximal piston 4, and the second proximal chamber 28 is defined at a proximal end thereof by the second proximal piston 12. By introducing high pressures or low pressures into the first proximal chamber 24 and the second proximal chamber 28, mechanical work (e.g., rotation of the cylinders 2, 10) can be generated.

Specifically, the first proximal chamber 24 can be provided with high pressure gas and the second proximal chamber 28 can be provided with low pressure gas in the 0-degree configuration of the engine 30. These pressures can drive the engine 30 to rotate from the 0-degree configuration to the 45-degree configuration, to the 90-degree configuration, to the 135-degree configuration, and to the 180-degree configuration. When the engine 30 reaches the 180-degree configuration, the second proximal chamber 28 can be provided with high pressure gas and the first proximal chamber 24 can be provided with low pressure gas. These pressures can drive the cylinders 2, 10 to rotate back to the 0-degree configuration.

Thus, in engine 30, pressure differentials acting on components of the cylinder 2 can continuously cause rotation of the cylinder 2. That is, cylinder 2 can power such rotation for 360° of the rotation. Pressure differentials acting on components of the cylinder 10 can also continuously cause rotation of the cylinder 10. That is, cylinder 10 can power such rotation for 360° of the rotation.

Figure 2:
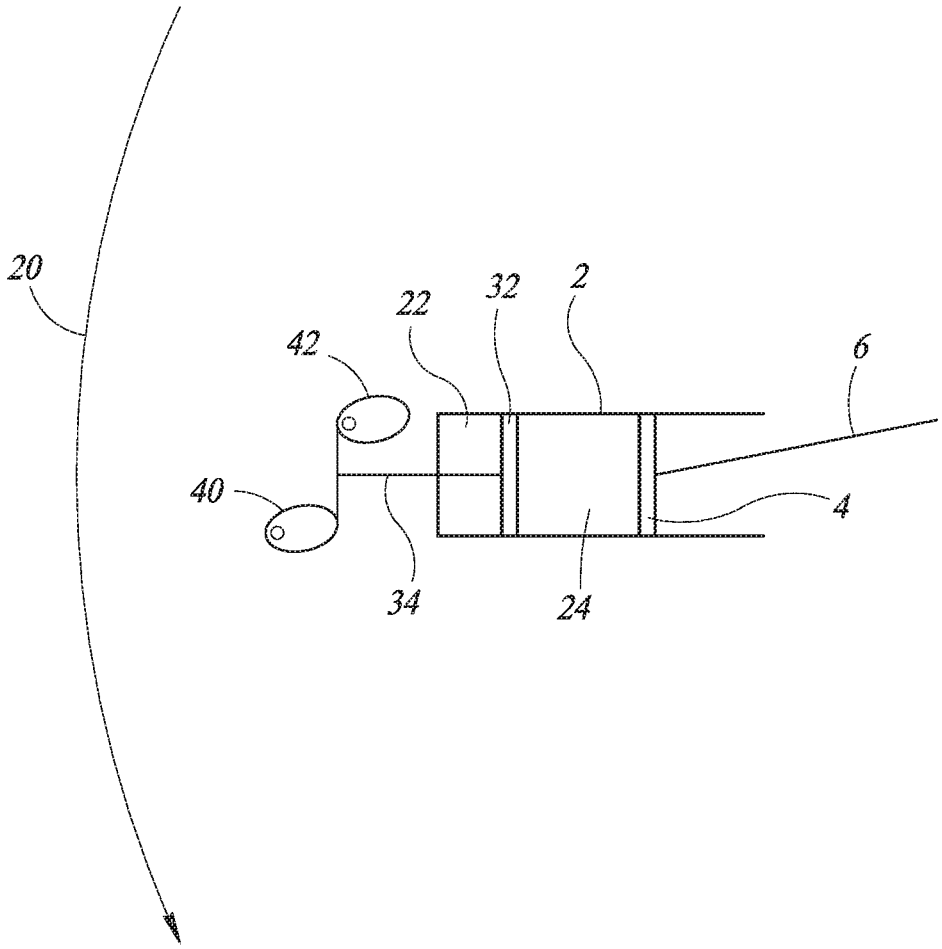
FIG. 2 is another schematic illustration of a portion of the pressure differential engine of FIG. 1A, according to at least one illustrated embodiment.

This use of pressure differentials to generate mechanical work is driven by the eccentricity of the central stationary shaft 8 with respect to the geometric center 18 of the orbit, Specifically, FIG. 2 illustrates a portion of FIG. 1C in greater detail. In FIG. 2, the proximal chamber 24 contains high pressure gas. If the first distal piston 32 (described in greater detail below) encounters resistance (e.g., friction, or if power is drawn from its motion), these pressures exert a net force against the piston 4 that pushes the piston 4 proximally. This net force of the pressures is counteracted by a compression force in the connecting rod 6 that pushes the piston 4 distally. Because the connecting rod 6 acts eccentrically to the piston 4, however, a component of the compression force also acts on the piston 4 to urge the piston 4 to move in the direction of the arrow 20, thereby effecting the rotation of the cylinder 2 along the orbit.

Because the connecting rod 6 in this example is in compression, this effect can be described as the connecting rod 6 "pushing" the cylinder 2 along the orbit. A similar effect allows the other connecting rod 14, which is in tension in the 90-degree configuration shown in FIG. 1C, to "pull" the other cylinder 10 along the orbit. When the proximal chamber 24 is provided with low pressure gas and the proximal chamber 28 is provided with high pressure gas, such as when the engine 30 crosses through the 180-degree configuration, the second connecting rod 14 can switch from pulling to pushing the second cylinder 10 along the orbit and the first connecting rod 6 can switch from pushing to pulling the first cylinder 2 along the orbit.

These pushing and pulling forces are larger when the engine 30 is in the 90-degree configuration than they are when the engine 30 is in the 0-degree configuration, and they change continuously as the engine 30 rotates along the orbit. In fact, when the engine 30 is in the 0-degree configuration, these pushing and pulling forces are negligible or do not exist, because the connecting rods 6, 14 do not act eccentrically to the pistons 4, 12 in this configuration. Thus, rotational momentum built up in the engine 30 instead carries the engine through the 0-degree configuration.

To describe this movement of the components in another way, the proximal pistons 4 and 12 orbit about the central stationary shaft 8 and the cylinders 2 and 10 orbit about the geometric center 18, which is offset by a distance from the central stationary shaft 8. Thus, the proximal pistons 4 and 12 have differential orbits with respect to the cylinders 2 and 10. One effect of these differential orbits is that the proximal pistons 4 and 12 reciprocate with respect to the cylinders 2 and 10. Various other components described herein can have differential orbits with respect to one another, as well as corresponding resulting reciprocation with respect to one another.

Any method of creating suitable pressures in the internal chambers 22, 24, 26, and 28 can be used to drive the engine 30 in this way. For example, compressed gas such as air, $CO_2$, or Nitrogen can be fed into the chambers to drive the engine 30, Thus, the engine 30 can be pneumatic. As another example, the engine 30 can be a combustion engine 30, and the pressures can be created by using spark plugs to ignite fuel within the internal chambers as in an internal combustion engine. The engine 30 can also take advantage of various naturally occurring pressure differentials. For example, a liquid such as water under a large pressure head, such as at a dam, high elevation reservoir, trapped at high tide, etc., can be used to drive the engine 30. Thus, the engine 30 can be hydraulic. The engine 30 can also be steam-powered. A vacuum can similarly be drawn within the chambers in any suitable way to create suitable or desired pressure differentials.

FIGS. 1A-1D also schematically illustrate that engine 30 includes a first distal piston 32 housed and axially slidable within the first cylinder 2, as well as a second distal piston 36 housed and axially slidable within the second cylinder 10. A first distal connecting rod 34 is coupled to the first distal piston 32. A second distal connecting rod 38 is coupled to the second distal piston 36. The first and second distal connecting rods 34, 38, can pass out through distal end portions of the first and second cylinders 2, 10, respectively, which can be sealed around the distal connecting rods 34, 38.

The first cylinder 2 includes a first distal chamber 22, and the second cylinder 10 includes a second distal chamber 26. The first distal chamber 22 is separated from the first proximal chamber 24 by the first distal piston 32, and the second distal chamber 26 is separated from the second proximal chamber 28 by the second distal piston 36. The first distal chamber 22 can be bounded and defined at its distal end by a distal end portion of the first cylinder 2 and at its proximal end by the first distal piston 32. The first proximal chamber 24 can be bounded and defined at its distal end by the first distal piston 32 and at its proximal end by the first proximal piston 4. The second distal chamber 26 can be bounded and defined at its distal end by a distal end portion of the second cylinder 10 and at its proximal end by the second distal piston 36. The second proximal chamber 28 can be bounded and defined at its distal end by the second distal piston 36 and at its proximal end by the second proximal piston 12. By inducing pressure differentials between the first distal chamber 22 and first proximal chamber 24 and between the second distal chamber 26 and the second proximal chamber 28, mechanical work (e.g., reciprocation of the distal connecting rods 34, 38 with respect to the cylinders 2, 10, respectively) can be generated. Given that different components described herein are moving along various orbits and axes with respect to one another, reciprocation in this sense refers to back-and-forth movement of one component with respect to another rather than in a global frame of reference.

Specifically, high pressure gas can be provided or injected into the first proximal chamber 24 and the first distal chamber 22 can be provided with relatively low-pressure gas. The pressure differential that results across the first distal piston 32 can force the first distal piston 32 to move distally. At the end of a distal stroke of the first distal piston 32, low pressure gas can be provided into the first proximal chamber 24 and the first distal chamber 22 can be provided with relatively high-pressure gas. The pressure differential that results across the first distal piston 32 can force the first distal piston 32 to move proximally. When the first distal piston 32 reaches the end of a proximal stroke, this process can be repeated.

Similarly, high pressure gas can be provided or injected into the second distal chamber 26 and the second proximal chamber 28 can be provided with relatively low-pressure gas. The pressure differential that results across the second distal piston 36 can force the second distal piston 36 to move proximally with respect to the second cylinder 10. At the end of a proximal stroke of the second distal piston 36, low pressure gas can be provided into the second distal chamber 26 and the second proximal chamber 28 can be provided with relatively high-pressure gas. The pressure differential that results across the second distal piston 36 can force the second distal piston 36 to move distally. When the second distal piston 36 reaches the end of a distal stroke, this process can be repeated.

FIGS. 1A-1D also schematically illustrate that the first distal connecting rod 34 can be engaged with a first distal cam 40 and a first proximal cam 42, as well as that the second distal connecting rod 38 can be engaged with a second distal cam 44 and a second proximal cam 46. Each of the cams 40, 42, 44, and 46 can be eccentrically mounted to rotate about an axis offset from its center. As explained above, pressure differentials within the cylinders 2, 10 can drive reciprocation of the distal connecting rods 34, 38 with respect to the cylinders 2, 10, respectively. Reciprocation of the connecting rods 34, 38 can, in turn, drive eccentric rotation of the cams 40, 42, 44, and 46. The eccentric rotation of the cams 40, 42, 44, and 46 can then be used to further drive rotation of the cylinders 2, 10 along the orbit, in a manner similar to that described in greater detail below with respect to engine 100.

Figure 3:
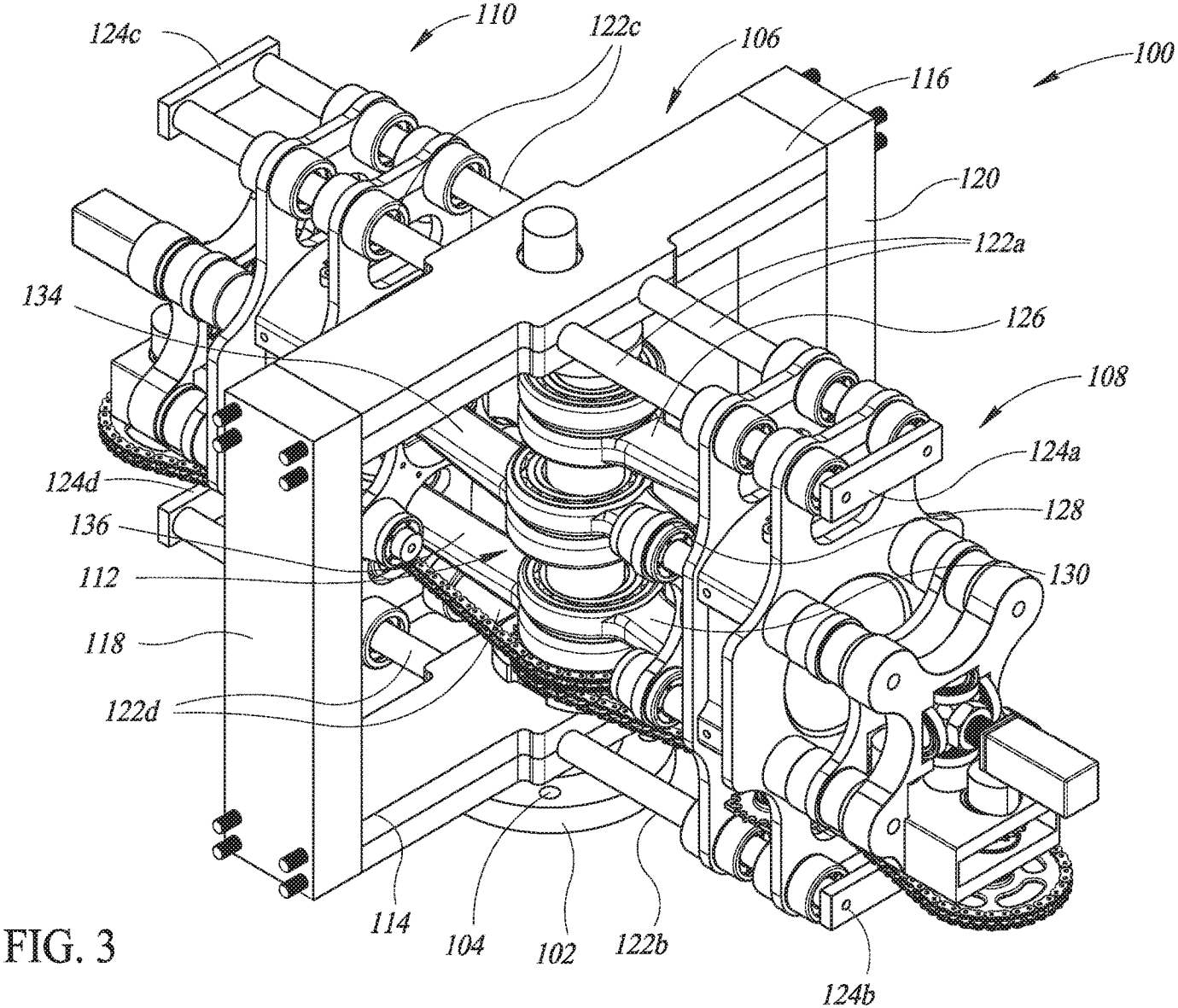
FIG. 3 is a perspective view of another pressure differential engine, according to at least one illustrated embodiment.
Figure 7:
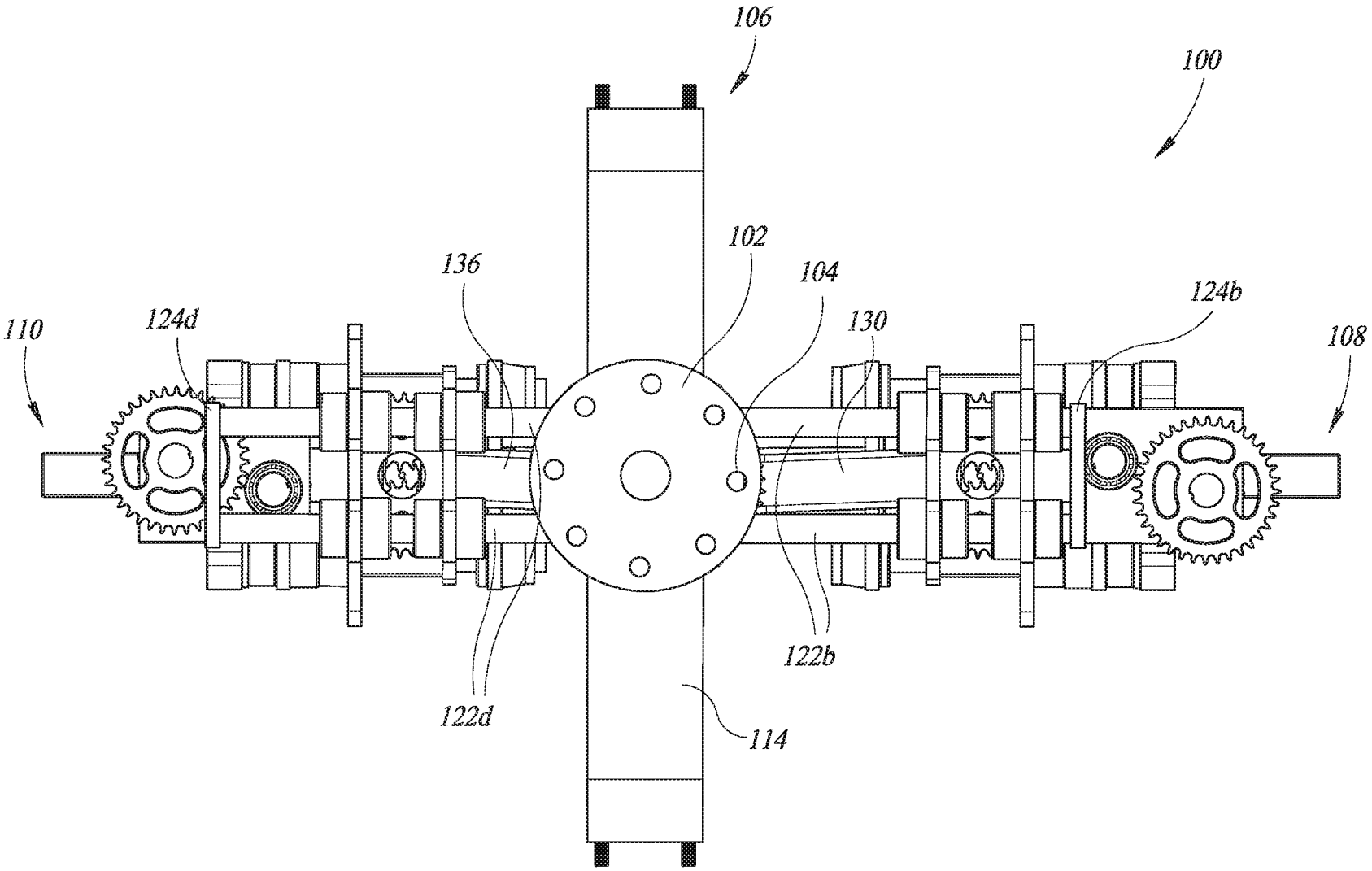
FIG. 7 is a bottom view of the pressure differential engine of FIG. 3, according to at least one illustrated embodiment.
Figure 46:
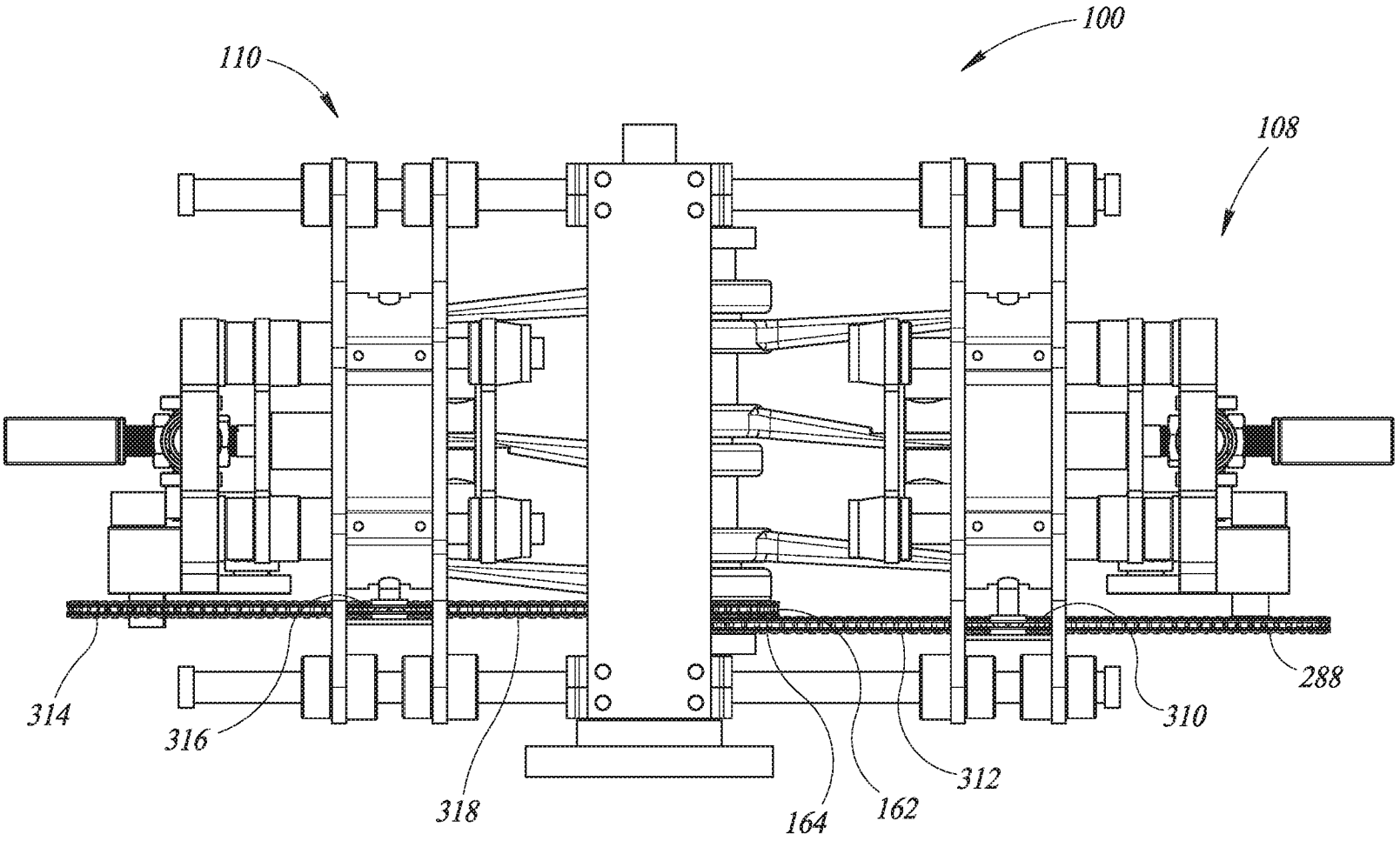
FIG. 46 is a side view of the pressure differential engine of FIG. 3, according to at least one illustrated embodiment.

FIGS. 3-7 illustrate perspective, side, top, end, and bottom views, respectively, of another embodiment of a rotary engine 100. Rotary engine 100 operates on some of the same principles as the engine 30, and can include any of the features of rotary engine 30. FIG. 3 illustrates the engine 100 in a fully-assembled state, and FIGS. 4-7 illustrate the engine 100 in a fully-assembled state, except for a pair of chains which are illustrated in FIGS. 3 and 46. Figures following FIG. 7 illustrate the engine 100 in a relatively disassembled state and then in generally increasing states of assembly. Engine 100 is designed and optimized to provide high efficiency in the conversion of energy from pressure differentials to mechanical work.

Engine 100 includes a stationary base plate 102 having a plurality of holes 104 formed therein. The engine 100 can be bolted down or installed in an operative location by passing bolts (not illustrated) through the holes 104 and coupling the engine 100 to a foundation or larger installation. Engine 100 also includes a main frame 106, a first piston assembly 108, a second piston assembly 110 opposed to the first piston assembly 108 across the main frame 106, and a central stationary shaft assembly 112. Compressed air tanks (not illustrated) can be coupled to the main frame 106 to power the engine 100.

The main frame 106 includes a horizontal bottom bar 114, a horizontal top bar 116, a first vertical side post 118, and a second vertical side post 120, which together can form a rectangular support structure. The main frame 106 also includes a pair of support rods 122*a*, a pair of support rods 122*b*, a pair of support rods 122*c*, and a pair of support rods 122*d* (collectively, support rods 122) extending laterally outward from and rigidly coupled to central portions of the bottom bar 114 or the top bar 116. The support rods 122 can form rails along which the first and second piston assemblies 108, 110 can slide.

For example, the first piston assembly 108 can be slidably mounted on the pair of support rods 122*a* extending laterally outward from a central portion of the top bar 116 and on the pair of support rods 122*b* extending laterally outward from a central portion of the bottom bar 114. Similarly, the second piston assembly 110 can be slidably mounted on the pair of support rods 122*c* extending laterally outward from a central portion of the top bar 116 and on the pair of support rods 122*d* extending laterally outward from a central portion of the bottom bar 114.

The main frame 106 also includes an end cap 124*a* mounted at the distal ends of the support rods 122*a* to couple the distal ends of the support rods 122*a* to one another, such as to prevent the first piston assembly 108 from sliding off the distal ends of the support rods 122*a*. Similarly, the main frame 106 also includes an end cap 124*b* mounted at the distal ends of the support rods 122*b* to couple the distal ends of the support rods 122*b* to one another, such as to prevent the first piston assembly 108 from sliding off the distal ends of the support rods 122*b*. Similarly, the main frame 106 also includes an end cap 124*c* mounted at the distal ends of the support rods 122*c* to couple the distal ends of the support rods 122*c* to one another, such as to prevent the second piston assembly 110 from sliding off the distal ends of the support rods 122*c*. Similarly, the main frame 106 also includes an end cap 124*d* mounted at the distal ends of the support rods 122*d* to couple the distal ends of the support rods 122*d* to one another, such as to prevent the second piston assembly 110 from sliding off the distal ends of the support rods 122*d*.

The first piston assembly 108 includes three connecting rods 126, 128, and 130 that couple other components of the first piston assembly 108 to the central stationary shaft assembly 112. Similarly, the second piston assembly 110 includes three connecting rods 132, 134, and 136 that couple other components of the second piston assembly 110 to the central stationary shaft assembly 112. Rotary engine 100 is illustrated having two piston assemblies 108, 110 separated by 180°. In different embodiments, the engine 100 can have 3, 4, 5, 6, 8, 10, 12, or any desirable or suitable number of piston assemblies. For example, the engine 100 can have three piston assemblies separated by 120° or four piston assemblies separated by 90°. In some embodiments, the engine 100 can have a single piston assembly, and can include a counterweight positioned opposite to the single piston assembly to maintain balance of the engine 100.

Figure 8:
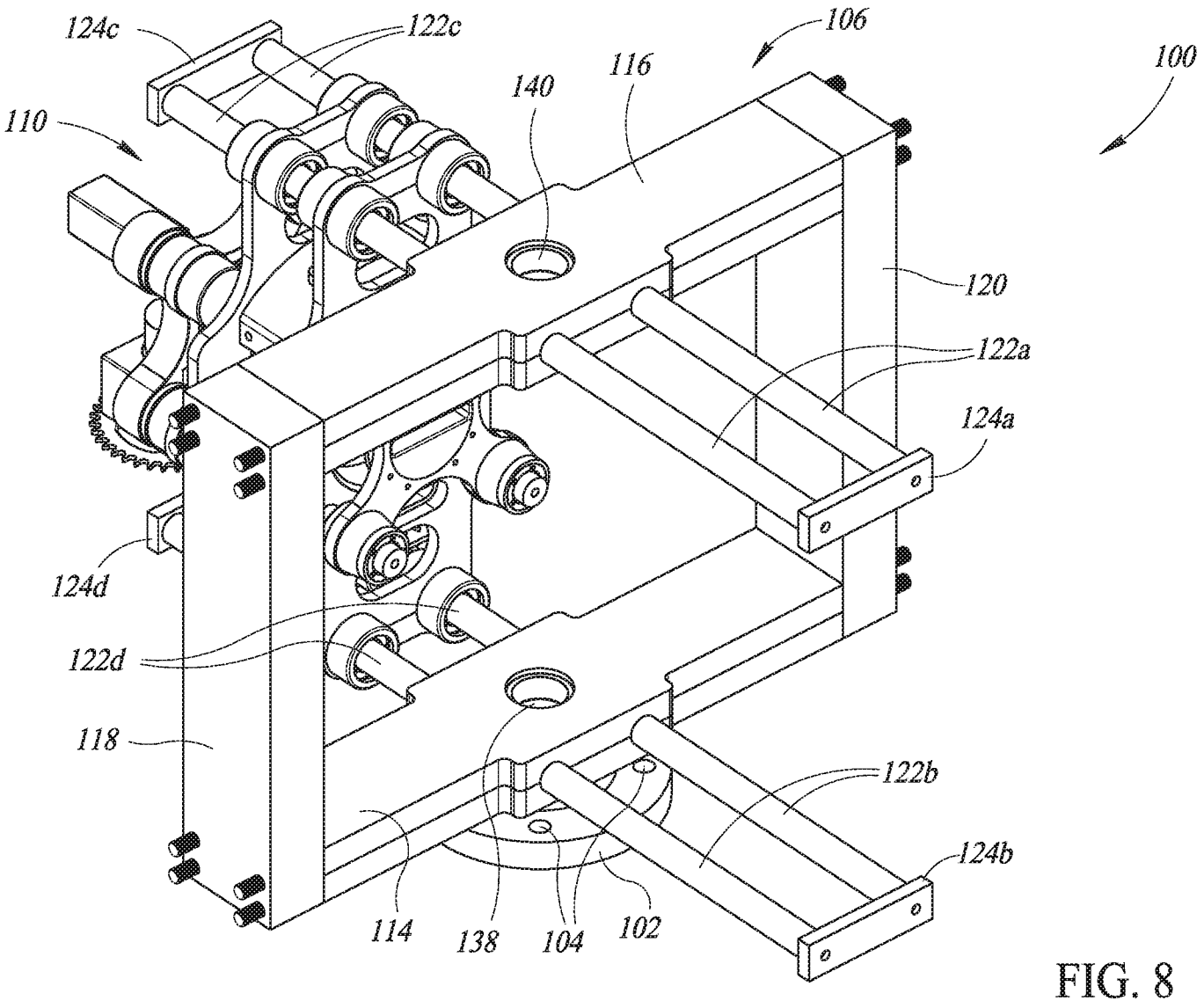
FIG. 8 is a perspective view of the pressure differential engine of FIG. 3 in one state of disassembly, according to at least one illustrated embodiment.
Figure 9:
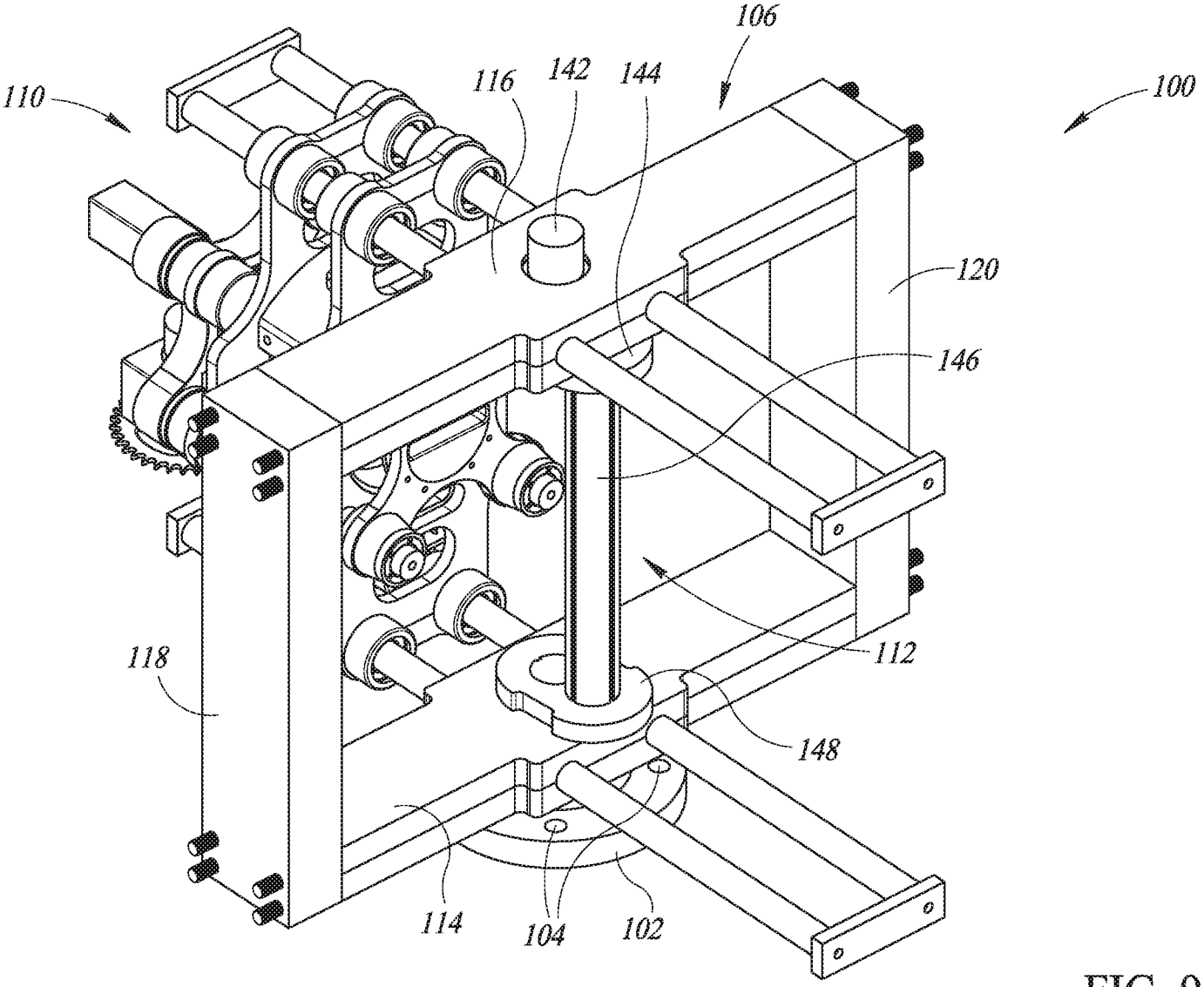
FIG. 9 is a perspective view of the pressure differential engine of FIG. 3 in another state of disassembly, according to at least one illustrated embodiment.
Figure 10:
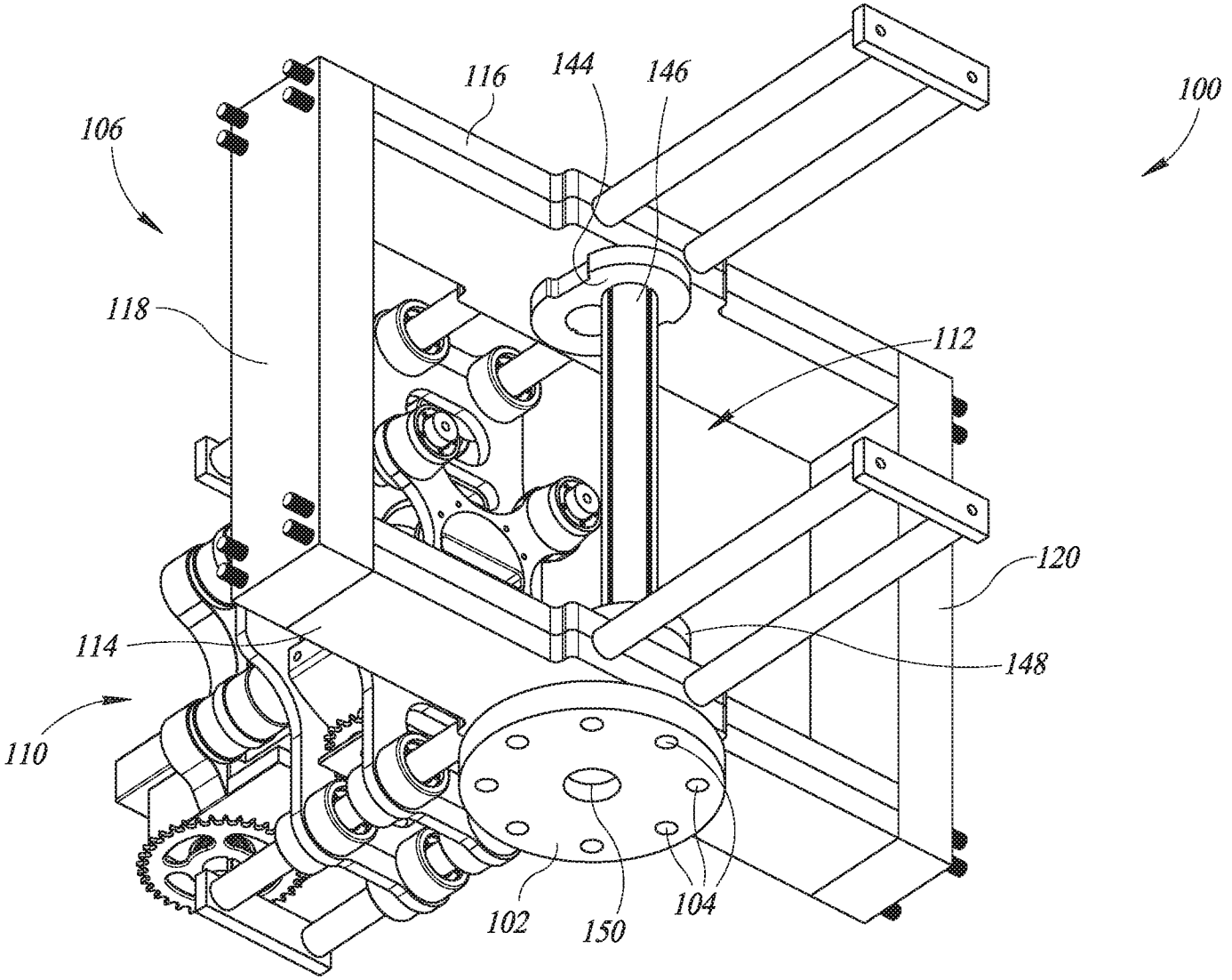
FIG. 10 is another perspective view of the pressure differential engine as shown in FIG. 9, according to at least one illustrated embodiment.
Figure 11D:
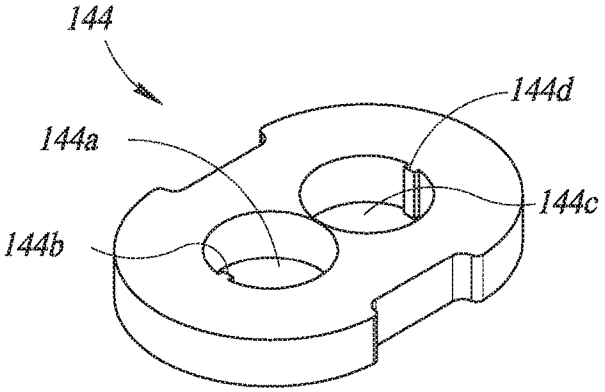
FIG. 11D is an illustration of another component of the pressure differential engine of FIG. 3, according to at least one illustrated embodiment.
Figure 11E:
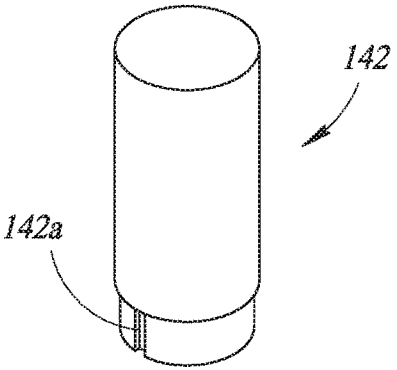
FIG. 11E is an illustration of another component of the pressure differential engine of FIG. 3, according to at least one illustrated embodiment.
Figure 11C:
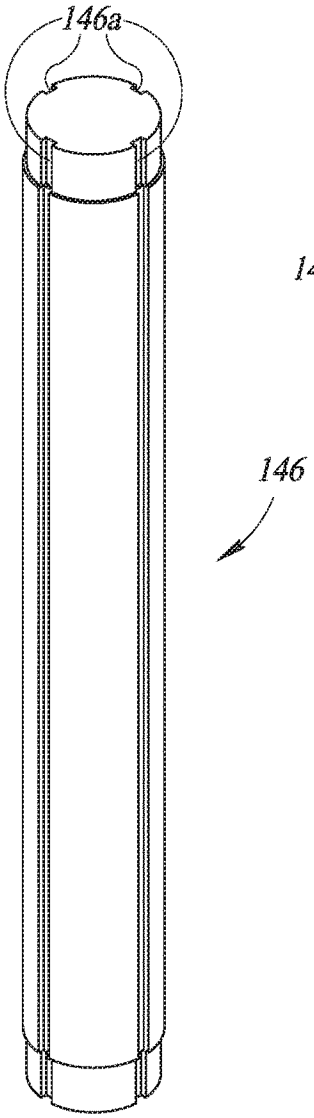
FIG. 11C is an illustration of another component of the pressure differential engine of FIG. 3, according to at least one illustrated embodiment.
Figure 11A:
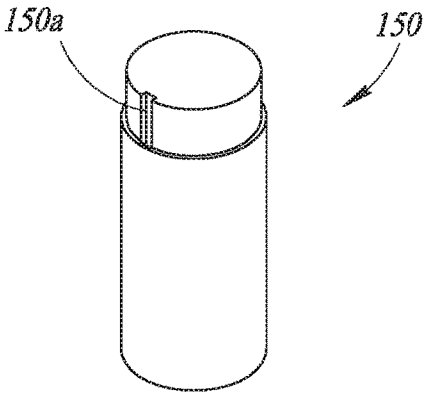
FIG. 11A is an illustration of a component of the pressure differential engine of FIG. 3. according to at least one illustrated embodiment.
Figure 11B:
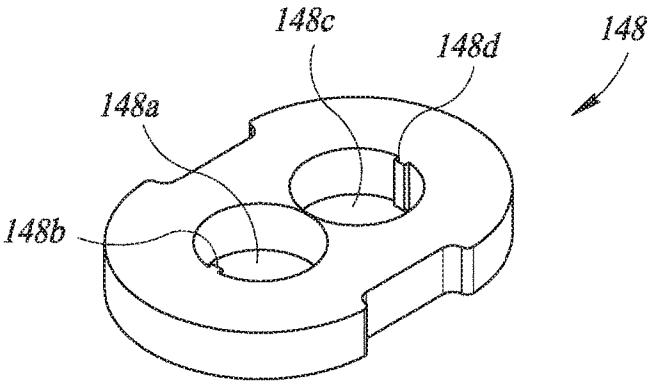
FIG. 11B is an illustration of another component of the pressure differential engine of FIG. 3, according to at least one illustrated embodiment.

FIG. 8 shows the engine 100 with the first piston assembly 108, the central stationary shaft assembly 112, and the connecting rods 132, 134, and 136 removed. As shown in FIG. 8, the bottom bar 114 and the top bar 116 of the main frame 106 include respective vertical boreholes 138, 140 extending through their centers. FIGS. 9 and 10 show top and bottom perspective views, respectively, of the engine 100 with the first piston assembly 108, portions of the central stationary shaft assembly 112, and the connecting rods 132, 134, and 136 removed. As shown in FIGS. 9 and 10, the central stationary shaft assembly 112 can include a top shaft portion 142, a top oval-shaped coupling and offsetting plate 144, an intermediate shaft portion 146, a bottom oval-shaped coupling and offsetting plate 148, and a bottom shaft portion 150.

The bottom shaft portion 150 is positioned within the vertical borehole 138 and extends through the center of the bottom bar 114. The bottom shaft portion 150 can be rigidly coupled to the stationary base plate 102 and therefore can also be stationary. The bottom oval-shaped coupling plate 148 is eccentrically coupled to a top end of the bottom shaft portion 150 such that it extends laterally outward from a central longitudinal axis of the bottom shaft portion 150. The bottom coupling plate 148 can be rigidly coupled to the bottom shaft portion 150 and therefore can also be stationary. The intermediate shaft portion 146 is eccentrically coupled to a top end of the bottom coupling plate 148 such that it has a central longitudinal axis that is parallel to but not coincident with (that is, offset from) the central longitudinal axis of the bottom shaft portion 150. The intermediate shaft portion 146 can be rigidly coupled to the bottom coupling plate 148 and therefore can also be stationary.

The top oval-shaped coupling plate 144 is eccentrically coupled to a top end of the intermediate shaft portion 146 such that it extends laterally outward from the central longitudinal axis of the intermediate shaft portion 146. The top coupling plate 144 can be rigidly coupled to the intermediate shaft portion 146 and therefore can also be stationary. The top shaft portion 142 is positioned within the vertical borehole 140 and extends through the center of the top bar 116. The top shaft portion 142 is eccentrically coupled to a top end of the top coupling plate 144 such that it has a central longitudinal axis that is parallel to but not coincident with (that is, offset from) the central longitudinal axis of the intermediate shaft portion 146. The central longitudinal axis of the top shaft portion 142 is coincident with the central longitudinal axis of the bottom shaft portion 150. The top shaft portion 142 can be rigidly coupled to the top coupling plate 144 and therefore can also be stationary.

FIGS. 11A-11E show the bottom shaft portion 150, bottom coupling plate 148, intermediate shaft portion 146, top coupling plate 144, and top shaft portion 142, respectively, in greater detail, and at the same orientation so as to illustrate how they can be assembled and interact. As shown in FIGS. 11A-11E, the bottom shaft portion 150 can be cylindrical and can include a groove or keyway 150*a* at its top end portion. The bottom coupling plate 148 can include a first opening 148*a* having a ridge or key 148*b* protruding therefrom for receiving the top end portion of the bottom shaft portion 150 and engaging with the keyway 150*a* of the bottom shaft portion 150. The bottom coupling plate 148 can also include a second opening 148*c*, which can be offset from the first opening 148*a* by a predetermined distance, and which can have a ridge or key 148*d* protruding therefrom. The second opening 148*c* and key 148*d* can receive the intermediate shaft portion 146 and engage with a keyway 146*a* provided therein.

The intermediate shaft portion 146 can be cylindrical and can include a plurality of longitudinal grooves or keyways 146*a* provided in its external surface for engaging with the key 148*d* and a key 144*d* of the top coupling plate 144. The plurality of longitudinal grooves or keyways 146*a* can include four keyways 146*a* that are spaced at 90° with respect to each other around the intermediate shaft portion 146. The top coupling plate 144 can include a first opening 144*a* having a ridge or key 144*b* protruding therefrom for receiving a bottom end portion of the top shaft portion 142 and engaging with a keyway 142*a* of the top shaft portion 142. The top coupling plate 144 can also include a second opening 144*c*, which can be offset from the first opening 144*a* by the predetermined distance, and which can have a ridge or key 144*d* protruding therefrom. The second opening 144*c* and key 144*d* can receive the intermediate shaft portion 146 and engage with the keyway 146*a* provided therein. The top shaft portion 142 can be cylindrical and can include the keyway 142*a* at its bottom end portion.

Thus, the base plate 102, bottom shaft portion 150, bottom coupling plate 148, intermediate shaft portion 146, top coupling plate 144, and top shaft portion 142 can be stationary and can form a stationary foundation of the engine 100 around which other components can rotate. For example, the main frame 106 and the components mounted thereto, e.g., the first and second piston assemblies 108, 110 mounted on the support rods 122, can rotate around the stationary foundation when the engine 100 operates. Specifically, the main frame 106 and the components mounted thereto can rotate about the central longitudinal axes of the bottom shaft portion 150 and the top shaft portion 142.

Figure 12:
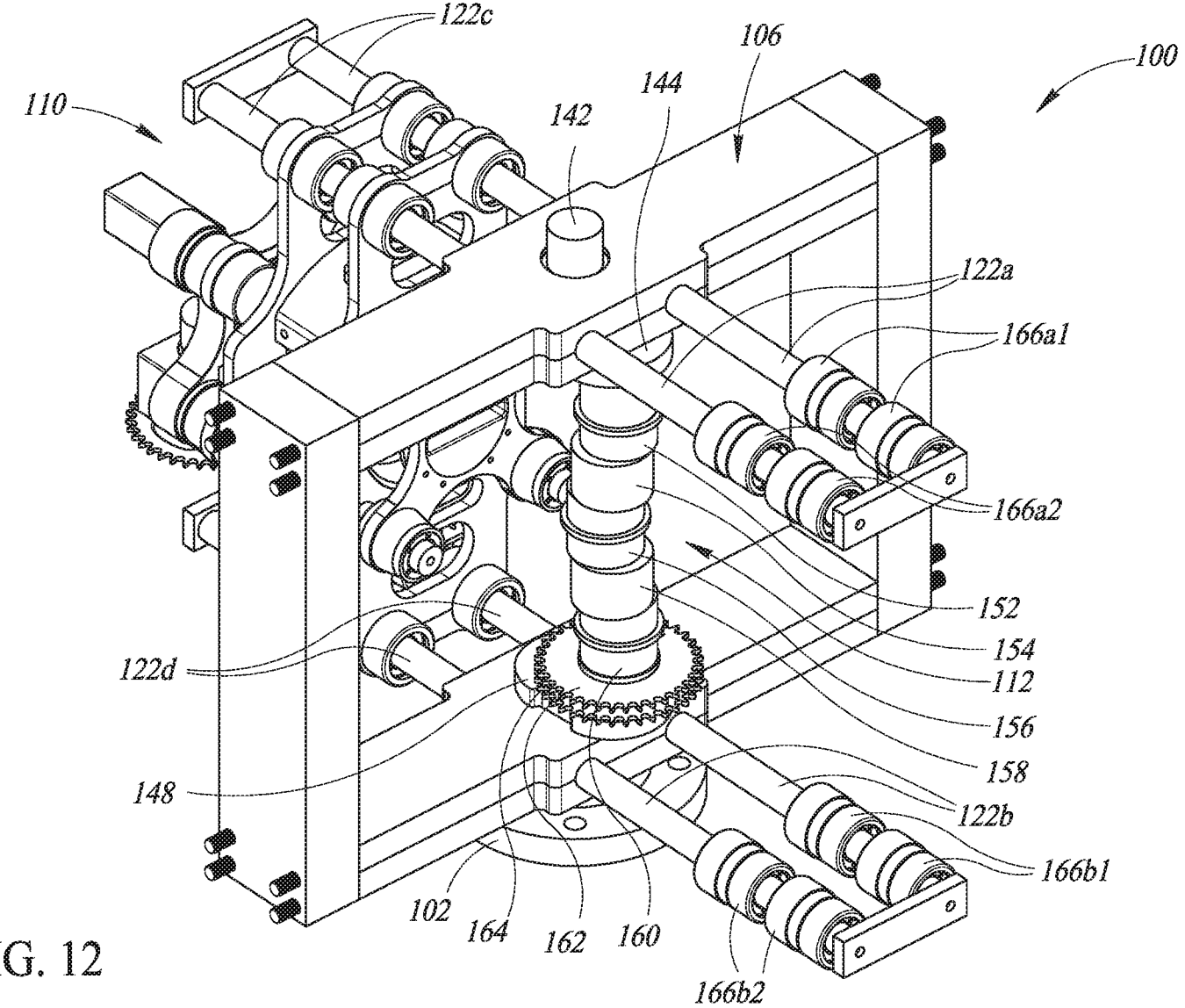
FIG. 12 is a perspective view of the pressure differential engine of FIG. 3 in another state of disassembly, according to at least one illustrated embodiment.

FIG. 12 illustrates further details of the central stationary shaft assembly 112 and the first piston assembly 108. The central stationary shaft assembly 112 can include additional components mounted on the intermediate shaft portion 146. For example, a top eccentric sleeve or collar 152, a top circular collar 154, an intermediate eccentric collar 156, a bottom circular collar 158, and a bottom eccentric collar 160 can be mounted, from top to bottom in the order listed, on the intermediate shaft portion 146. A proximal top gear 162 and a proximal bottom gear 164 can further be mounted on and fixed to the bottom eccentric collar 160 such that the top and bottom gears 162, 164 are also stationary.

Figure 13:
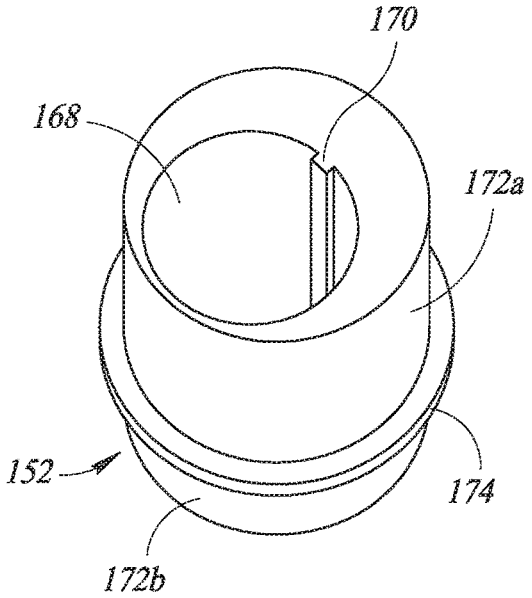
FIG. 13 is an illustration of a component of the pressure differential engine of FIG. 3, according to at least one illustrated embodiment.

FIG. 13 illustrates the top eccentric collar 152 in greater detail. The top eccentric collar 152 includes a central circular borehole 168 having a ridge or key 170 formed therein. The intermediate shaft portion 146 and a keyway 146*a* formed therein can be received within the central circular borehole 168 such that the top eccentric collar 152 is mounted on the intermediate shaft portion 146 and the key 170 engages the keyway 146*a* to rotationally lock the top eccentric collar 152 to the intermediate shaft portion 146. The top eccentric collar 152 also includes a circular external surface 172 having a central longitudinal axis offset from a central longitudinal axis of the central circular borehole 168. The circular external surface 172 is represented in the drawings by the combination of, and is divided by an external circumferential ridge 174 into, a top portion 172*a* and a bottom portion 172*b*. The top portion 172*a* of the external surface 172 is larger (has a larger height, or is longer) than the bottom portion 172*b* of the external surface 172.

Figure 14:
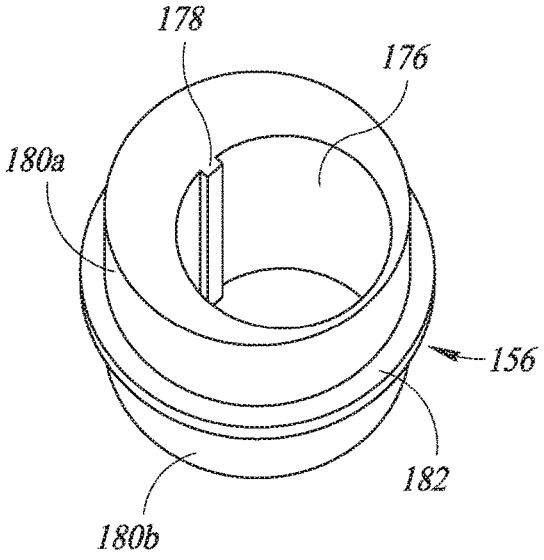
FIG. 14 is an illustration of another component of the pressure differential engine of FIG. 3, according to at least one illustrated embodiment.

FIG. 14 illustrates the intermediate eccentric collar 156 in greater detail. The intermediate eccentric collar 156 includes a central circular borehole 176 having a ridge or key 178 formed therein. The intermediate shaft portion 146 and a keyway 146*a* formed therein can be received within the central circular borehole 176 such that the intermediate eccentric collar 156 is mounted on the intermediate shaft portion 146 and the key 178 engages the keyway 146*a* to rotationally lock the intermediate eccentric collar 156 to the intermediate shaft portion 146. The intermediate eccentric collar 156 also includes a circular external surface 180 having a central longitudinal axis offset from a central longitudinal axis of the central circular borehole 176. The circular external surface 180 is represented in the drawings by the combination of, and is divided by an external circumferential ridge 182 into, a top portion 180*a* and a bottom portion 180*b* by an external circumferential ridge 182. The top portion 180*a* of the external surface 180 is about the same size (has about the same height, or is about the same length) as the bottom portion 180*b* of the external surface 180.

Figure 15:
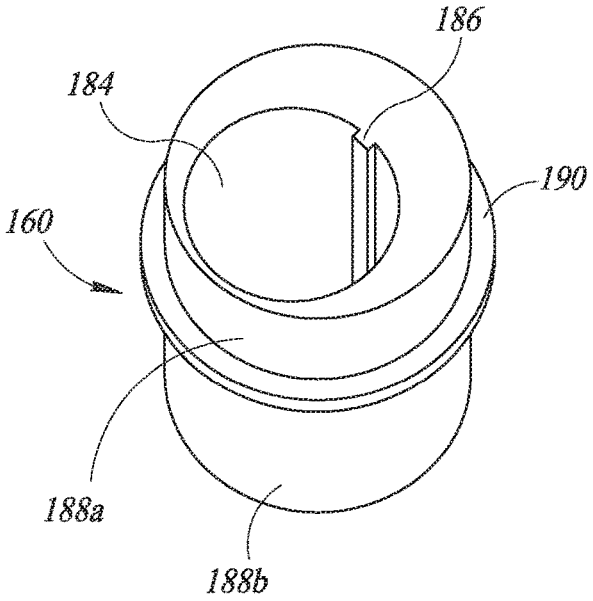
FIG. 15 is an illustration of another component of the pressure differential engine of FIG. 3, according to at least one illustrated embodiment.

FIG. 15 illustrates the bottom eccentric collar 160 in greater detail. The bottom eccentric collar 160 includes a central circular borehole 184 having a ridge or key 186 formed therein. The intermediate shaft portion 146 and a keyway 146*a* formed therein can be received within the central circular borehole 184 such that the bottom eccentric collar 160 is mounted on the intermediate shaft portion 146 and the key 186 engages the keyway 146*a* to rotationally lock the bottom eccentric collar 160 to the intermediate shaft portion 146. The bottom eccentric collar 160 also includes a circular external surface 188 having a central longitudinal axis offset from a central longitudinal axis of the central circular borehole 184. The circular external surface 188 is represented in the drawings by the combination of, and is divided by an external circumferential ridge 190 into, a top portion 188*a* and a bottom portion 188*b*. The top portion 188*a* of the external surface 188 is smaller (has a smaller height, or is shorter) than the bottom portion 188*b* of the external surface 188.

FIGS. 13-15 illustrate the top, intermediate, and bottom eccentric collars 152, 156, 160, respectively, at the same orientation as they are installed on the intermediate shaft 146, so as to illustrate how they can interact when mounted on the intermediate shaft portion 146. For example, the top and bottom eccentric collars 152, 160 have very similar or identical structures except for the location of the external circumferential ridges 174, 190, and are mounted on the intermediate shaft portion 146 in the same orientation. Thus, elements rotationally mounted to the top and bottom eccentric collars 152, 160 are rotatable about the same longitudinal axis as one another, which longitudinal axis is defined by the central longitudinal axes of the external surfaces 172, 188, which are coincident with one another.

As another example, the intermediate eccentric collar 156 has a similar structure as the top and bottom eccentric collars 152, 160, but is mounted on the intermediate shaft portion 146 in an orientation different from the top and bottom eccentric collars 152, 160. Thus, elements rotationally mounted to the intermediate eccentric collar 156 are rotatable about a different longitudinal axis from components rotatably mounted to the top or bottom eccentric collars 152, 160, which different longitudinal axis is defined by the central longitudinal axis of the external surface 180.

Figure 16:
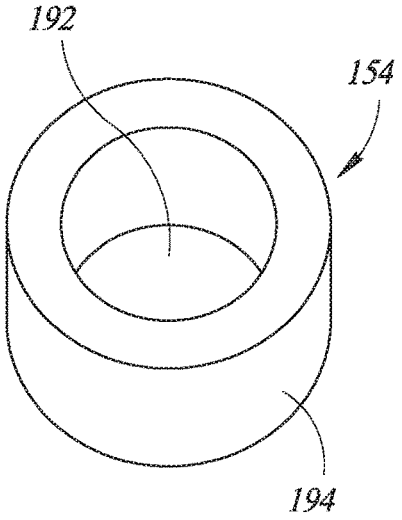
FIG. 16 is an illustration of another component of the pressure differential engine of FIG. 3, according to at least one illustrated embodiment.

FIG. 16 illustrates the top circular collar 154 in greater detail. The top circular collar 154 includes a central circular borehole 192. The intermediate shaft portion 146 can be received within the central circular borehole 192 such that the top circular collar 154 is mounted on the intermediate shaft portion 146. The top circular collar 154 also includes a circular external surface 194 having a central longitudinal axis coincident with a central longitudinal axis of the central circular borehole 192. The bottom circular collar 158 can have a structure similar or identical to the top circular collar 154. The top and bottom circular collars 154, 158 can act as spacers between and separating the eccentric collars 152, 156, 160.

Figure 17:
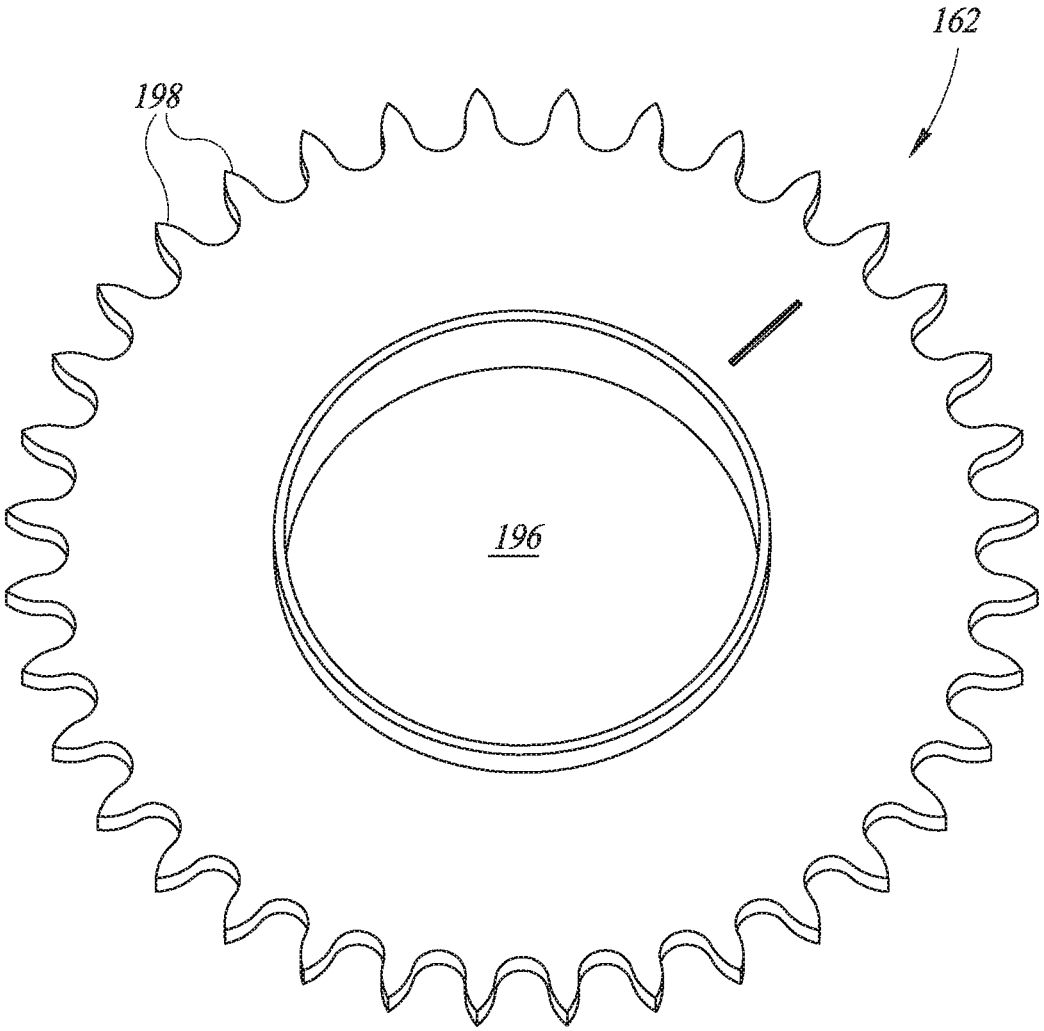
FIG. 17 is an illustration of another component of the pressure differential engine of FIG. 3, according to at least one illustrated embodiment.

FIG. 17 illustrates the top gear 162 in greater detail. The top gear 162 includes a central circular borehole 196. The bottom eccentric collar 160 can be received within the central circular borehole 196 such that the top gear 162 is mounted on the bottom eccentric collar 160. The top gear 162 also includes a plurality of teeth 198 formed along an outer circumference thereof. The bottom gear 164 can have a structure similar or identical to the top gear 162. As noted above, the top and bottom gears 162, 164 are fixed to the bottom eccentric collar 160. In some embodiments, the top and bottom gears 162, 164 can be fixed to the bottom eccentric collar 160 using keys and keyways as described elsewhere herein.

FIG. 12 also illustrates that the first piston assembly 108 can include a plurality of roller bearings 166 positioned on the support rods 122*a*, 122*b*. Specifically, a pair of roller bearings 166*a* 1 can be provided on a first one of the support rods 122*a*, a pair of roller bearings 166*a* 2 can be provided on a second one of the support rods 122*a*, a pair of roller bearings 166*b* 1 can be provided on a first one of the support rods 122*b*, and a pair of roller bearings 166*b* 2 can be provided on a second one of the support rods 122*b*. The roller bearings 166 slide along the support rods 122 and allow the first piston assembly 108 to translate freely along the support rods 122.

Figure 18:
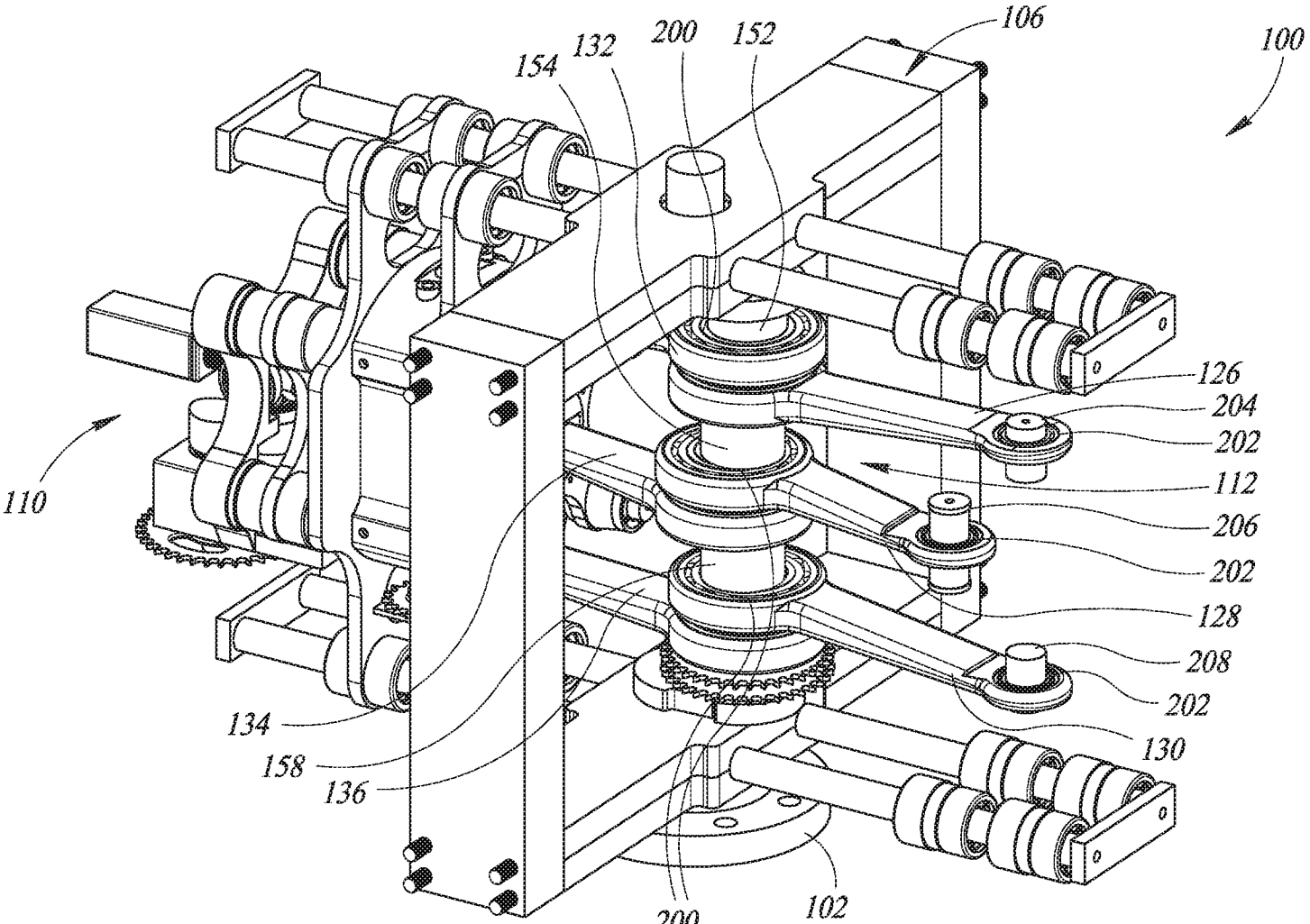
FIG. 18 is a perspective view of the pressure differential engine of FIG. 3 in another state of disassembly, according to at least one illustrated embodiment.

FIG. 18 illustrates the connecting rods 126, 128, and 130 of the first piston assembly 108 mounted on the central stationary shaft assembly 112. Specifically, the bottom connecting rod 130 of the first piston assembly 108 is mounted on a first roller bearing 200 mounted on the top portion 188*a* of the external surface 188 of the bottom eccentric collar 160 and thus the bottom connecting rod 130 is rotatably mounted to the central stationary shaft assembly 112, The middle connecting rod 128 of the first piston assembly 108 is mounted on a second roller bearing 200 mounted on the top portion 180*a* of the external surface 180 of the intermediate eccentric collar 156 and thus the middle connecting rod 128 is rotatably mounted to the central stationary shaft assembly 112. The top connecting rod 126 of the first piston assembly 108 is mounted on a third roller bearing (not visible in FIG. 18) mounted on the bottom portion 172*b* of the external surface 172 of the top eccentric collar 152 and thus the top connecting rod 126 is rotatably mounted to the central stationary shaft assembly 112, As noted above, elements rotatably mounted to the top and bottom eccentric collars 152, 160 are rotatable about the same longitudinal axis as one another, which longitudinal axis is defined by the central longitudinal axes of the external surfaces 172, 188, which are coincident with one another. Thus, the bottom connecting rod 130, mounted on the bottom eccentric collar 160, and the top connecting rod 126, mounted on the top eccentric collar 152, are rotatable about the central stationary shaft assembly 112 on the same longitudinal axis as one another. As also noted above, elements rotatably mounted to the intermediate eccentric collar 156 are rotatable about a different longitudinal axis from components rotatably mounted to the top or bottom eccentric collars 152, 160, which different longitudinal axis is defined by the central longitudinal axis of the external surface 180, Thus, the middle connecting rod 128, mounted on the intermediate eccentric collar, is rotatable about the central stationary shaft assembly 112 on a different longitudinal axis than the top and bottom connecting rods 126, 130.

Details of the second piston assembly 110 are not described separately herein because the second piston assembly 110 can have a structure similar to, identical to, or a mirror image of, the first piston assembly 108, Differences between the first piston assembly 108 and the second piston assembly 110 are described herein, and arise primarily with regard to the coupling of the piston assemblies 108, 110 to the central stationary shaft assembly 112.

Figure 4:
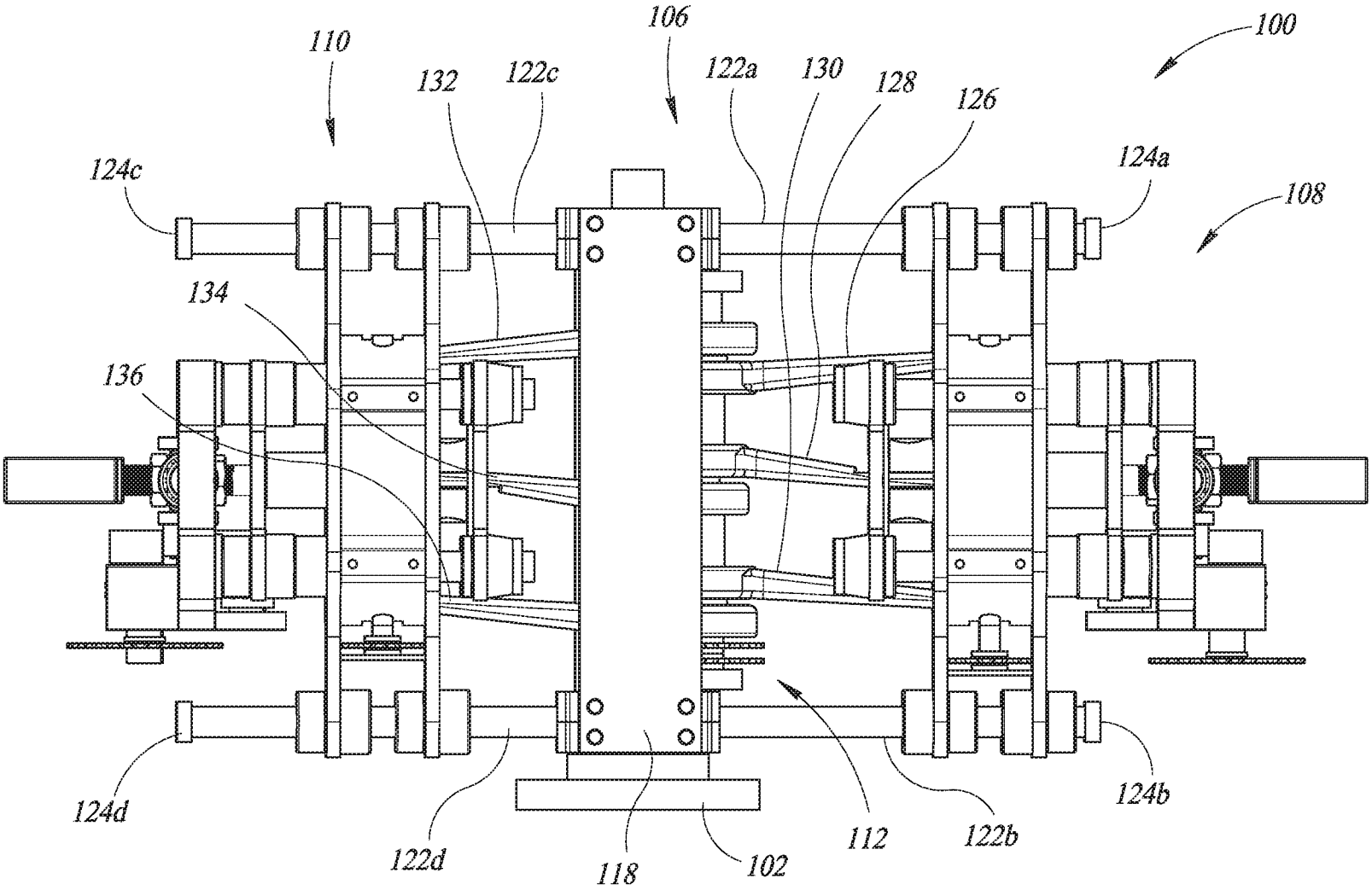
FIG. 4 is a side view of the pressure differential engine of FIG. 3, according to at least one illustrated embodiment.

For example, as shown in FIGS. 4 and 18, the bottom connecting rod 136 of the second piston assembly 110 is mounted on a fourth roller bearing (not visible in FIG. 4 or 18) mounted on the bottom portion 188*b* of the external surface 188 of the bottom eccentric collar 160. The bottom connecting rod 136 of the second piston assembly 110 can be separated on the bottom eccentric collar 160 from the bottom connecting rod 130 of the first piston assembly 108 by the external circumferential ridge 190 of the bottom eccentric collar 160.

Further, the middle connecting rod 134 of the second piston assembly 110 is mounted on a fifth roller bearing (not visible in FIG. 4 or 18) mounted on the bottom portion 180*b* of the external surface 180 of the intermediate eccentric collar 156. The middle connecting rod 134 of the second piston assembly 110 can be separated on the intermediate eccentric collar 156 from the middle connecting rod 128 of the first piston assembly 108 by the external circumferential ridge 182 of the intermediate eccentric collar 156.

Further still, the top connecting rod 132 of the second piston assembly 110 is mounted on a sixth roller bearing 200 mounted on the top portion 172*a* of the external surface 172 of the top eccentric collar 152. The top connecting rod 132 of the second piston assembly 110 can be separated on the top eccentric collar 152 from the top connecting rod 126 of the first piston assembly 108 by the external circumferential ridge 174 of the top eccentric collar 152.

As illustrated in FIG. 4, the proximal end portion of any one of the connecting rods 126, 128, 130, 132, 134, and 136, which is coupled by a roller bearing to the central stationary shaft assembly 112, can be at a different elevation than the distal end portion of the respective connecting rod. For example, the proximal end portions of the bottom connecting rods 130, 136 can be stacked on top of one another on the central stationary shaft assembly 112 and the distal end portions of the bottom connecting rods 130, 136 can be at the same elevation. Further, the proximal end portions of the middle connecting rods 128, 134 can be stacked on top of one another on the central stationary shaft assembly 112 and the distal end portions of the middle connecting rods 128, 134 can be at the same elevation. Further still, the proximal end portions of the top connecting rods 126, 132 can be stacked on top of one another on the central stationary shaft assembly 112 and the distal end portions of the top connecting rods 126, 132 can be at the same elevation. That the distal end portions of opposing connecting rods are at the same elevation allows the other components of the first and second piston assemblies 108, 110, to be identical to, similar to, or mirror images of one another.

Figure 19:
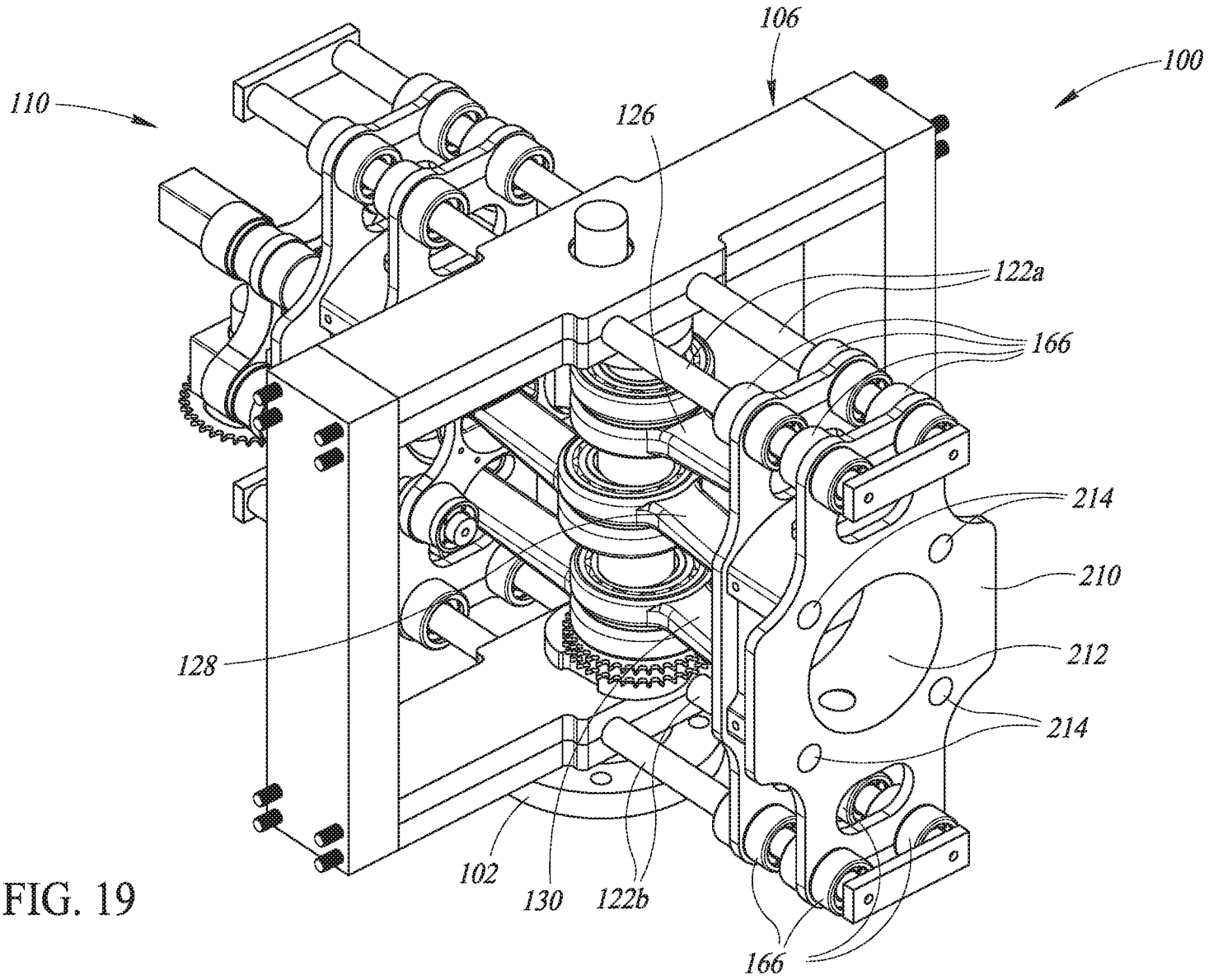
FIG. 19 is a perspective view of the pressure differential engine of FIG. 3 in another state of disassembly, according to at least one illustrated embodiment.
Figure 21:
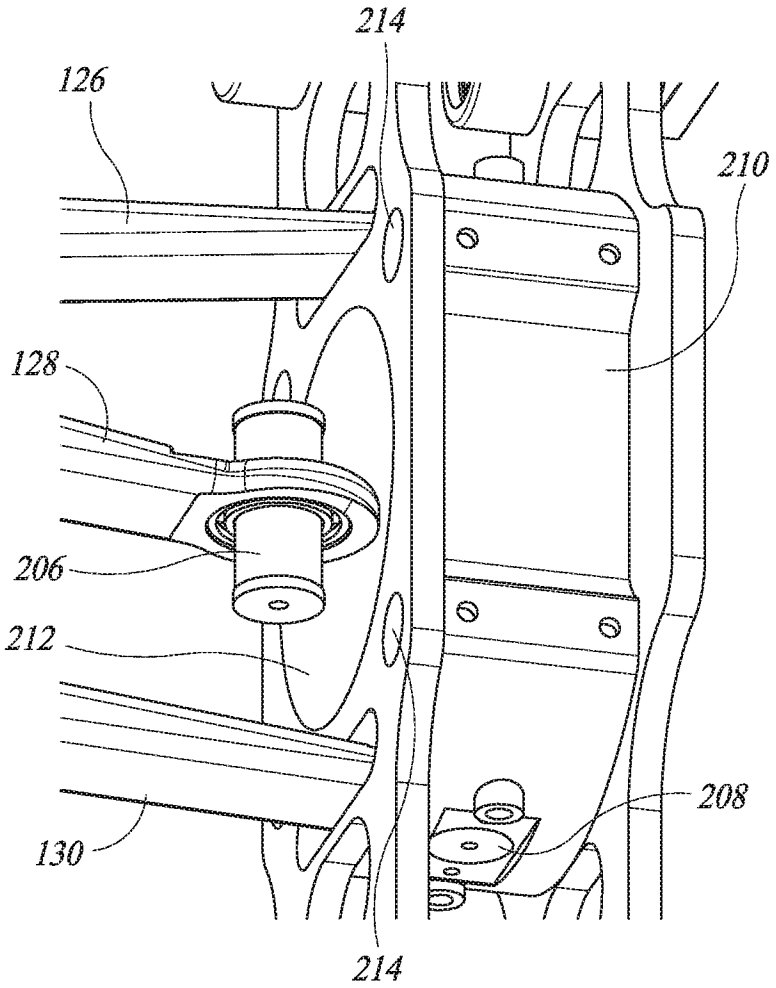
FIG. 21 is another partial perspective view of the pressure differential engine as shown in FIG. 19, according to at least one illustrated embodiment.
Figure 20:
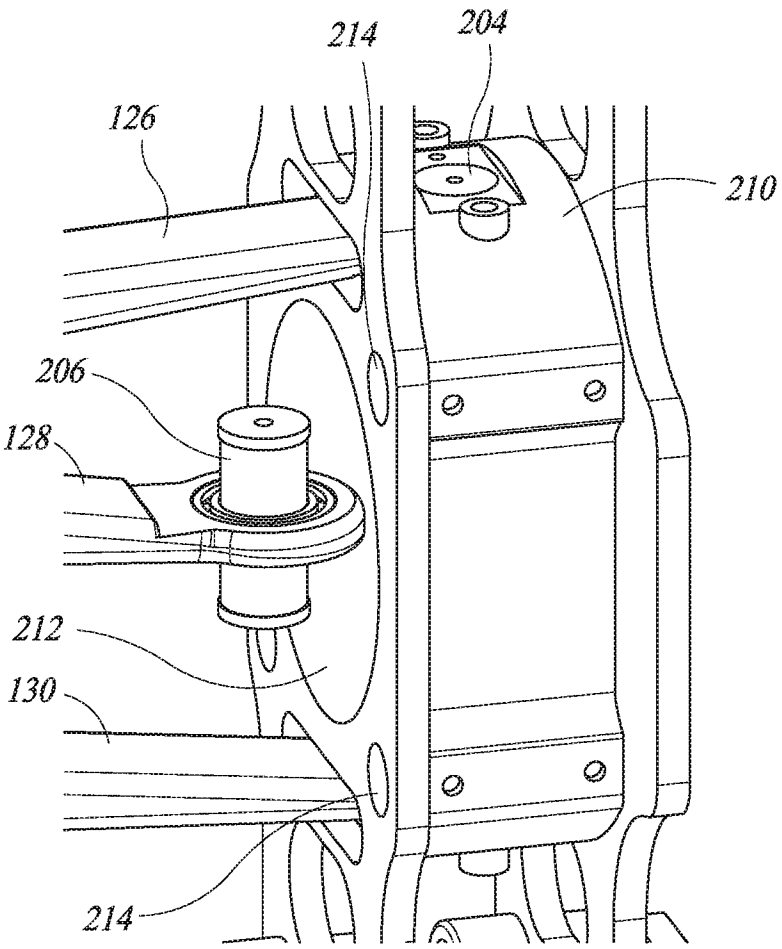
FIG. 20 is a partial perspective view of the pressure differential engine as shown in FIG. 19, according to at least one illustrated embodiment.

As further illustrated in FIG. 18, the distal end portions of the connecting rods 126, 128, and 130 can be coupled by roller bearings 202 to locking pins or dowels 204, 206, and 208, respectively. FIGS. 19-21 illustrate that the first piston assembly 108 can include a primary cylinder body or chassis 210 mounted on the roller bearings 166 of the first piston assembly 108 such that the primary cylinder body 210 is slidably mounted on the support rods 122*a*, 122*b* of the main frame 106. FIGS. 20 and 21 show partial top and bottom perspective views, respectively, of the primary cylinder body 210, and illustrate that the primary cylinder body 210 is rotatably coupled to the top and bottom connecting rods 126, 130, by the locking pins 204 and 208, respectively.

The primary cylinder body 210 can be coupled to the top and bottom connecting rods 126, 130 to be rotatable with respect to the top and bottom connecting rods 126, 130 about the central longitudinal axes of the locking pins 204, 208, which axes can be coincident with one another. Further, as noted above, the top and bottom connecting rods 126, 130 are rotatable about the central stationary shaft assembly 112 on the same longitudinal axis as one another, which longitudinal axis is defined by the central longitudinal axes of the external surfaces 172, 188. Thus, the primary cylinder body 210 is freely rotatable about the central stationary shaft assembly 112 on the longitudinal axis defined by the central longitudinal axes of the external surfaces 172, 188. The primary cylinder body 210 can so rotate at a fixed distance which is the distance between the central longitudinal axes of the locking pins 204, 208, and the central longitudinal axes of the external surfaces 172, 188.

Figure 22:
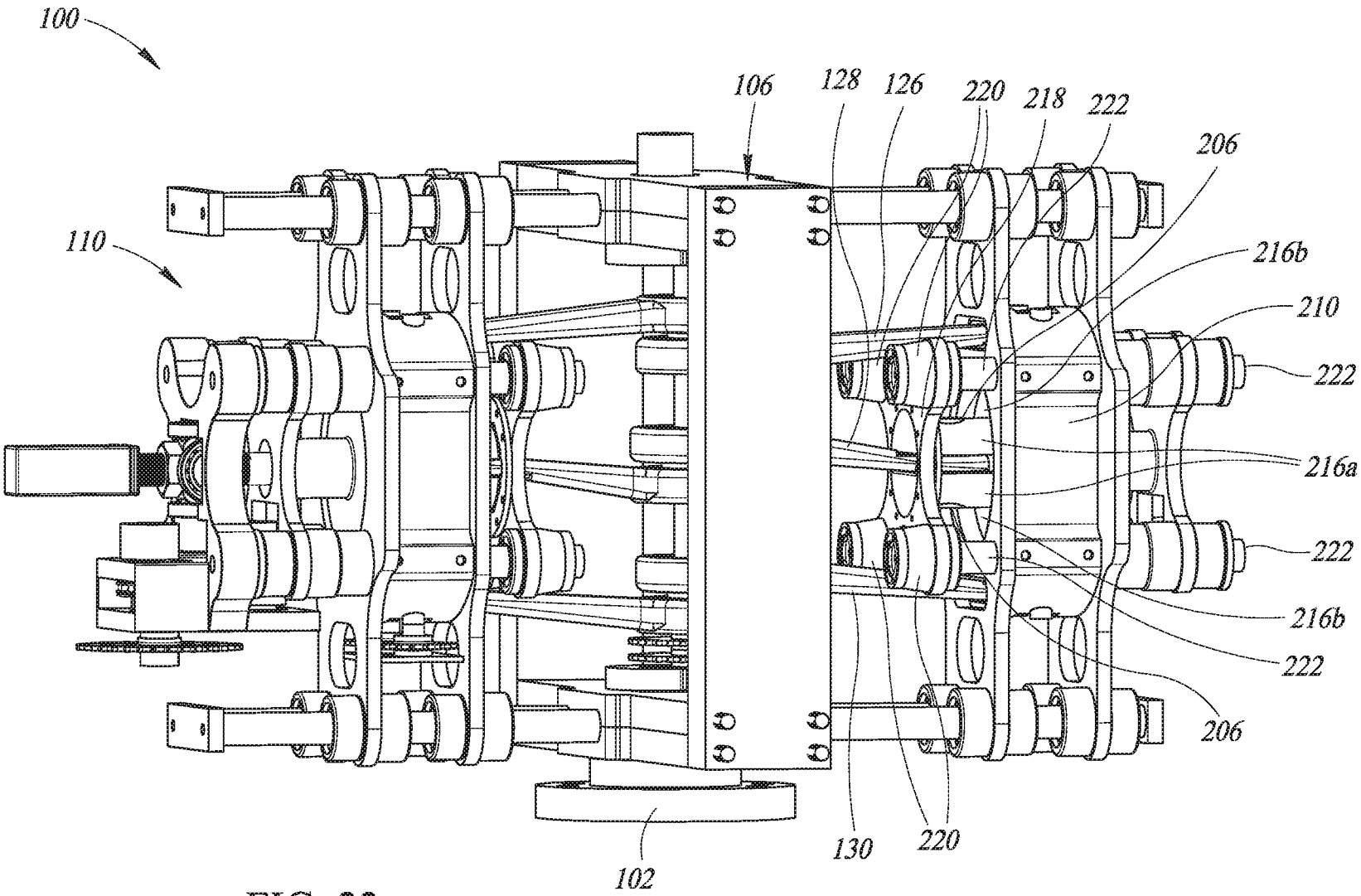
FIG. 22 is a perspective view of the pressure differential engine of FIG. 3 in another state of disassembly, according to at least one illustrated embodiment.
Figure 24:
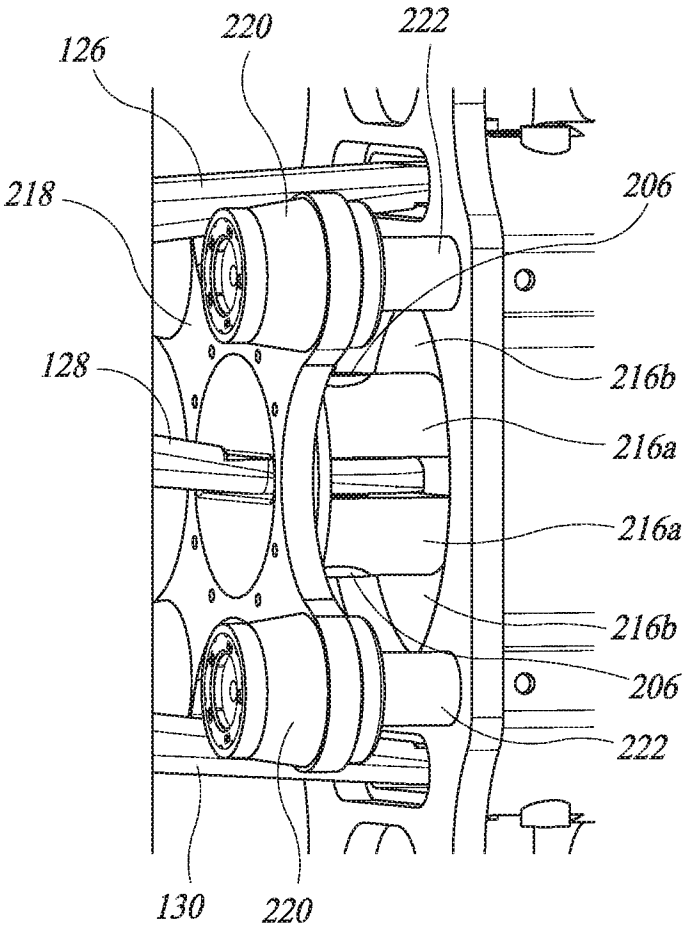
FIG. 24 is another partial perspective view of the pressure differential engine as shown in FIG. 22, according to at least one illustrated embodiment.
Figure 23:
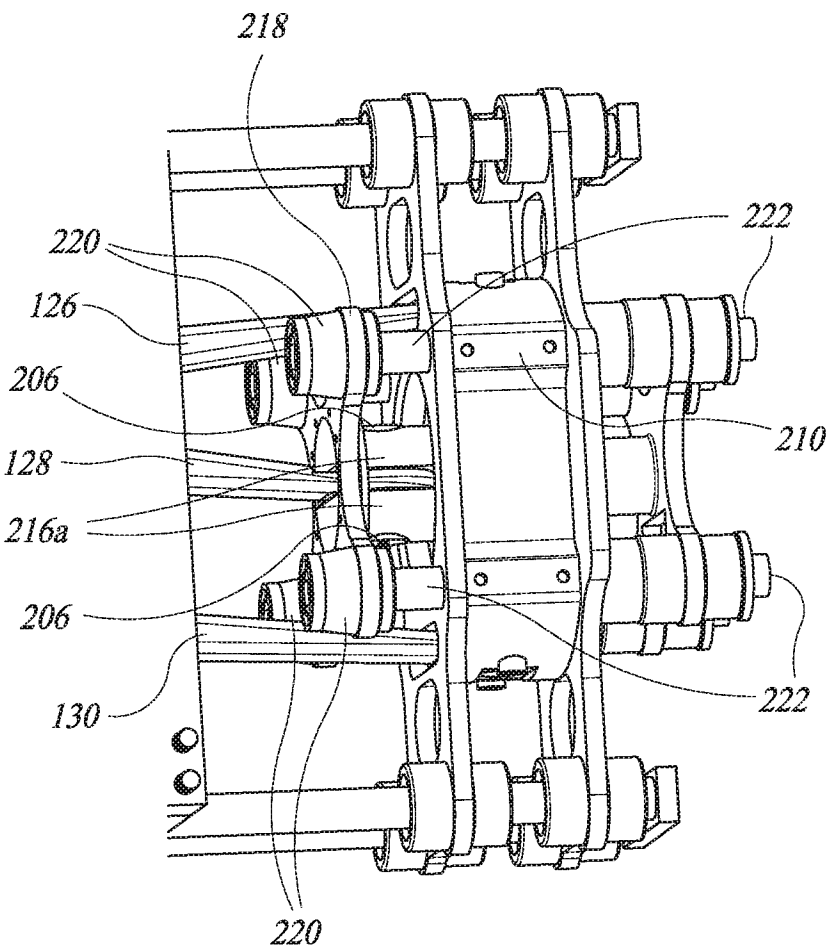
FIG. 23 is a partial perspective view of the pressure differential engine as shown in FIG. 22, according to at least one illustrated embodiment.

The primary cylinder body 210 includes a primary inner chamber 212 which is cylindrical with a central longitudinal axis oriented in the proximal-distal direction. The primary cylinder body 210 also includes four boreholes 214, each having a central longitudinal axis oriented in the proximal-distal direction, and each spaced apart from the primary inner chamber 212. FIGS. 22-24 illustrate that the first piston assembly 108 also includes a proximal piston 216, represented in the drawings by the combination of a proximal piston coupler shaft 216*a* and a proximal piston plate 216*b*, which can be formed integrally with one another. The proximal piston plate 216*b* can be positioned within the primary inner chamber 212 and can act as a proximal wall of the inner chamber 212 to seal the proximal end portion of the inner chamber 212.

The proximal piston coupler shaft 216*a* is rotatably coupled to the middle connecting rod 128 by the locking pin 206 to be rotatable with respect to the middle connecting rod 128 about the central longitudinal axis of the locking pin 206. Further, as noted above, the middle connecting rod 128 is rotatable about the central stationary shaft assembly 112 on a different longitudinal axis than the top and bottom connecting rods 126, 130, which different longitudinal axis is defined by the central longitudinal axis of the external surface 180. Thus, the proximal piston 216 is freely rotatable about the central stationary shaft assembly 112 on the longitudinal axis defined by the central longitudinal axis of the external surface 180. The proximal piston 216 can so rotate at a fixed distance which is the distance between the central longitudinal axis of the locking pin 206 and the central longitudinal axis of the external surface 180.

The proximal piston plate 216*b* can be axially slidable within the inner chamber 212 of the primary cylinder body along a central longitudinal axis of the inner chamber 212. For example, because the primary cylinder body 210 and the proximal piston 216 rotate about the central stationary shaft assembly 112 on different axes, the proximal piston plate 216*b* can be drawn proximally and distally through the inner chamber 212 as the entire first piston assembly 108 rotates about of the central stationary shaft assembly 112, under principles similar to those described above with regard to engine 30.

The proximal piston 216 is coupled at a proximal end thereof to a support plate 218, which is mounted on four roller bearings 220, each of which roller bearings 220 is in turn mounted on a respective one of the four support shafts 222, each of which support shafts 222 is in turn mounted within and extends through a respective one of the four boreholes 214. The support shafts 222 can be fixedly mounted within the respective boreholes 214 to fix other components of the first piston assembly 108 to the primary cylinder body 210.

Figure 26:
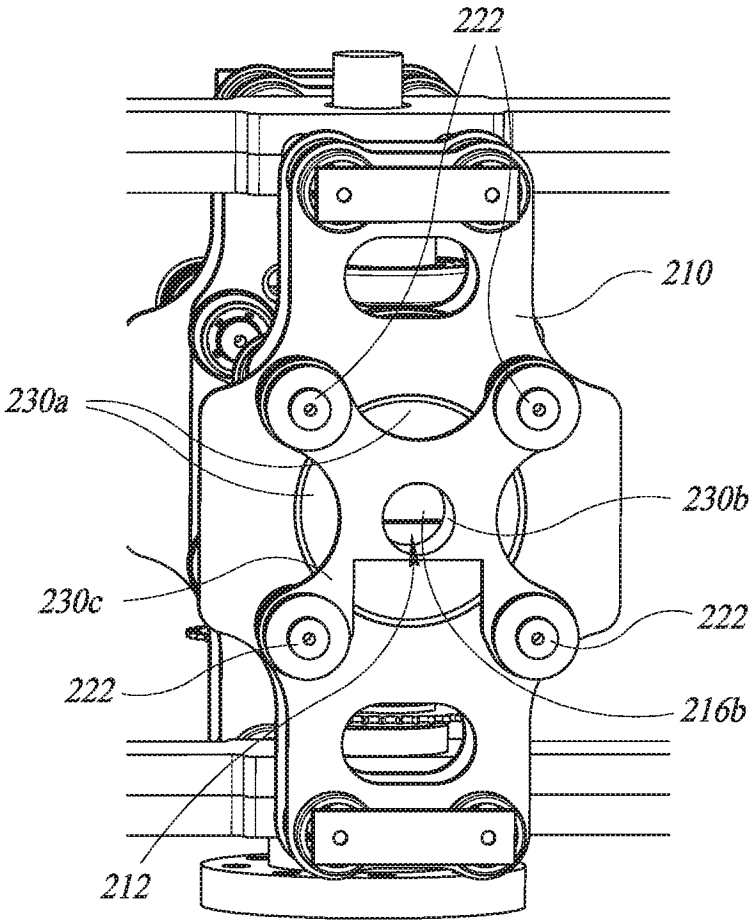
FIG. 26 is another partial perspective view of the pressure differential engine as shown in FIG. 22, according to at least one illustrated embodiment.
Figure 25:
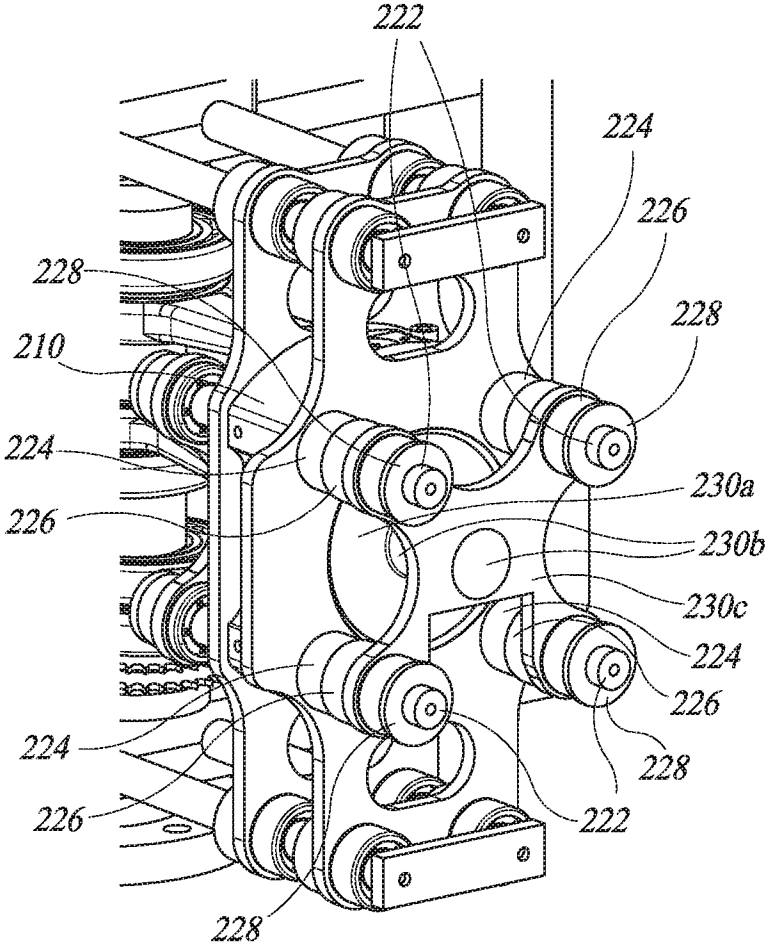
FIG. 25 is another partial perspective view of the pressure differential engine as shown in FIG. 22, according to at least one illustrated embodiment.
Figure 27:
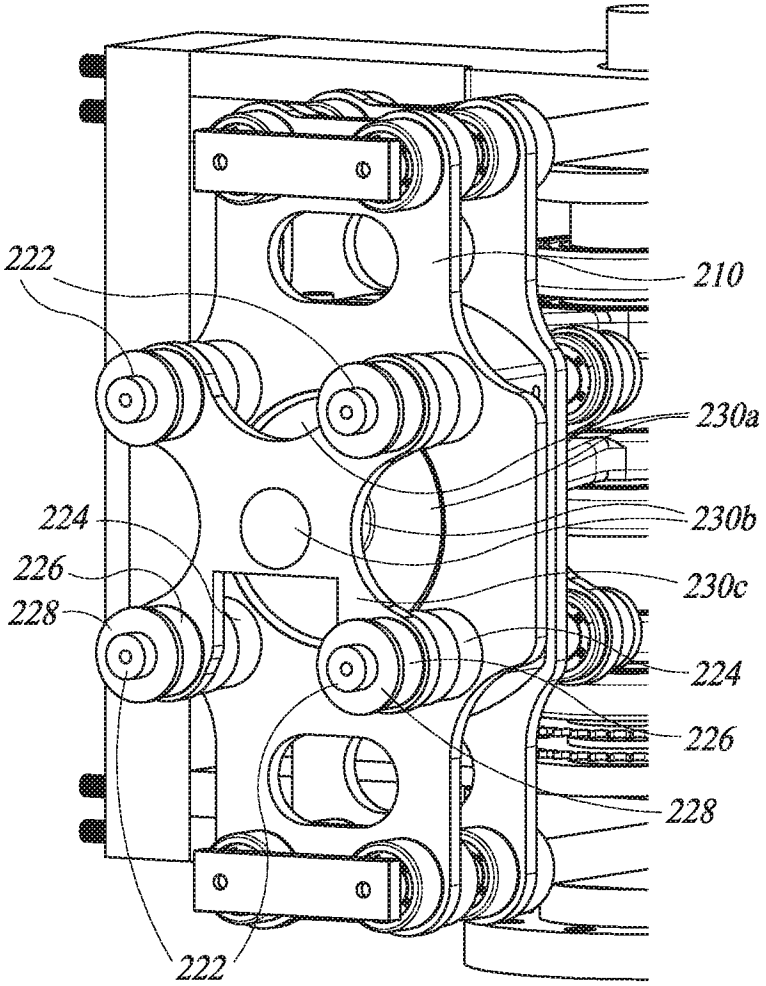
FIG. 27 is another partial perspective view of the pressure differential engine as shown in FIG. 22, according to at least one illustrated embodiment.

FIGS. 25-27 illustrate the engine 100 in the same state of assembly as in FIGS. 22-24, from three different perspective views. FIGS. 25-27 illustrate that the first piston assembly 108 can include four proximal spacer elements 224, each mounted on a respective one of the four support shafts 222 just distal to the primary cylinder body 210. The first piston assembly 108 can also include four roller bearings 226, each mounted on a respective one of the four support shafts 222 just distal to the proximal spacer elements 224. The first piston assembly 108 can also include four distal spacer elements 228, each mounted on a respective one of the four support shafts 222 just distal to the roller bearings 226.

FIGS. 25-27 also illustrate that the first piston assembly 108 also includes a distal piston 230, represented in the drawings by the combination of a distal piston plate 230*a*, a distal piston coupler shaft 230*b*, and a distal piston support plate 230*c*, which can be formed integrally with one another. The distal piston support plate 230*c* can be mounted on the four roller bearings 226 and can have an opening formed in the center thereof. The distal piston coupler shaft 230*b* can be a hollow cylindrical shaft coupled to the distal piston support plate 230*c* and extending proximally therefrom to the distal piston plate 230*a*. The distal piston plate 230*a* can be positioned within the primary inner chamber 212 and can act as a distal wall of the inner chamber 212, and can have an opening formed in the center thereof. The distal piston coupler shaft 230*b* includes a conduit that couples the opening in the distal piston support plate 230*c* with the opening in the distal piston plate 230*a*, and allows other components to enter the primary inner chamber 212 therethrough.

As noted above, the distal piston 230 is mounted on the roller bearings 226 via the distal piston support plate 230*c*. Thus, in some embodiments, the distal piston 230 can be actuated to move, and can be axially slidable along the support shafts 222 such that the distal piston plate 230*a* is axially slidable within the inner chamber 212 of the primary cylinder body 210 along the central longitudinal axis of the inner chamber 212. For example, in some embodiments, motion of the distal piston 230 can be externally controlled to further control the pressures within the inner chamber 212 and thereby contribute to the power output of the engine 100. In the illustrated embodiment, however, the roller bearings 226 are restrained against motion along the support shafts 222 by the spacer elements 224, 228, and thus the distal piston plate 230*a* is restrained against motion within the inner chamber 212.

Figure 28:
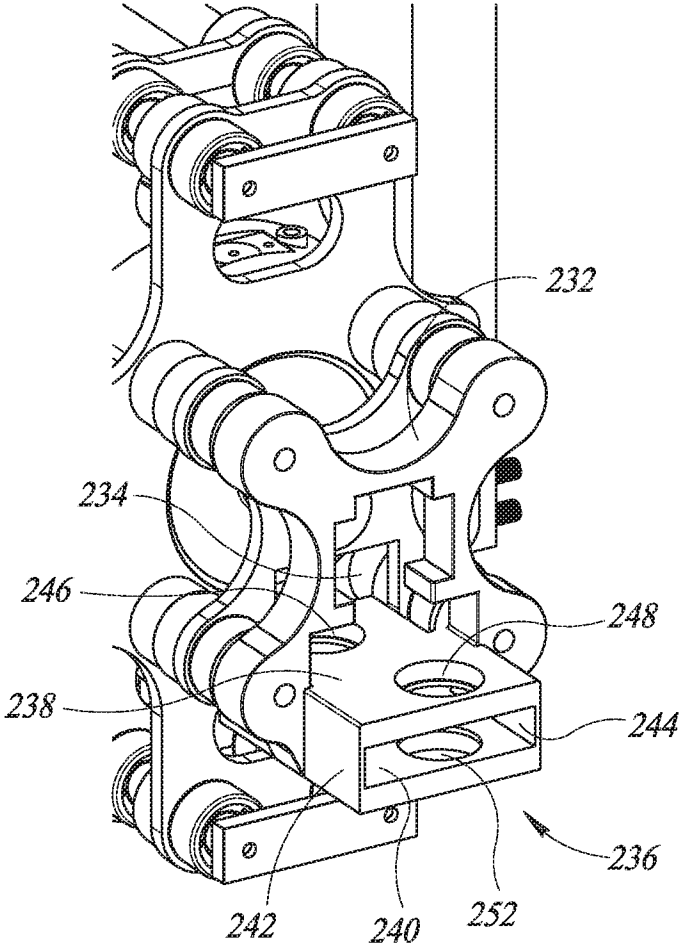
FIG. 28 is a partial perspective view of the pressure differential engine of FIG. 3 in another state of disassembly, according to at least one illustrated embodiment.
Figure 30:
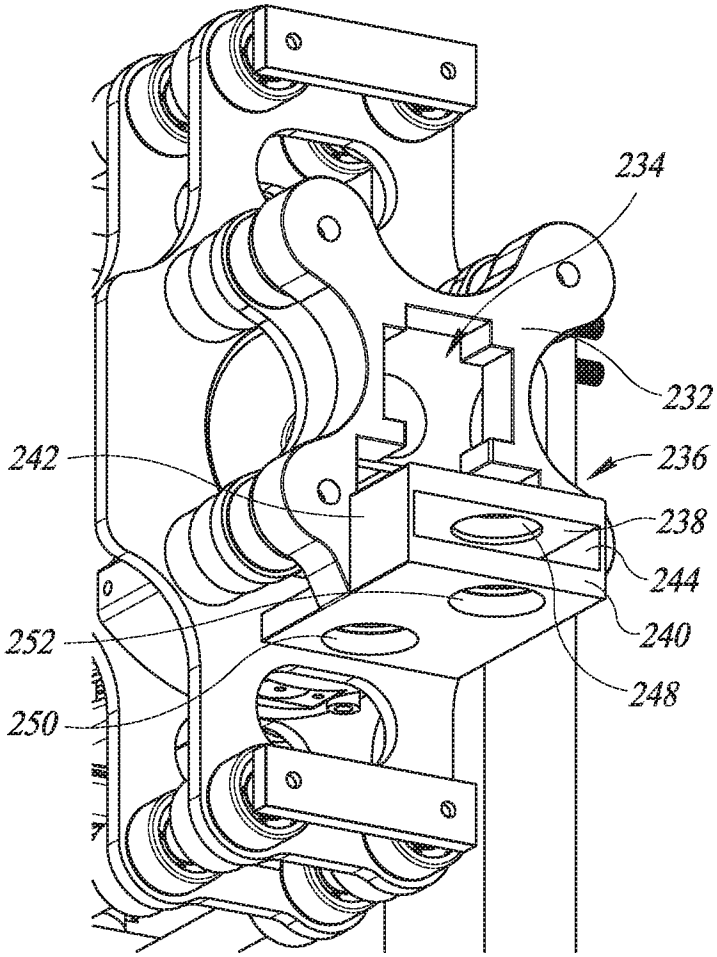
FIG. 30 is another partial perspective view of the pressure differential engine as shown in FIG. 28, according to at least one illustrated embodiment.
Figure 29:
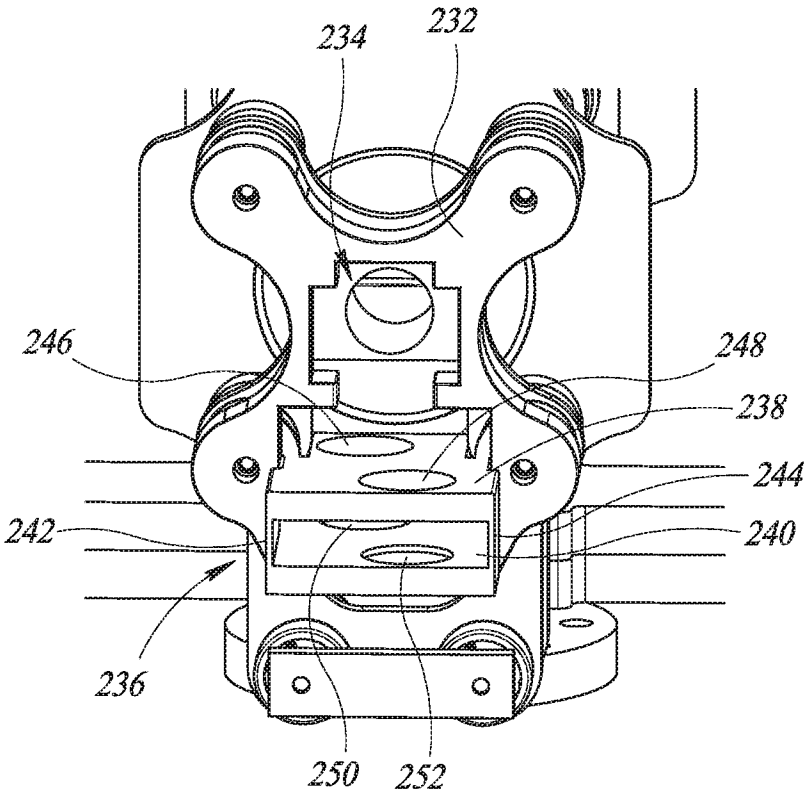
FIG. 29 is a partial perspective view of the pressure differential engine as shown in FIG. 28, according to at least one illustrated embodiment.

FIGS. 28-30 illustrate that the first piston assembly 108 can include a distal plate 232 mounted and fixedly secured to the distal end portions of the support shafts 222 (not visible in FIGS. 28-30). The distal plate 232 includes a generally cruciform opening 234 at its center, which is aligned with the central longitudinal axes of the opening in the distal piston plate 230*a*, the distal piston coupler shaft 230*b*, and the opening in the distal piston support plate 230*c*. The distal plate also supports and can be formed integrally with a cam-and-gearbox 236. The cam-and-gearbox 236 includes an upper shelf or roof element 238 and a lower shelf or floor element 240, as well as a first vertical wall element 242 and a second vertical wall element 244 that span vertically from and connect the roof element 238 to the floor element 240.

The roof element 238 includes two vertically-aligned openings formed therein: an upper proximal opening 246 positioned laterally to one side of a proximal-distal axis in the roof element 238, and an upper distal opening 248 positioned distally of the upper proximal opening 246 and laterally to the opposite side of the proximal-distal axis from the upper proximal opening 246 in the roof element 238. Similarly, the floor element 240 includes two vertically-aligned openings formed therein: a lower proximal opening 250 positioned laterally to one side of a proximal-distal axis in the floor element 240, and a lower distal opening 252 positioned distally of the lower proximal opening 250 and laterally to the opposite side of the proximal-distal axis from the lower proximal opening 250 in the floor element 240. The upper proximal opening 246 is directly above the lower proximal opening 250 and the upper distal opening 248 is directly above the lower distal opening 252.

Figure 32:
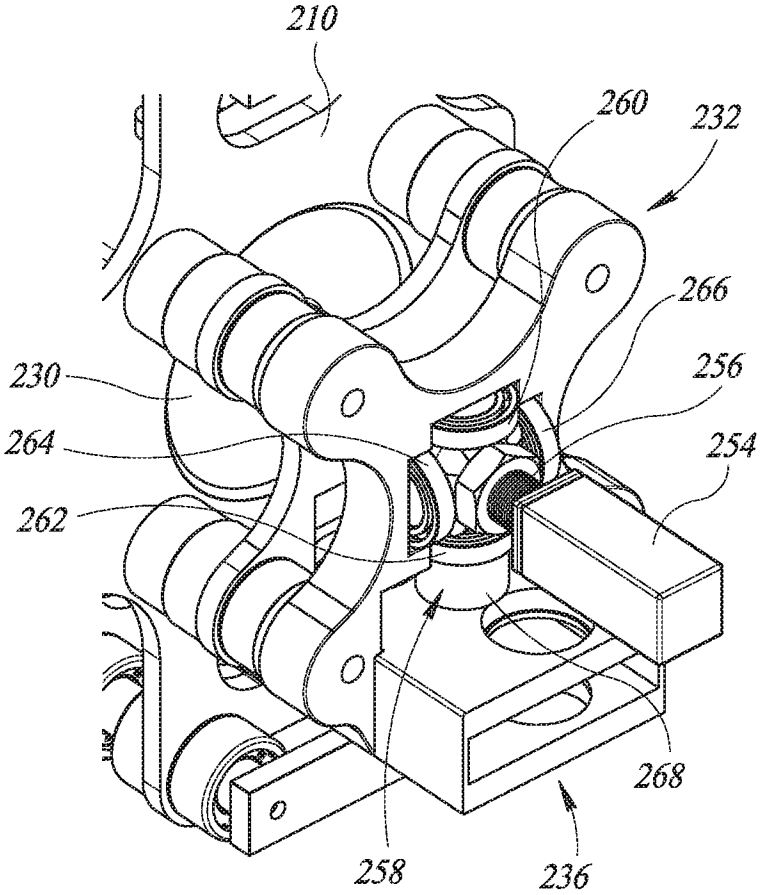
FIG. 32 is a partial perspective view of the pressure differential engine as shown in FIG. 31, according to at least one illustrated embodiment.
Figure 31:
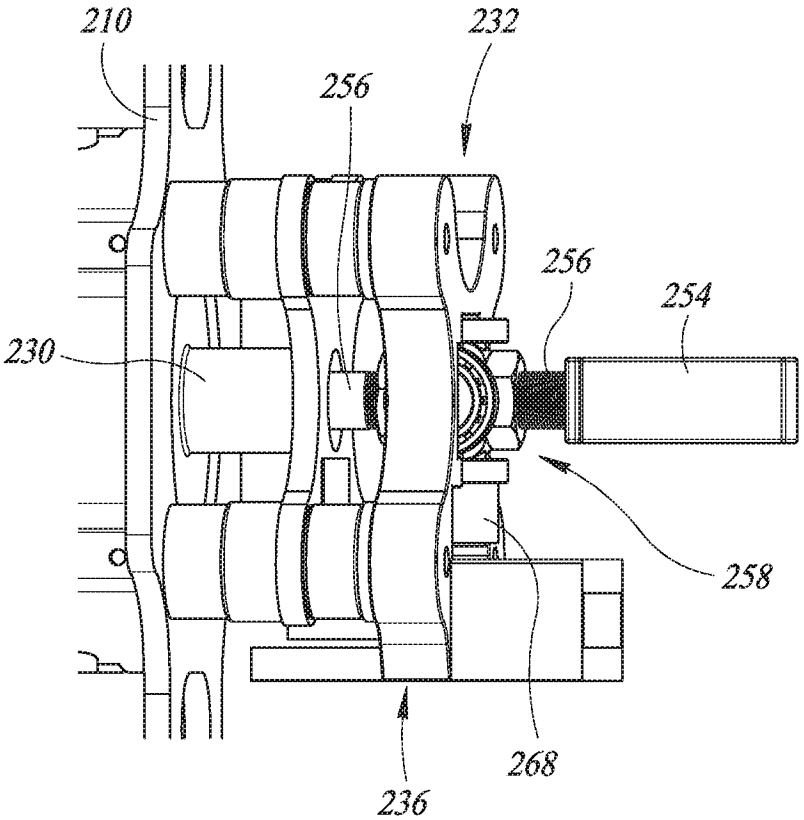
FIG. 31 is a partial perspective view of the pressure differential engine of FIG. 3 in another state of disassembly, according to at least one illustrated embodiment.
Figure 34:
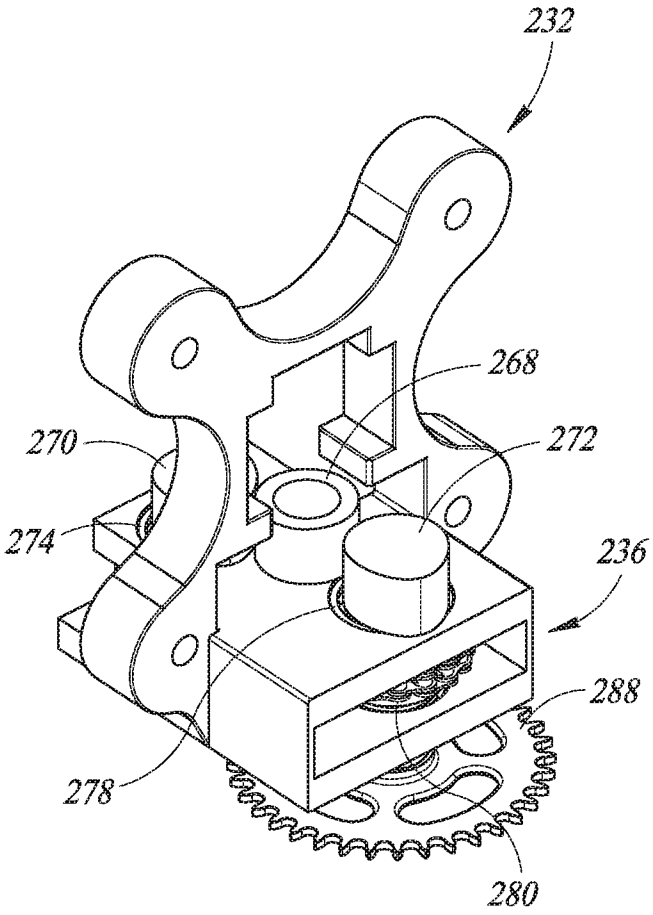
FIG. 34 is a perspective view of several components of the pressure differential engine of FIG. 3 in isolation from other components of the pressure differential engine of FIG. 3, according to at least one illustrated embodiment.

FIGS. 31 and 32 illustrate that the first piston assembly 108 includes a controller 254 coupled to a control shaft 256, which extends from the controller 254 proximally through the opening in the distal piston plate 230*a*, through the distal piston coupler shaft 230*b*, and through the opening in the distal piston support plate 230*c*, to within the inner chamber 212. Inside the inner chamber 212, a proximal end portion of the control shaft 256 is coupled to an intermediate piston 320 (see FIG. 47), which is positioned between the proximal piston 216 and the distal piston 230, and which is described in greater detail below.

The control shaft 256 is coupled to a bearing assembly 258 that includes a top roller bearing 260 positioned within a top portion of the cruciform opening 234, a bottom roller bearing 262 positioned within a bottom portion of the cruciform opening 234, a first side roller bearing 264 positioned within a first side portion of the cruciform opening 234, and a second side roller bearing 266 positioned within a second side portion of the cruciform opening 234. The roller bearings 260, 262, 264, and 266 can bear against the respective surfaces of the cruciform opening 234 in the distal plate 232 to allow the intermediate piston 320 to move axially and smoothly within the inner chamber 212.

As also illustrated in FIGS. 31 and 32, a cylindrical drive shaft 268 is coupled to a bottom surface or underside of the bearing assembly 258. The cylindrical drive shaft 268 is fixedly secured, via the bearing assembly 258 and the control shaft 256, to the intermediate piston 320 such that as the intermediate piston 320 moves proximally and distally within the inner chamber 212, the drive shaft 268 similarly moves proximally and distally.

Figure 33:
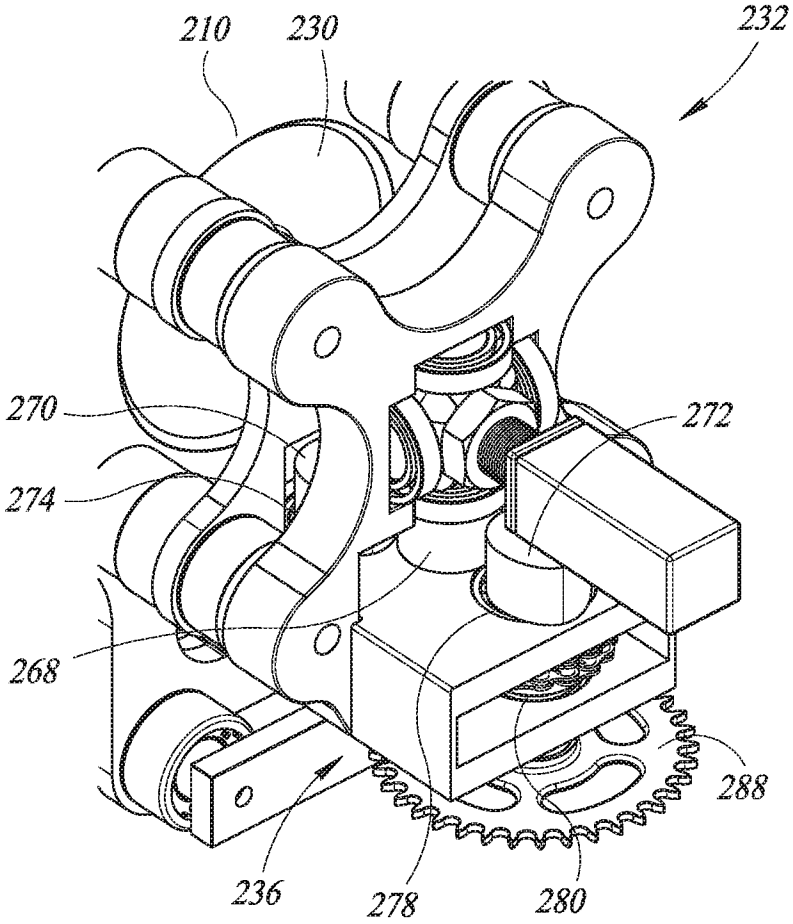
FIG. 33 is a partial perspective view of the pressure differential engine of FIG. 3 in another state of disassembly, according to at least one illustrated embodiment.
Figure 36:
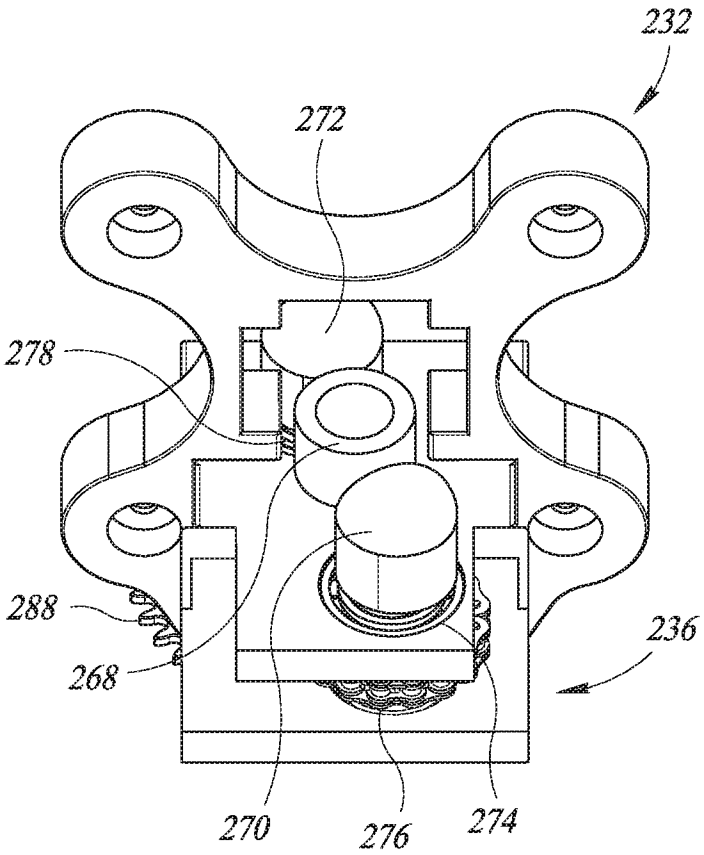
FIG. 36 is another perspective view of several components of the pressure differential engine of FIG. 3 in isolation from other components of the pressure differential engine of FIG. 3, according to at least one illustrated embodiment.
Figure 35:
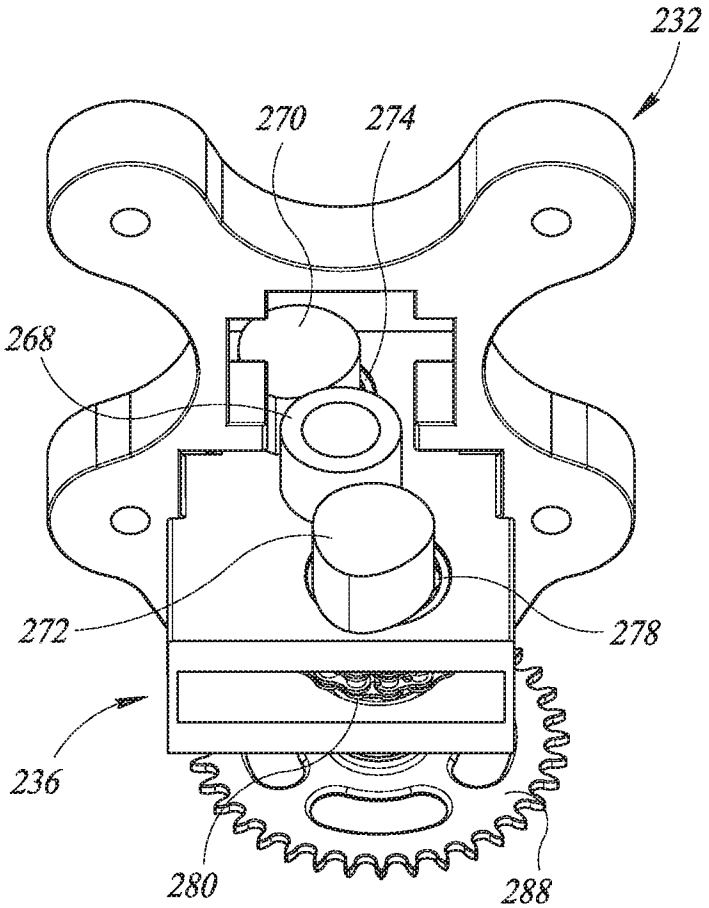
FIG. 35 is another perspective view of several components of the pressure differential engine of FIG. 3 in isolation from other components of the pressure differential engine of FIG. 3, according to at least one illustrated embodiment.

FIGS. 33-38 illustrate that the first piston assembly 108 also includes a set of interacting cams, gears, and chains mounted to the cam-and-gearbox 236. FIG. 33 illustrates the cams, gears, and chains mounted to the cam-and-gearbox 236, mounted to the first piston assembly, FIGS. 34-38 illustrate the cams, gears, and chains mounted to the cam-and-gearbox 236 in isolation from the rest of the first piston assembly 108, in order to more fully illustrate those components. Specifically, a proximal cam 270 is rotatably and eccentrically mounted on an upper proximal roller bearing 274 in the upper proximal opening 246 and on a lower proximal roller bearing 276 in the lower proximal opening 250, and a distal cam 272 is rotatably and eccentrically mounted on an upper distal roller bearing 278 in the upper distal opening 248 and on a lower distal roller bearing 280 in the lower distal opening 252.

The drive shaft 268 is situated between and bears against both the proximal cam 270 and the distal cam 272. Proximal movement of the intermediate piston 320 through the inner chamber 212 produces proximal movement of the drive shaft 268 with respect to the proximal and distal cams 270, 272. Thus, as the intermediate piston 320 moves proximally within the inner chamber 212, the drive shaft 268 pushes the proximal cam 270, which is eccentrically mounted on the roller bearings 274, 276, to rotate about a central longitudinal axis of the upper and lower proximal openings 246, 250. Similarly, distal movement of the intermediate piston 320 through the inner chamber 212 produces distal movement of the drive shaft 268 with respect to the proximal and distal cams 270, 272, Thus, as the intermediate piston 320 moves distally within the inner chamber 212, the drive shaft 268 pushes the distal cam 272, which is eccentrically mounted on the roller bearings 278, 280 to rotate about a central longitudinal axis of the upper and lower distal openings 248, 252.

Figure 37:
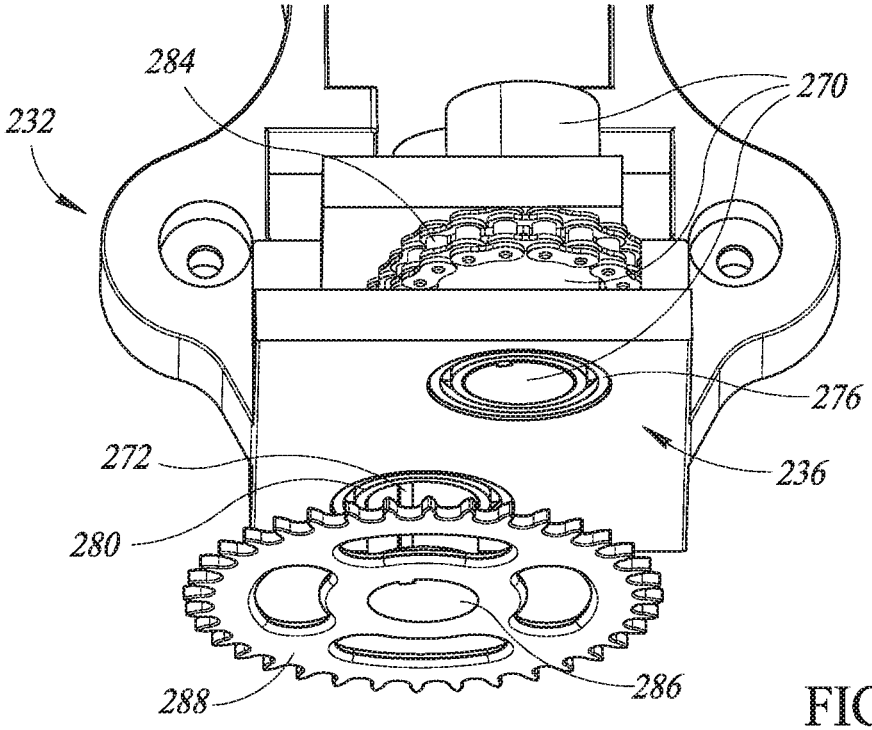
FIG. 37 is another perspective view of several components of the pressure differential engine of FIG. 3 in isolation from other components of the pressure differential engine of FIG. 3, according to at least one illustrated embodiment.
Figure 38:
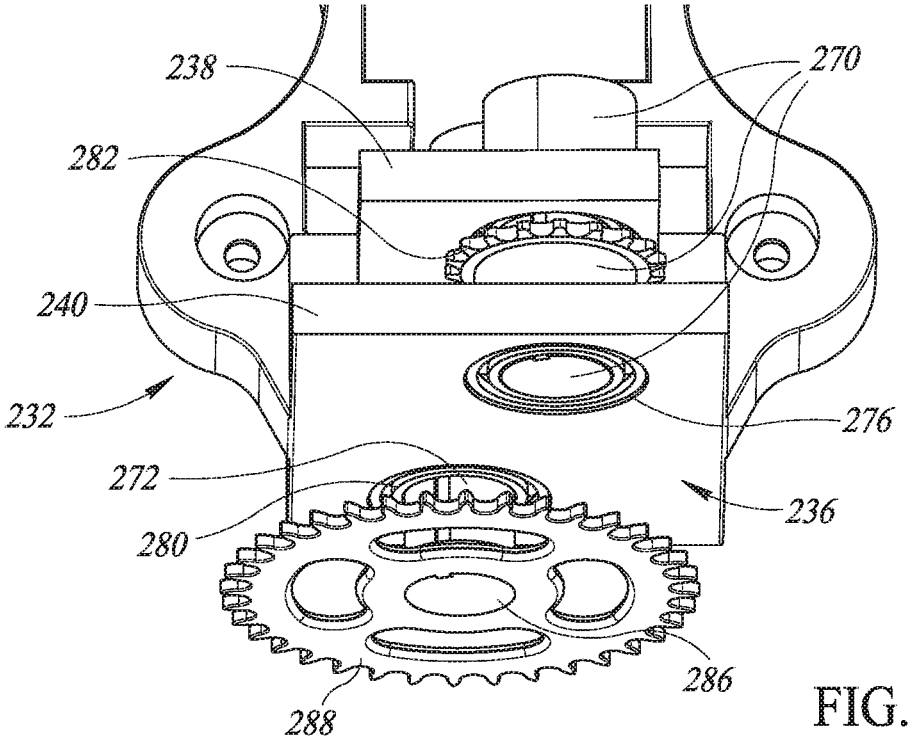
FIG. 38 is another perspective view of several components of the pressure differential engine of FIG. 3 in isolation from other components of the pressure differential engine of FIG. 3, according to at least one illustrated embodiment.

As shown in FIGS. 37 and 38, the proximal and distal cams 270, 272 can be rotationally tied to one another. For example, a gear 282 can be mounted on and rotationally fixed to each of the proximal and distal cams 270, 272, such as between the roof element 238 and the floor element 240. These gears 282 can be rotationally tied to one another, such that they are constrained to rotate synchronously with one another, by a link mechanism such as a chain 284 mounted on the gears 282 between the roof element 238 and the floor element 240. The chain 284 is illustrated in FIG. 37, but not in FIG. 38, in order to illustrate the various components more clearly. The dual, rotationally locked, proximal and distal cams 270, 272 allow the intermediate piston 320 to induce rotation of both of the cams 270, 272, during both proximal and distal motion of the intermediate piston 320. As also shown in FIGS. 37 and 38, the distal cam 272 includes a leg 286 that extends through and to below the floor element 240. A distal bottom gear 288 is mounted on and rotationally fixed to the distal cam 272.

If, in the configuration illustrated in FIGS. 33-38, the intermediate piston 320 moves proximally within the inner chamber 212, then the drive shaft 268 pushes the proximal cam 270 to rotate in a clockwise direction as looking down on the proximal cam 270. Such rotation of the proximal cam 270 causes clockwise rotation of the gear 282 coupled to the proximal cam 270, thereby causes clockwise rotation of the chain 284, thereby causes clockwise rotation of the gear 282 coupled to the distal cam 272, and thereby causes clockwise rotation of the distal cam 272.

The engine 100 can be configured such that, when the intermediate piston 320 reaches the end of its proximal stroke, the drive shaft 268 reaches and contacts the centerline of the proximal cam 270 at its heel, and is in contact with the centerline of the of the distal cam 272 at its nose. Thus, when the intermediate piston 320 begins its distal stroke, the drive shaft 268 pushes the distal cam 272 to rotate in a clockwise direction as looking down on the distal cam 272. Momentum of the various components can help to ensure that at each such transition between proximal and distal motion of the intermediate piston 320, the proximal and distal cams 270, 272 continue to rotate in a clockwise direction. This process can repeat as the intermediate piston 320 cycles back and forth within the inner chamber 212. In this way, the cams 270, 272 can provide what can be referred to as an "infinite inclined plane" against which the drive shaft 268 can constantly push.

If, on the other hand, in the configuration illustrated in FIGS. 33-38, the intermediate piston 320 moves distally within the inner chamber 212, then the drive shaft 268 pushes the distal cam 272 to rotate in a counter-clockwise direction as looking down on the distal cam 272, and the foregoing descriptions are reversed accordingly. Thus, in either case, as the intermediate piston 320 cycles back and forth within the inner chamber 212, the drive shaft 268 can continuously push against one of the proximal or distal cams 270, 272 to cause both the proximal and the distal cams 270, 272 to rotate continuously in the same direction. Thus, because the bottom gear 288 is fixed with respect to the distal cam 272, the reciprocal motion of the intermediate piston 320 can be converted into continuous rotation of the bottom gear 288 in a single direction with respect to the first piston assembly 108.

The proximal cam 270 is mounted at a location offset in a first direction and at a first distance from the proximal-distal axis along which the drive shaft 268 reciprocates, and the distal cam 272 is mounted at a location offset in a second direction opposite to the first direction and at the first distance from the proximal-distal axis along which the drive shaft 268 reciprocates. As a result, the axis along which the drive shaft 268 reciprocates is oblique to an axis extending from the axis of rotation of the proximal cam 270 to the axis of rotation of the distal cam 272. Thus, as the drive shaft 268 reciprocates, it exerts a force against the cams 270, 272 along an axis at a constant distance from their respective axes of rotation (e.g., with a constant lever arm) to cause their rotation.

Figure 39:
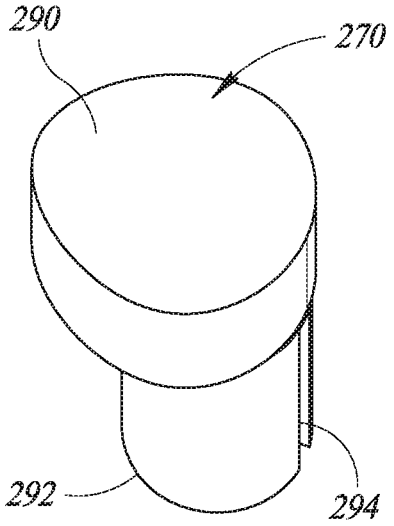
FIG. 39 is an illustration of a component of the pressure differential engine of FIG. 3, according to at least one illustrated embodiment.
Figure 40:
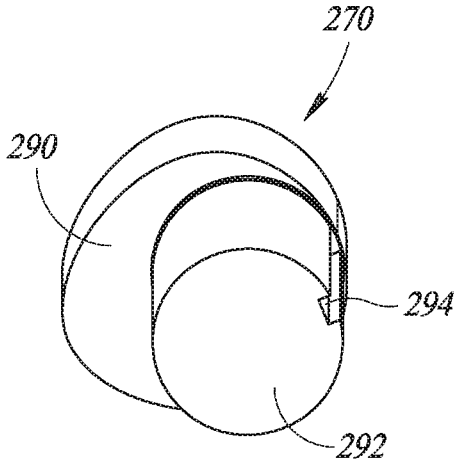
FIG. 40 is an illustration of another component of the pressure differential engine of FIG. 3, according to at least one illustrated embodiment.

FIGS. 39-42 illustrate the proximal and distal cams 270, 272 isolated and in greater detail. FIGS. 39 and 40 illustrate that the proximal cam 270 includes a proximal cam head 290 and a proximal cam leg 292 eccentrically coupled to the proximal cam head 290. When the proximal cam 270 is installed on the first piston assembly 108, the proximal cam leg 292 is mounted on the upper and lower proximal roller bearings 274, 276 within the upper and lower proximal openings 246, 250, and the proximal cam head 290 is positioned on top of the roof element 238 to bear against the drive shaft 268. The proximal cam leg 292 includes a groove or keyway 294 extending longitudinally along its length, to facilitate coupling gears thereto.

Figure 41:
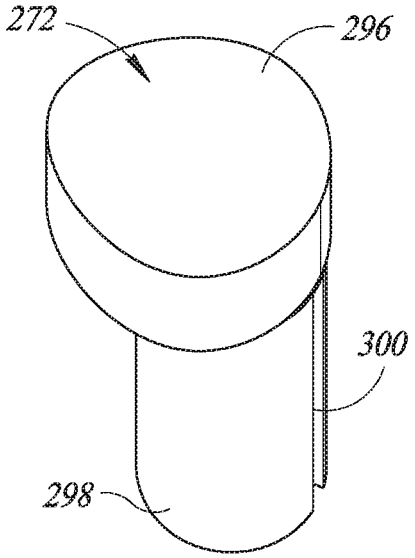
FIG. 41 is an illustration of another component of the pressure differential engine of FIG. 3, according to at least one illustrated embodiment.
Figure 42:
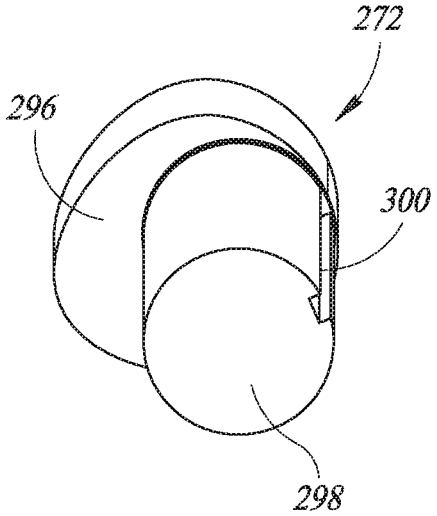
FIG. 42 is an illustration of another component of the pressure differential engine of FIG. 3, according to at least one illustrated embodiment.

Similarly, FIGS. 41 and 42 illustrate that the distal cam 272 includes a distal cam head 296 and a distal cam leg 298 eccentrically coupled to the distal cam head 296. The distal cam leg 298 can be longer than the proximal cam leg 292. When the distal cam 272 is installed on the first piston assembly 108, the distal cam leg 298 is mounted on the upper and lower distal roller bearings 278, 280 within the upper and lower distal openings 248, 252, and the distal cam head 296 is positioned on top of the roof element 238 to bear against the drive shaft 268. The distal cam leg 298 includes a groove or keyway 300 extending longitudinally along its length, to facilitate coupling gears thereto.

Figure 43:
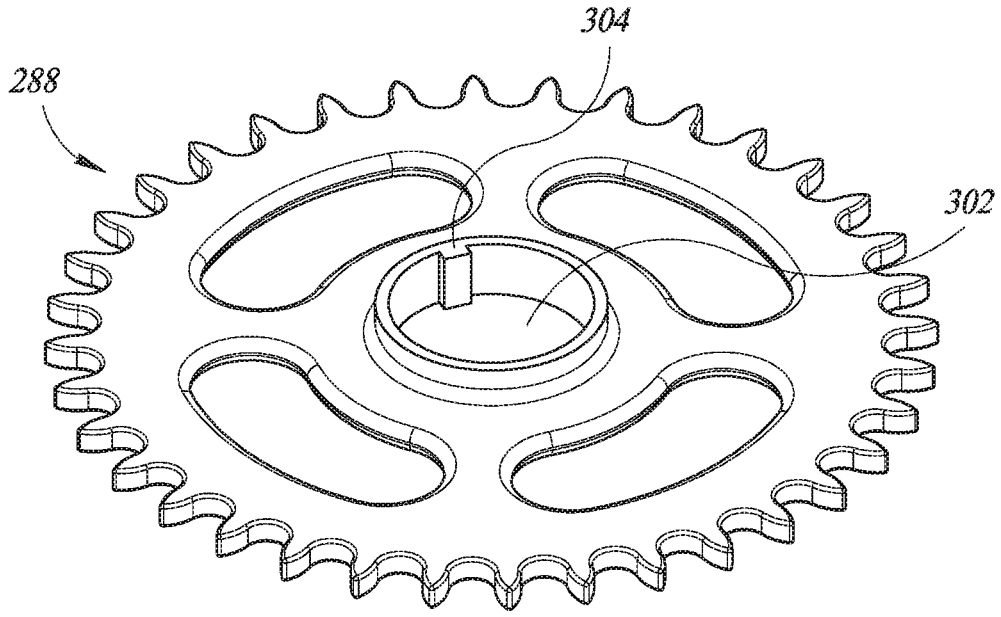
FIG. 43 is an illustration of another component of the pressure differential engine of FIG. 3, according to at least one illustrated embodiment.
Figure 44:
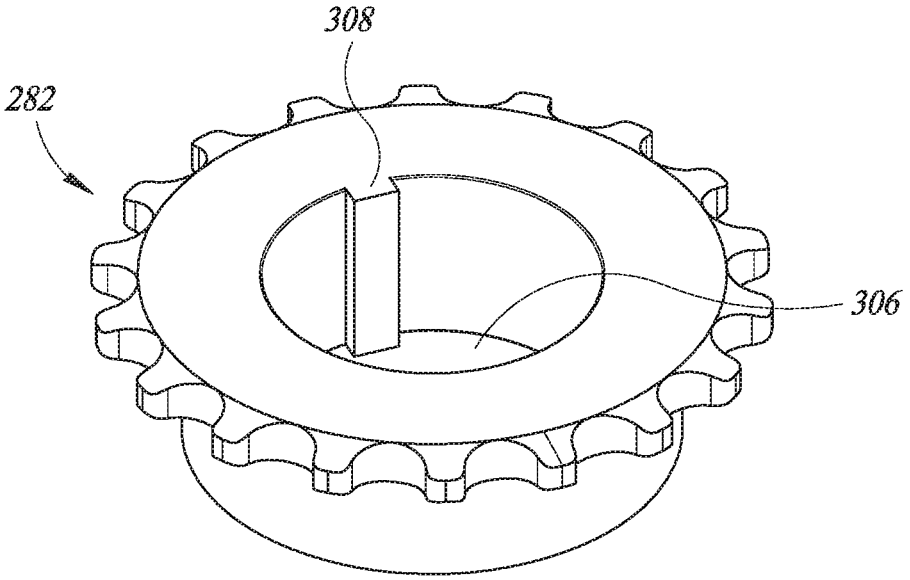
FIG. 44 is an illustration of another component of the pressure differential engine of FIG. 3, according to at least one illustrated embodiment.

FIG. 43 illustrates the bottom gear 288 isolated and in greater detail. Bottom gear 288 includes a central opening 302 for receiving the distal cam leg 298 and a ridge or key 304 for engaging with the keyway 300 to rotationally lock the bottom gear 288 to the distal cam 272. FIG. 44 illustrates the gear 282 isolated and in greater detail. Gear 282 includes a central opening 306 for receiving either the proximal or the distal cam leg 292, 298, and a ridge or key 308 for engaging with the keyway 294 or the keyway 300 to rotationally lock the gear 282 to the proximal or distal cam 270, 272, respectively.

Figure 45:
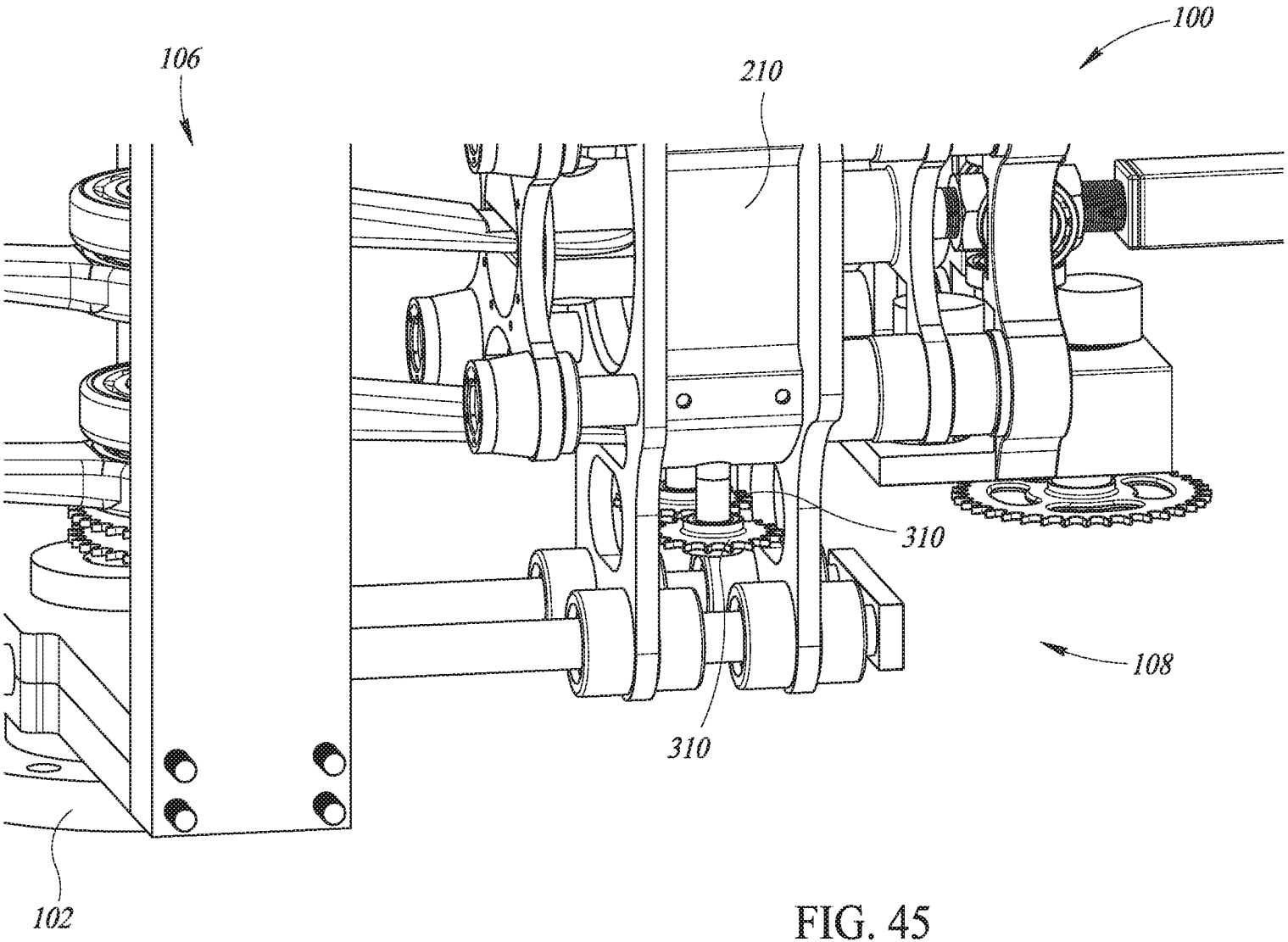
FIG. 45 is a partial perspective view of the pressure differential engine of FIG. 3, according to at least one illustrated embodiment.

FIG. 45 illustrates that a pair of tensioning gears 310 are mounted to the bottom or underside of the primary cylinder body 210. FIG. 46 illustrates that the first piston assembly 108 can include a bottom chain 312 that extends from the distal bottom gear 288 of the first piston assembly 108, to the tensioning gears 310 of the first piston assembly 108, to the proximal bottom gear 164. The chain 312 can extend around and rotationally lock the gears 288, 310, 164 to one another. That is, because the proximal bottom gear 164 is stationary and rotationally locked to the central stationary shaft assembly 112, the bottom chain 312 can prevent the distal bottom gear 288 from rotating about its own central axis. The tensioning gears 310 can ensure that the chain 312 experiences tension and does not go slack.

FIG. 46 also illustrates that the second piston assembly 110 can include a distal bottom gear 314 similar to the distal bottom gear 288 of the first piston assembly, tensioning gears 316 similar to the tensioning gears 310 of the first piston assembly, and a bottom chain 318 similar to the bottom chain 312 of the first piston assembly. The bottom chain 318 extends from the distal bottom gear 314 of the second piston assembly 110, to the tensioning gears 316 of the second piston assembly 110, to the proximal top gear 162. The chain 318 can extend around and rotationally lock the gears 314, 316, 162 to one another. That is, because the proximal top gear 162 is stationary and rotationally locked to the central stationary shaft assembly 112, the bottom chain 318 can prevent the distal bottom gear 314 from rotating about its own central axis. The tensioning gears 316 can ensure that the chain 318 experiences tension and does not go slack.

As described above, as the intermediate piston 320 moves back and forth (reciprocates) within the inner chamber 212, the distal bottom gear 288 can continuously rotate in a single direction with respect to the first piston assembly 108. As also described above, the proximal bottom gear 164 is stationary and rotationally locked to the central stationary shaft assembly 112. Thus, because the bottom chain 312 rotationally locks the distal bottom gear 288 to the proximal bottom gear 164, such that the distal bottom gear 288 does not rotate about its own central axis, reciprocation of the intermediate piston 320 causes the entire first piston assembly 108, including the distal bottom gear 288, to continuously rotate (e.g., powers rotation for 360°) around the central stationary shaft 112, including the proximal bottom gear 164. The teeth of the distal bottom gear 288 and of the proximal bottom gear 164 can each crawl along the bottom chain 312 as the first piston assembly 108 rotates about the central stationary shaft 112. The same principles apply to the second piston assembly 110.

Thus, rotation of the first piston assembly 108 about the central stationary shaft assembly 112 can be powered by two mechanisms. First, as explained above, because the primary cylinder body 210 and the proximal piston 216 rotate about the central stationary shaft assembly 112 on different axes, the proximal piston plate 216*b* can be drawn proximally and distally through the inner chamber 212 as the entire first piston assembly 108 rotates about of the central stationary shaft assembly 112, powering rotation of the first piston assembly 108 under principles similar to those described above with regard to engine 30, Second, reciprocation of the intermediate piston 320 powers rotation of the first piston assembly 108 via the drive shaft 268, cams 270, 272, gears 288, 164, and chain 312. These two mechanisms can be coordinated such that they both power rotation of the first piston assembly 108 in the same direction and at the same rate of rotation for 360° of the rotation.

Figure 5:
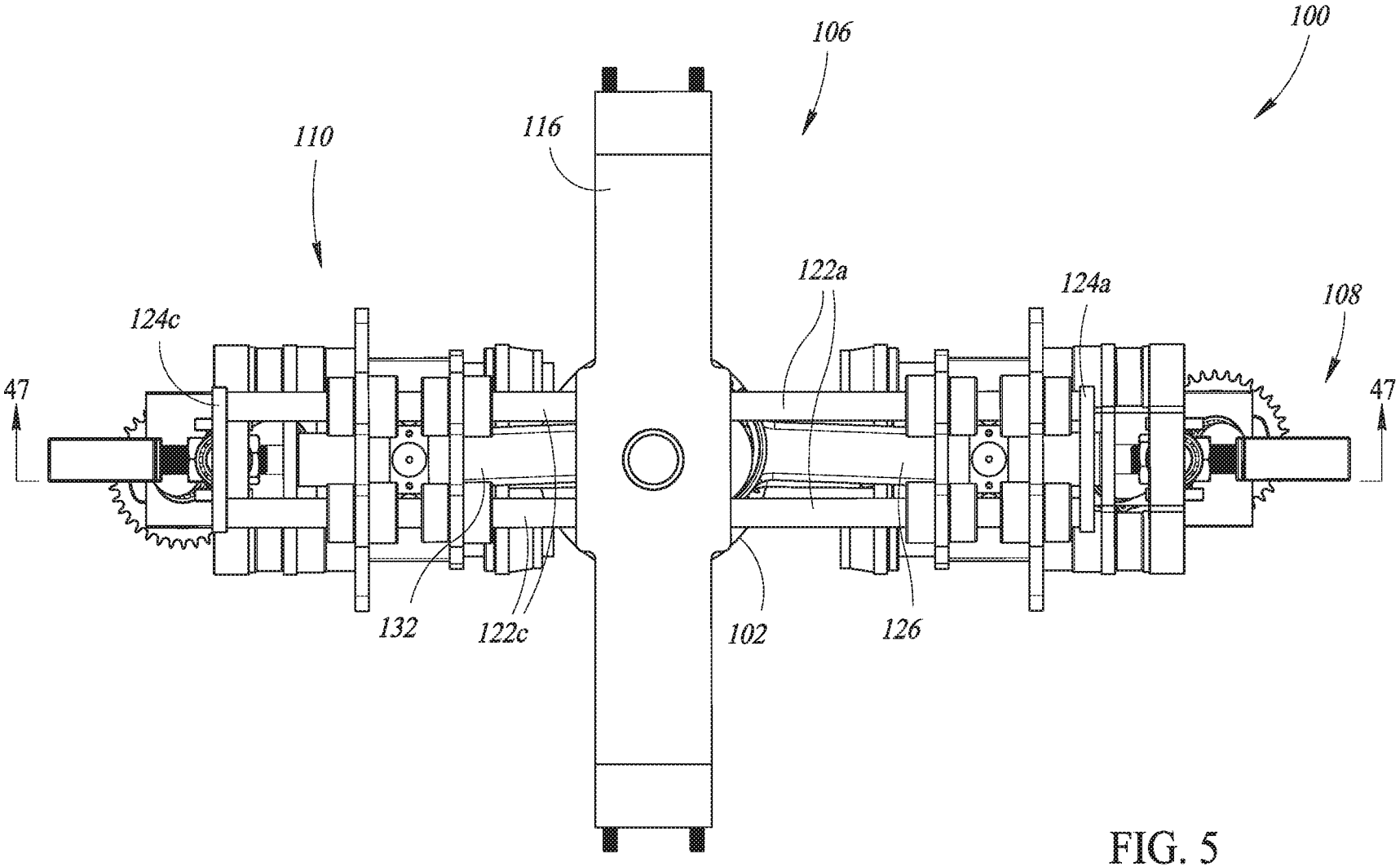
FIG. 5 is a top view of the pressure differential engine of FIG. 3, according to at least one illustrated embodiment.
Figure 6:
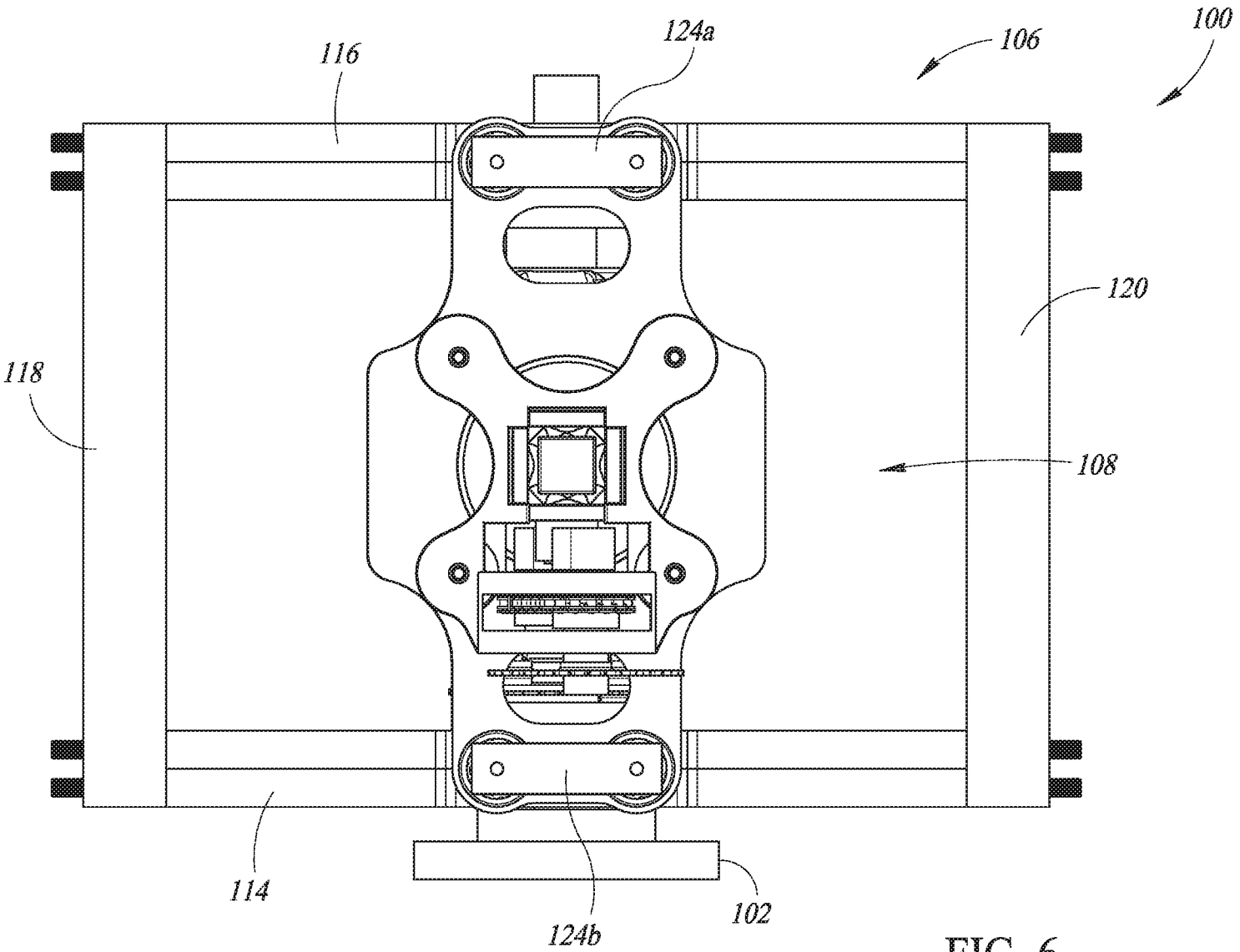
FIG. 6 is an end view of the pressure differential engine of FIG. 3, according to at least one illustrated embodiment.
Figure 47:
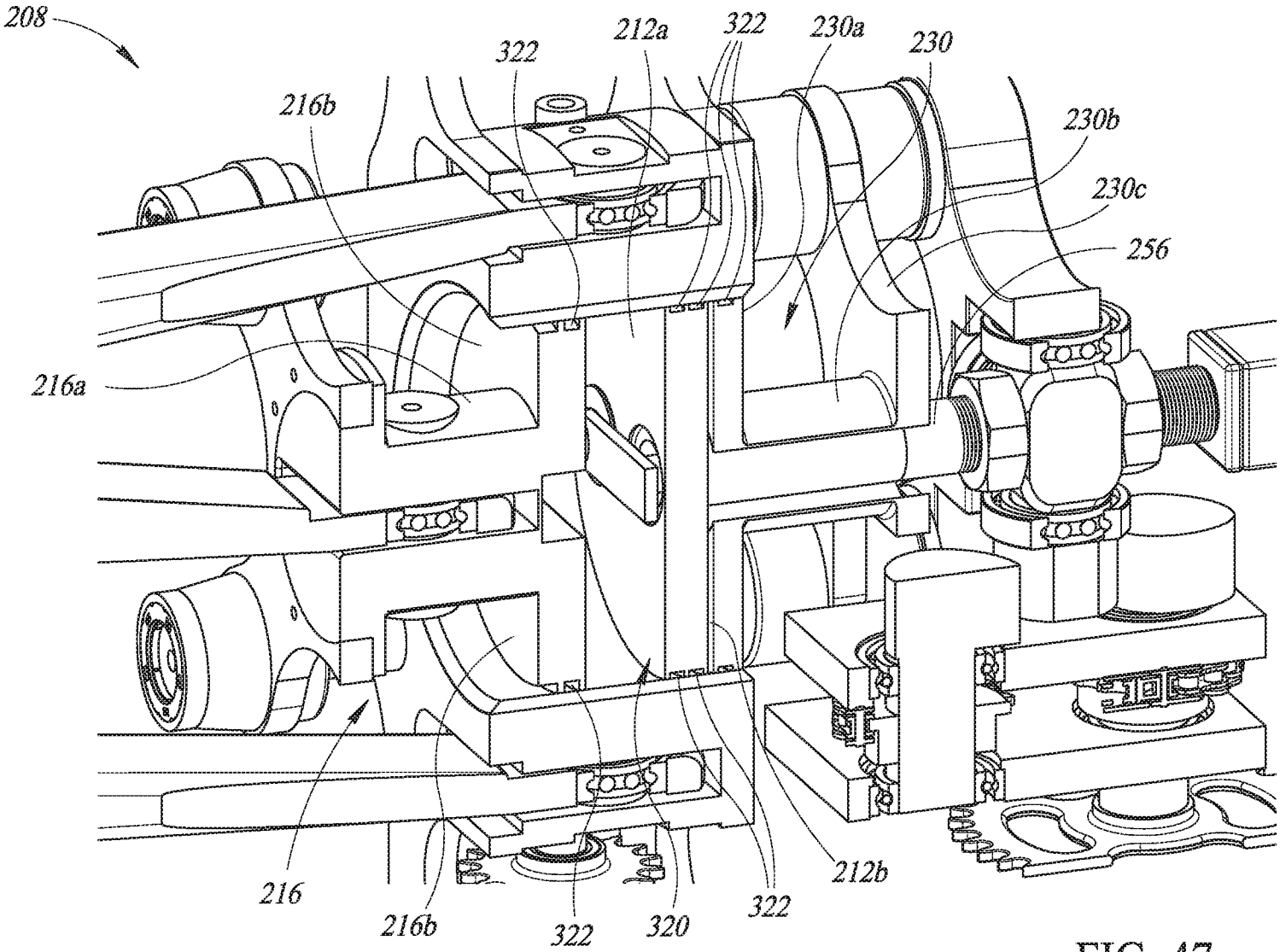
FIG. 47 is a partial perspective cross-sectional view of the pressure differential engine of FIG. 3, according to at least one illustrated embodiment.

FIG. 47 illustrates a cross-sectional view of the engine 100 taken along line 47-47 shown in FIG. 5. FIG. 47 illustrates the relationships of the proximal piston 216, the distal piston 230, and the intermediate piston 320. FIG. 47 illustrates that the intermediate piston 320 separates the primary inner chamber 212 into a proximal inner chamber 212*a* and a distal inner chamber 212*b*. FIG. 47 also illustrates that each of the proximal, intermediate, and distal pistons 216, 320, 230, can include one or more peripheral grooves 322 within which sealing elements such as gaskets (not illustrated) can be positioned to seal the proximal and distal inner chambers 212*a*, 212*b*. The interior of the distal piston coupler shaft 230*b* can be sealed around the control shaft 256 so as to enclose the distal inner chamber 212*b*.

Figure 48:
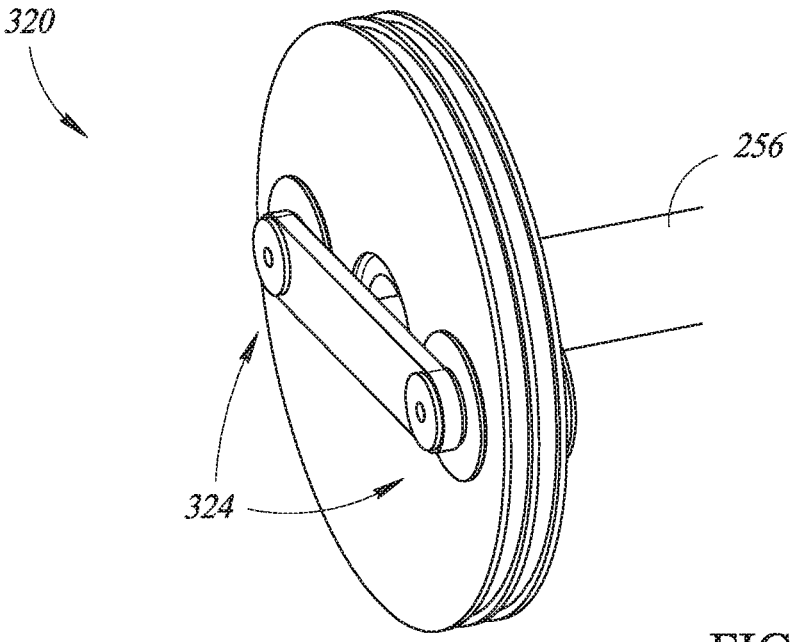
FIG. 48 is a partial perspective view of several components of the pressure differential engine of FIG. 3, according to at least one illustrated embodiment.
Figure 49:
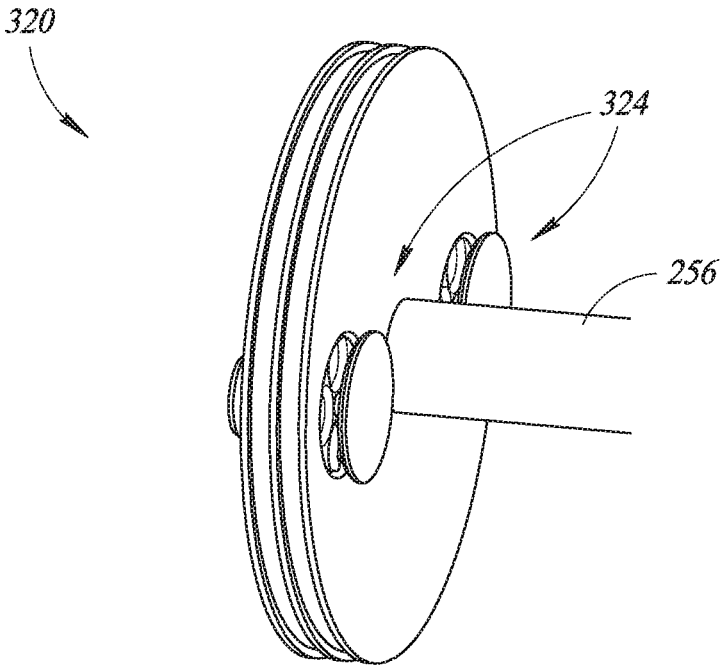
FIG. 49 is another partial perspective view of the components of FIG. 48, according to at least one illustrated embodiment.

FIGS. 48 and 49 illustrate the intermediate piston 320 and the control shaft 256 in isolation in order to more fully illustrate those components. The face of the intermediate piston 320 is circular. The faces of any of the pistons described herein can be circular, or can comprise any other suitable shape, such as a square, oval, ellipse, triangle, etc., depending on the specific implementation. The intermediate piston 320 can include a pair of valves 324 that can be opened to allow air to flow through the intermediate piston 320 (e.g., to allow air to flow between the proximal and distal inner chambers 212*a*, 212*b*), and closed to prevent air from flowing through the piston 320. For example, the valves 324 can be controlled by the controller 254 to open and close at controlled times.

In some implementations, the valves 324 can be opened and closed in rapid succession in order to equalize the pressures between the proximal and distal inner chambers 212*a*, 212*b*. Such pressure equalization events can be timed so as to increase the power output, efficiency, or other properties of the engine 100, and the timing of these events can depend on the specific implementation of the engine 100. In some implementations, the valves 324 can be opened and closed in rapid succession once per revolution of the first and second piston assemblies 108, 110 about the central stationary shaft assembly 112. In some more specific implementations, these pressurization equalization events can be timed to occur when the first and second piston assemblies 108, 110 are in a 240° configuration (or a configuration within ±5° of a 240° configuration), as understood with reference to the 0-degree, 45-degree, 90-degree, and 135-degree configurations illustrated above with regard to engine 30.

In some implementations, the proximal and distal inner chambers 212*a*, 212*b* can be provided with inlet and outlet valves (e.g., solenoid valves) to allow high pressure gas to be injected into, or relatively low pressure gas to be exhausted from, the chambers 212*a*, 212*b*. In some implementations, after the engine 100 has been brought up to a certain speed of rotation (primed), the valves can be closed to seal off the primary inner chamber 212. In such an implementation, the valves 324 can be used to shuttle air between the proximal and distal inner chambers 212*a*, 212*b* so the engine 100 can continue to generate mechanical work for a time until the pressure differentials eventually dissipate due to frictional or other losses. In some implementations, air compressed to about 30 psi (gauge pressure) can be used to drive the engine 100.

In some implementations, exhausted, relatively low pressure gas can be re-circulated or re-injected into the engine 100 and used to drive the engine 100 again. For example, exhausted gas can be lower-pressure than the high pressure gas originally injected, but still sufficiently high pressure such that it can be used to induce desirable pressure differentials, as described above. As another example, exhausted gas can be recompressed and then re-injected into the engine 100. In some implementations, gas exhausted from one chamber of a cylinder can be re-injected into another chamber of that cylinder, or can be re-injected into a chamber of a different cylinder.

In some implementations, power can be drawn from the engine 100 by mounting and rigidly fixing a gear to the top of the main frame 106, e.g., such that it rotates about the top shaft portion 142, and drawing power from the gear. The components of the engine 100 can be fabricated from any suitable materials, such as steel, aluminum, or other metals.

In some implementations, pressure differential engines such as engine 100 can include a gas pressurization system.

Figure 50:
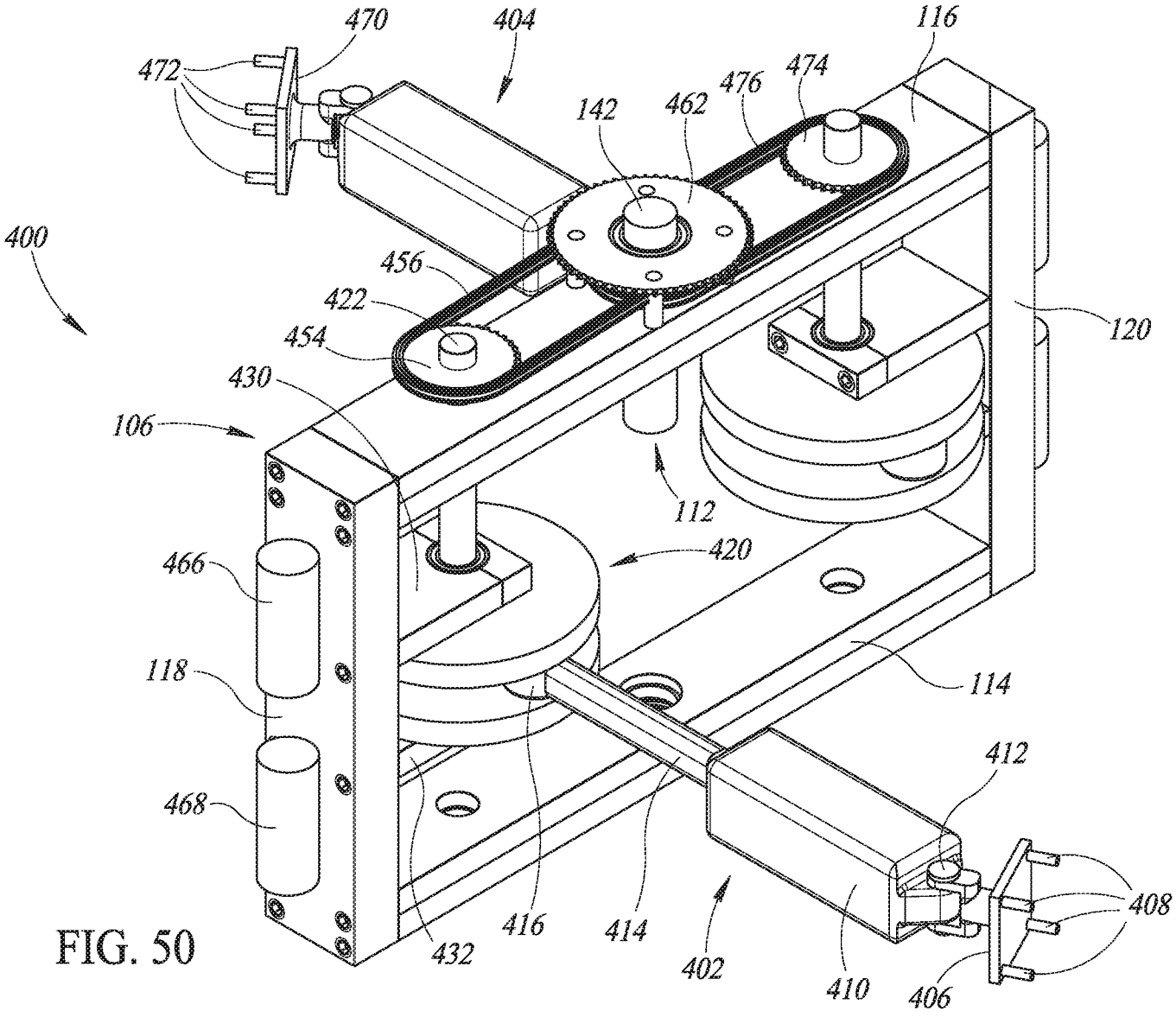
FIG. 50 is a perspective view of a pressurization system of another pressure differential engine, according to at least one illustrated embodiment.
Figure 51:
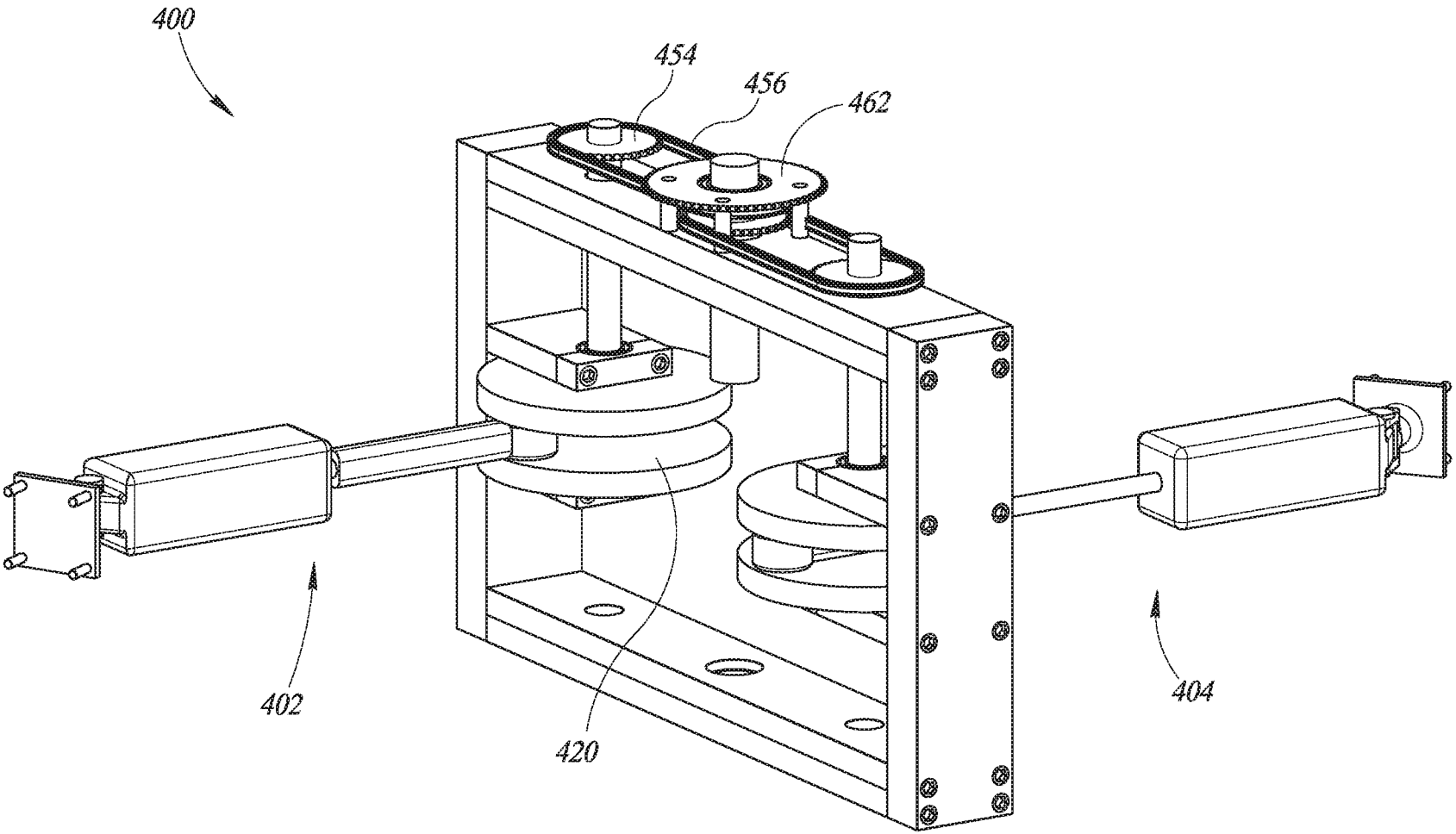
FIG. 51 is another perspective view of the pressurization system of FIG. 50, according to at least one illustrated embodiment.
Figure 52:
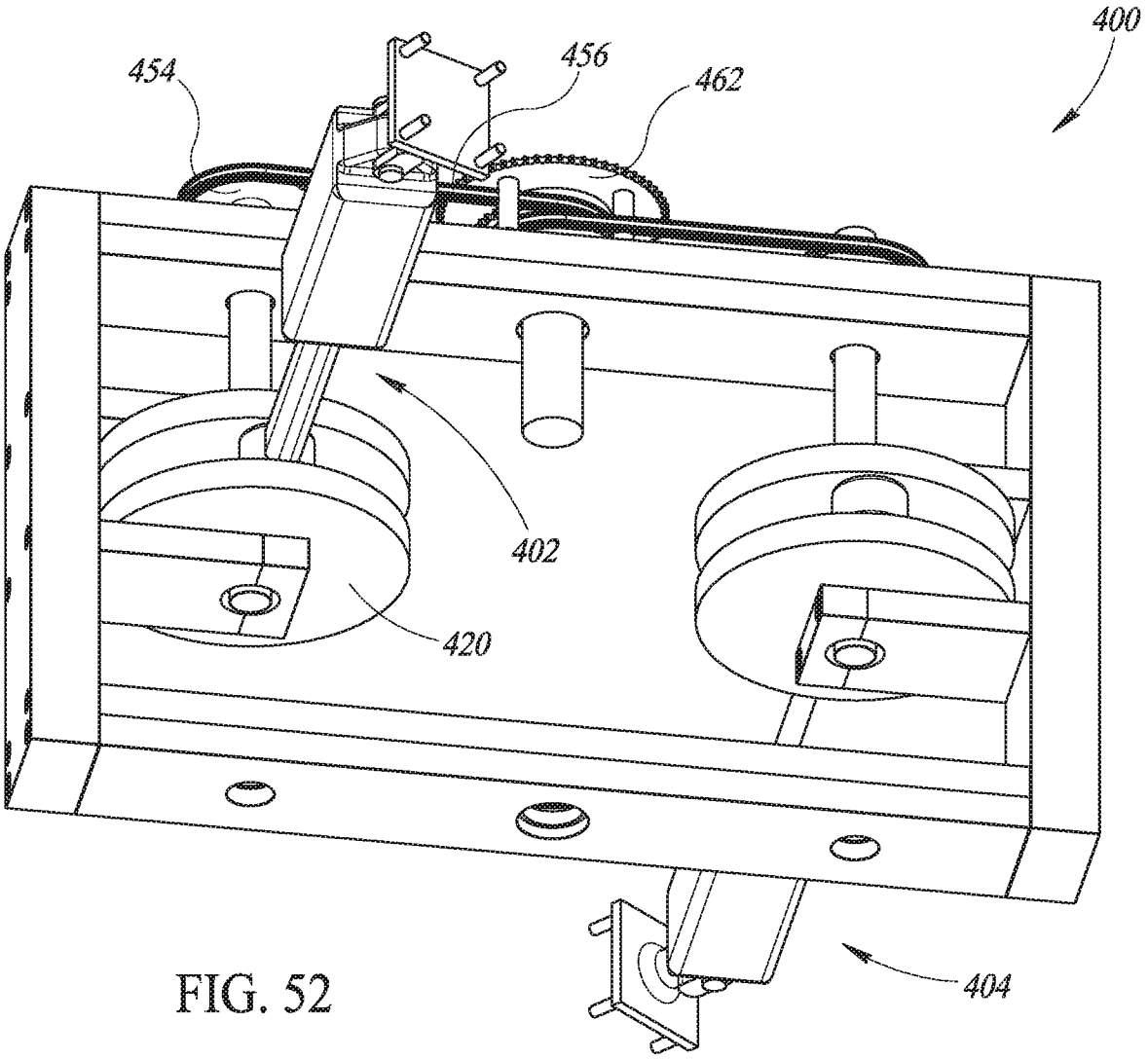
FIG. 52 is another perspective view of the pressurization system of FIG. 50, according to at least one illustrated embodiment.

FIGS. 50-57 illustrate such a gas pressurization system 400 for use with a pressure differential engine having components similar to those described above for engine 100. Although the components of the engine 100 and the components illustrated in FIGS. 50-57 may have some differences, they are labeled using the same reference numerals for the sake of clarity and convenience. FIGS. 50-52 illustrate that the pressurization system 400 can include a first pneumatic cylinder assembly 402 positioned on a first side of the main frame 106 and a second pneumatic cylinder assembly 404 positioned on a second side of the main frame 106 opposite to the first side. Various components, including the first piston assembly 108 and the second piston assembly 110, are not illustrated in FIGS. 50-57, in order to avoid obscuring the illustration of the components of the pressurization system 400. The cylinder assemblies 402 and 404 are mirror images of one another except for any other differences described herein. Thus, the following description of the pressurization system 400 focuses on the first cylinder assembly 402, and the second cylinder assembly 404 can include features similar or identical to those of the first cylinder assembly 402.

The first cylinder assembly 402 comprises a clevis 406 including four clevis bolts 408 for coupling the clevis 406 to other components. For example, the bolts 408 can secure the clevis 406 to the first piston assembly 108, such as to the primary cylinder body 210 of the first piston assembly 108. The first cylinder assembly 402 also comprises a pneumatic cylinder 410 and a clevis pin 412 that rotatably couples the pneumatic cylinder 410 to the clevis 406. The pneumatic cylinder 410 can be provided with inlet and outlet valves (e.g., solenoid valves) to allow high pressure gas to be injected into, or relatively low pressure gas to be exhausted from, the pneumatic cylinder 410.

The pneumatic cylinder 410 includes a piston mounted therein to form a chamber between the piston and a distal end of the pneumatic cylinder 410, the piston coupled to a connecting rod 414 that extends out of the cylinder 410 beyond a proximal end of the cylinder 410 opposite the clevis 406. The connecting rod 414 extends from the cylinder 410 to a proximal end of the connecting rod 414, which includes a hollow cylinder 416 having a longitudinal bore extending vertically therethrough. The longitudinal bore of the hollow cylinder 416 can be engaged with a crankpin 418 (see FIG. 53) of a crankshaft 420 mounted to the main frame 106. For example, the crankpin 418 can travel through the longitudinal bore of the hollow cylinder 416.

Figure 53:
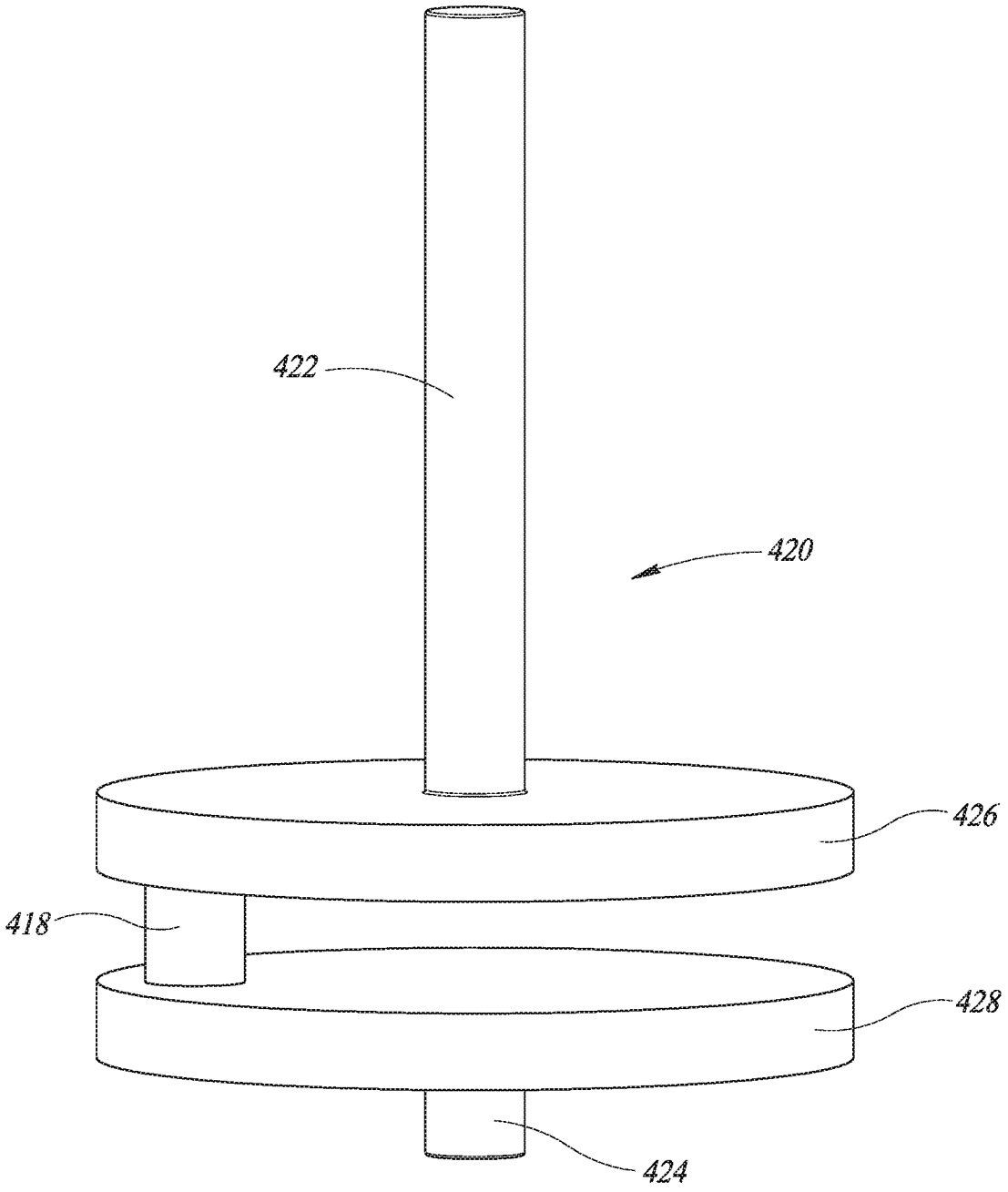
FIG. 53 is a perspective view of a component of the pressurization system of FIGS. 50-52, according to at least one illustrated embodiment.

FIG. 53 illustrates the crankshaft 420 isolated from other components. As shown in FIG. 53, the crankshaft 420 includes a main bearing journal including an upper crankshaft rod 422 and a lower crankshaft rod 424 that has a diameter matching a diameter of the upper crankshaft rod 422, that extends along the same central longitudinal axis as the upper crankshaft rod 422, and that is spaced apart axially from the upper crankshaft rod 422 along the common longitudinal axis shared by the upper and lower crankshaft rods 422, 424. An upper crankweb 426 is coupled to the bottom end of the upper crankshaft rod 422. A lower crankweb 428 is coupled to the top end of the lower crankshaft rod 424. The crankwebs 426 and 428 are flat cylinders having the same diameter as one another and larger diameters than the diameters of the upper and lower crankshaft rods 422, 424, extend along the same central longitudinal axis as the upper and lower crankshaft rods 422, 424, and are spaced apart axially from one another along their common central longitudinal axis.

The crankpin 418 is coupled at a top end thereof to a bottom end of the top crankweb 426 and at a bottom end thereof to a top end of the bottom crankweb 428. The crankpin 418 extends along a central longitudinal axis that is parallel to, but offset from, the central longitudinal axis of the crankshaft rods 422, 424, and crankwebs 426, 428. Because the crankpin 418 of the crankshaft 420 extends through the longitudinal bore of the hollow cylinder 416, the hollow cylinder 416 is constrained to translate with the crankpin 418 and can rotate about the crankpin 418. Thus, these components can convert reciprocating motion of the connecting rod 414 with respect to the crankshaft 420 into rotational motion of the crankshaft 420, or can convert rotational motion of the crankshaft 420 into reciprocal motion of the connecting rod 414 with respect to the crankshaft 420.

As shown in FIGS. 50-52, the crankshaft 420 can be mounted to the first vertical side post 118 and to the horizontal top bar 116 of the main frame 106. For example, a first, top support plate 430 and a second, bottom support plate 432 can be coupled to an inner surface of the first vertical side post 118 and extend proximally inward from the side post 118. The top and bottom support plates 430, 432 include vertically extending boreholes 434, 436, respectively (see FIGS. 54 and 55) and the horizontal top bar 116 and horizontal bottom bar 114 include vertically extending boreholes 438, 440, respectively (see FIGS. 54 and 55). The upper crankshaft rod 422 can extend through and be mounted within the boreholes 438 and 434, and the lower crankshaft rod 424 can extend through and be mounted within the boreholes 436 and 440. As illustrated, the lower crankshaft rod 424 extends through and is mounted within only the borehole 436.

Figure 54:
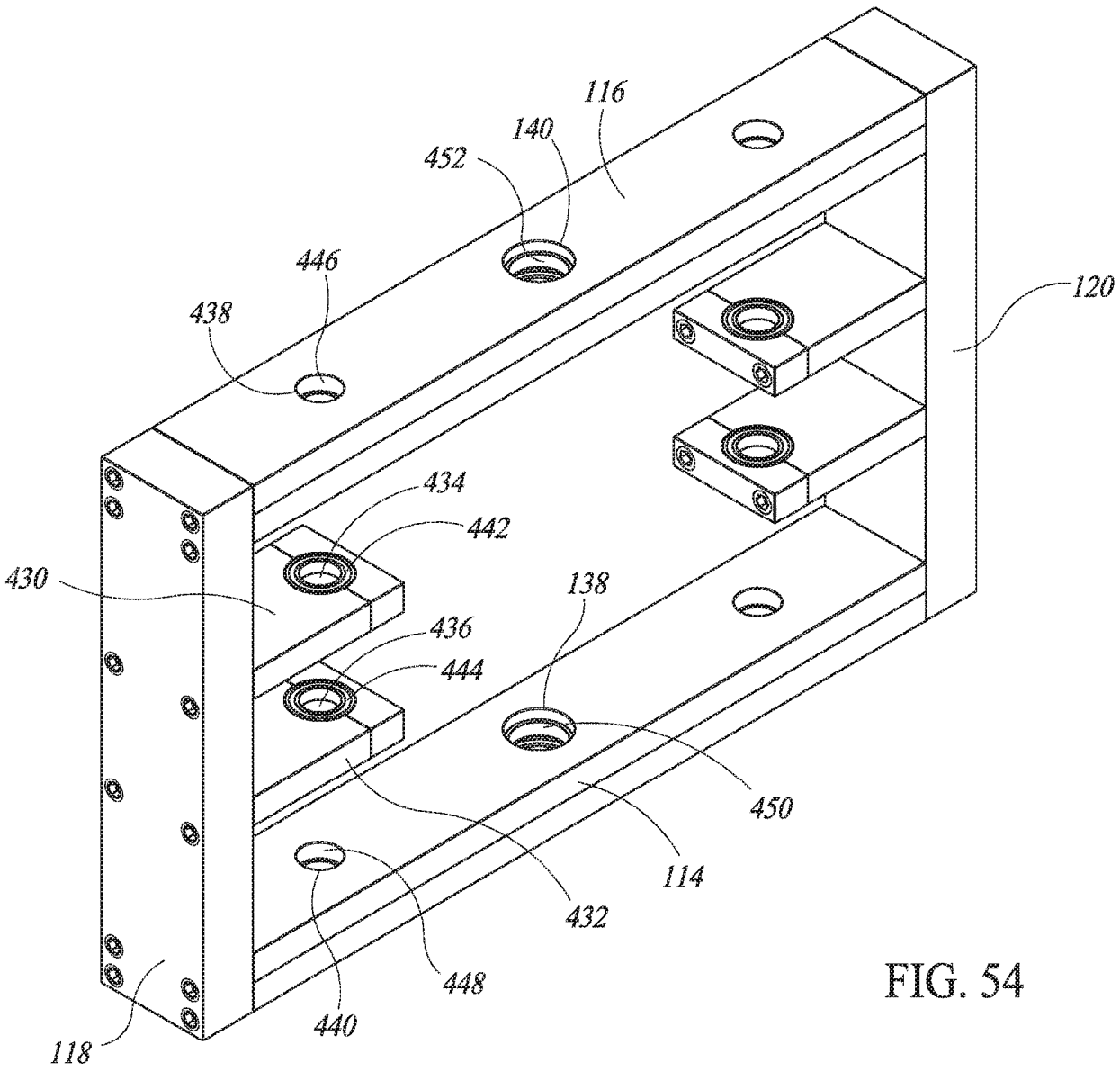
FIG. 54 is a top perspective view of components of the pressure differential engine, including components of the pressurization system, of FIGS. 50-52, according to at least one illustrated embodiment.
Figure 55:
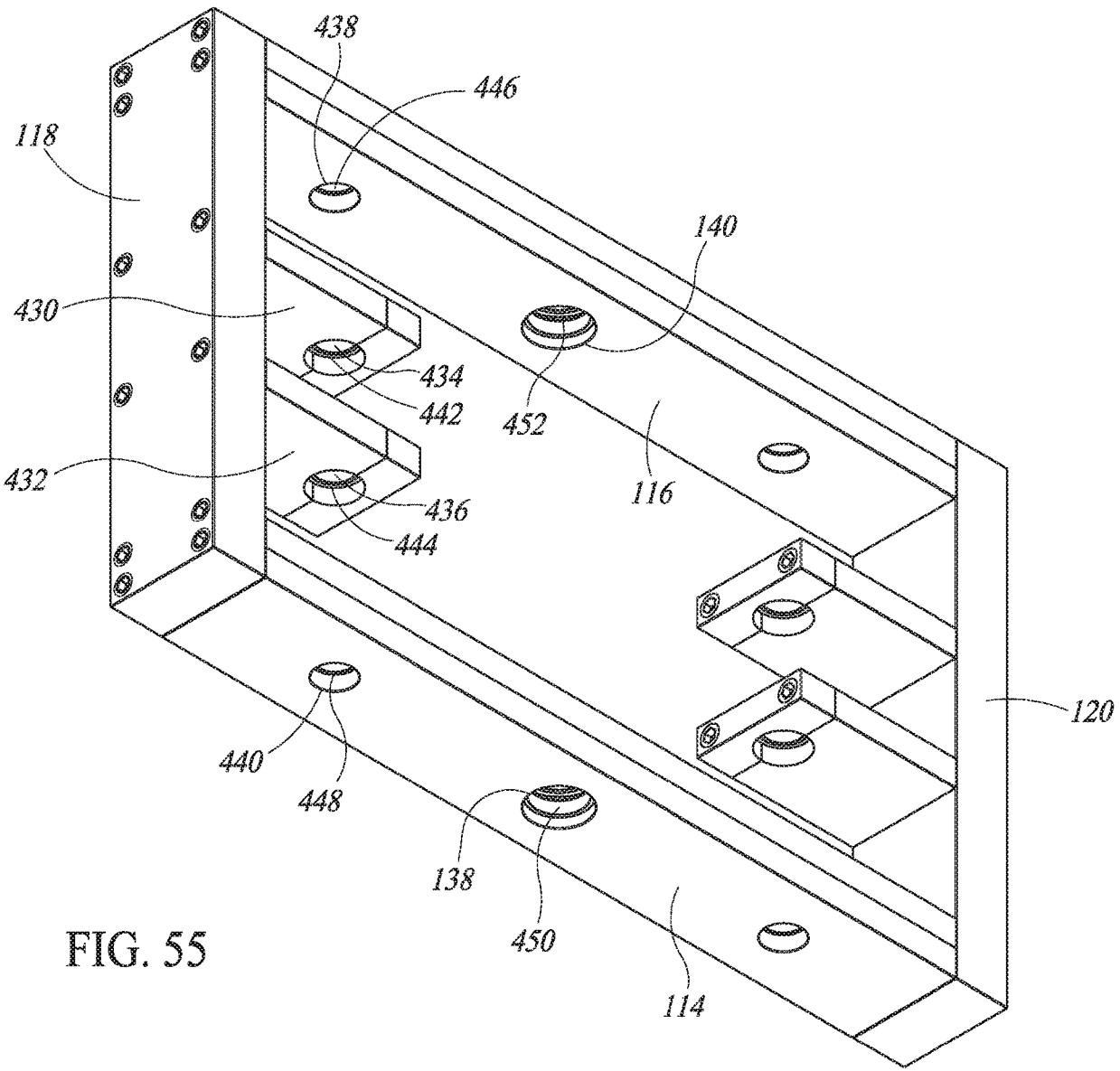
FIG. 55 is a bottom perspective view of components of the pressure differential engine, including components of the pressurization system, of FIGS. 50-52, according to at least one illustrated embodiment.

FIGS. 54 and 55 illustrate the boreholes 434, 436, 438, and 440 with other components removed, to improve the clarity of their illustration. As seen in FIGS. 54 and 55, roller bearings 442, 444, 446, and 448 are mounted in each of the boreholes 434, 436, 438, and 440, respectively, to reduce friction resulting from rotation of the crankshaft 420 with respect to the main frame 106. As further illustrated in FIGS. 54 and 55, additional roller bearings 450 and 452 are mounted in each of the vertical boreholes 138, 140, respectively, to reduce friction resulting from rotation of the main frame 106 about the central stationary shaft 112, only a portion of which is shown in FIGS. 50-52 for clarity of illustration.

As illustrated in FIGS. 50-52, the upper crankshaft rod 422 of the crankshaft 420 extends through and above the borehole 438 and roller bearing 446 positioned in the top bar 116. A portion of the crankshaft rod 422 extending above the top bar 116 is rigidly coupled to a distal crankshaft gear 454. The crankshaft gear 454 is rotatably coupled by a crankshaft chain 456 to a proximal crankshaft gear 458 (see FIGS. 56 and 57), The proximal crankshaft gear 458 is rigidly mounted to the top shaft portion 142 of the central stationary shaft 112, such that the proximal crankshaft gear 458 is also stationary.

Figure 56:
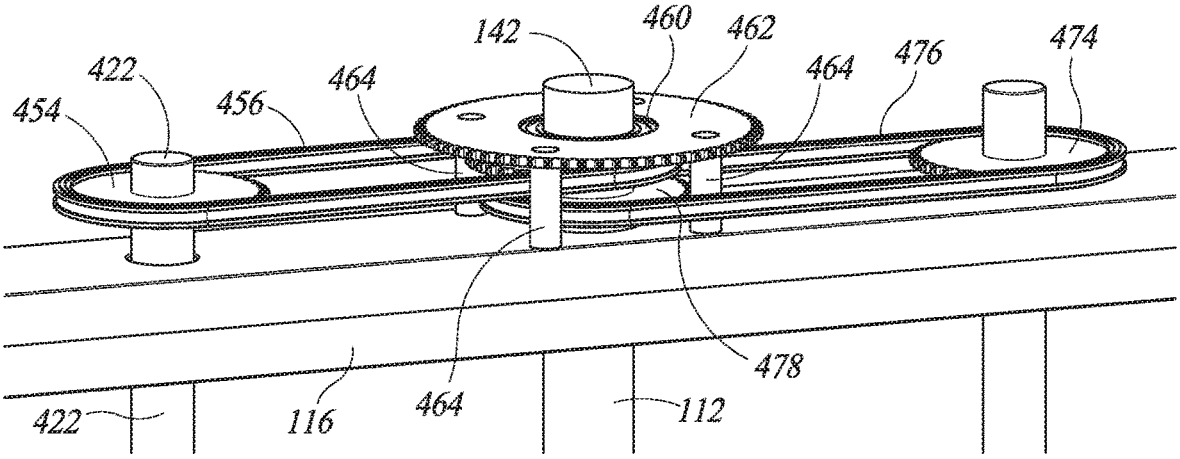
FIG. 56 is a perspective view of components of the pressurization system of FIGS. 50-52, according to at least one illustrated embodiment.
Figure 57:
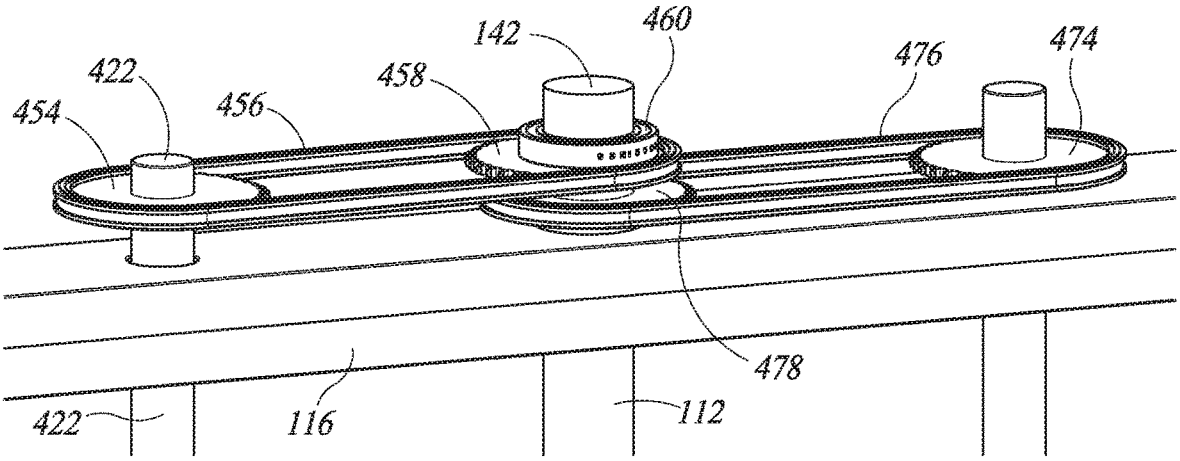
FIG. 57 is another perspective view of components of the pressurization system of FIGS. 50-52, according to at least one illustrated embodiment.

As illustrated in FIGS. 56 and 57, a roller bearing 460 is mounted to the top shaft portion 142 above the proximal crankshaft gear 458. A drive gear 462 (illustrated in FIG. 56, not in FIG. 57) is mounted on the roller bearing 460 so that the drive gear 462 is freely rotatable about the top shaft portion 142. The drive gear 462 is rigidly coupled to four tensioning rods 464 which are rigidly mounted on top of the top bar 116 so that the drive gear 462 rotates with the top bar 116 and the rest of the main frame 106. Power can be drawn from the drive gear 462. The crankshaft chain 456 extends between two of the tensioning rods 464, which push the chain 456 inwards from either side to induce tension in the chain 456 to prevent the chain 456 from going slack. The chain 456 extends around and rotationally locks the gears 454 and 458 to one another, That is, because the proximal crankshaft gear 458 is stationary and rotationally locked to the distal crankshaft gear 454, the crankshaft chain 456 can prevent the distal crankshaft gear 454 from rotating about its own central axis, As shown in FIGS. 50-52, the first cylinder assembly 402 also includes a high-pressure gas tank 466 and a low-pressure gas tank 468 mounted to the first side post 118. The high-pressure tank 466 can be used to store high pressure gasses to supply the pistons and chambers, as described elsewhere herein, with a high-pressure gas to drive operation of the various features described herein, such as by feeding the high-pressure gas to the various valves (e.g., solenoid valves) and various chambers (e.g., chambers 212*a* and 212*b*) described herein. For example, 50 milliliters of compressed, high-pressure gas can be fed from the high-pressure tank 466 to the chambers at a time. The low-pressure tank 468 can be used to collect relatively low pressure gas exhausted from the various valves (e.g., solenoid valves) and various chambers (e.g., chambers 212*a* and 212*b*) described herein.

Operation of the pressurization system 400 is driven by the relative motion of the primary cylinder body 210 of each of the first and second piston assemblies 108, 110, with respect to the main frame 106 as the first and second piston assemblies 108, 110 and main frame 106 rotate about the central stationary shaft 112. For example, the first and second piston assemblies 108, 110 can reciprocate back and forth with respect to the main frame 106 by sliding toward and away from the main frame 106 along the support rods 122. This relative motion can drive operation of the pressurization system 400 to realize at least two distinct benefits to a pressure differential engine such as pressure differential engine 100.

First, in operation, high-pressure gas from the high-pressure gas tank 466 can be used to drive operation of a pressure differential engine, such as described above with regard to pressure differential engine 100. Once these operations have been performed to drive rotation of the main frame 106 about the central stationary shaft 112, and the high-pressure gas has become a relatively low pressure gas, the low-pressure gas can be exhausted to the low-pressure gas tank 468. Low-pressure gas can then be fed from the low-pressure gas tank 468 and injected into the pneumatic cylinder 410 when the primary cylinder body 210 is furthest from the main frame 106 and the chamber within the pneumatic cylinder 410 is therefore at its largest. As the main frame 106 and the primary cylinder body 210 continue to rotate about the central stationary shaft 112, the primary cylinder body 210 moves toward the main frame 106, thereby compressing the gas in the pneumatic cylinder 410. When the primary cylinder body 210 is closest to the main frame 106 and the chamber within the pneumatic cylinder 410 is therefore at its smallest and the pressure of the gas in the pneumatic cylinder 410 at its highest, high-pressure gas can then be fed from the pneumatic cylinder 410 and injected back into the high-pressure tank 466, where it can be used again to drive operation of the pressure differential engine.

Second, as the primary cylinder body 210 moves toward the main frame 106, and as the pressure of the air in the pneumatic cylinder 410 increases, as described above, the connecting rod 414 is driven toward the crankshaft 420 to drive rotation of the crankshaft 420 for 180 degrees of its rotation. Similarly, once the primary cylinder body 210 begins moving away from the main frame 106, the connecting rod 414 is pulled by the primary cylinder body 210 away from the crankshaft 420 to further drive rotation of the crankshaft 420 for the additional 180 degrees of its rotation, such that the connecting rod 414 drives the crankshaft 420 for 360 degrees of its rotation.

Thus, as the connecting rod 414 reciprocates back and forth with respect to the crankshaft 420, the distal crankshaft gear 454 continuously rotates in a single direction with respect to the main frame 106. As described above, however, the crankshaft chain 456 prevents the distal crankshaft gear 454 from rotating about its own central axis. Thus, reciprocation of the connecting rod 414 causes the entire main frame 106 to continuously around the central stationary shaft 112 and the teeth of the distal crankshaft gear 454 to crawl along the crankshaft chain 456 as the main frame 106 rotates about the central stationary shaft 112, in the same way that reciprocation of the intermediate piston 320 causes the first piston assembly 108 to continuously rotate around the central stationary shaft 112, as described above.

Thus, rotation of the main frame 106 and the piston assemblies 108, 110 about the central stationary shaft assembly 112 can be powered by three mechanisms. First, as explained above, rotation can be powered under principles similar to those described above with regard to engine 30. Second, as also explained above, rotation can be powered by reciprocation of the intermediate piston 320. Third, as just explained, rotation can be powered by reciprocation of the primary cylinder body 210 with respect to the main frame 106. These three mechanisms can be coordinated such that they all power rotation of the main frame 106 and the piston assemblies 108, 110 in the same direction and at the same rate of rotation for 360° of the rotation.

The second pneumatic cylinder assembly 404 can be a mirror image of the first pneumatic cylinder assembly 402, with some additional differences. For example, the second cylinder assembly 404 can include a clevis 470 and four bolts 472 to secure the clevis 470 to the second piston assembly 110 rather than the first piston assembly 108. Further, the second cylinder assembly 404 can be coupled to the second side post 120 rather than the first side post 118. Additionally, the second cylinder assembly 404 can include a distal crankshaft gear 474, crankshaft chain 476, and proximal crankshaft gear 478, that are positioned lower than the respective components of the first cylinder assembly 402 (see FIGS. 56 and 57) so they do not interfere with one another. Further, the crankshaft chain 476 extends around, rather than between, two of the tensioning rods 464, such that the two tensioning rods 464 push the chain 476 outwards toward either side to induce tension in the chain 476 to prevent the chain 476 from going slack.

Figure 58:
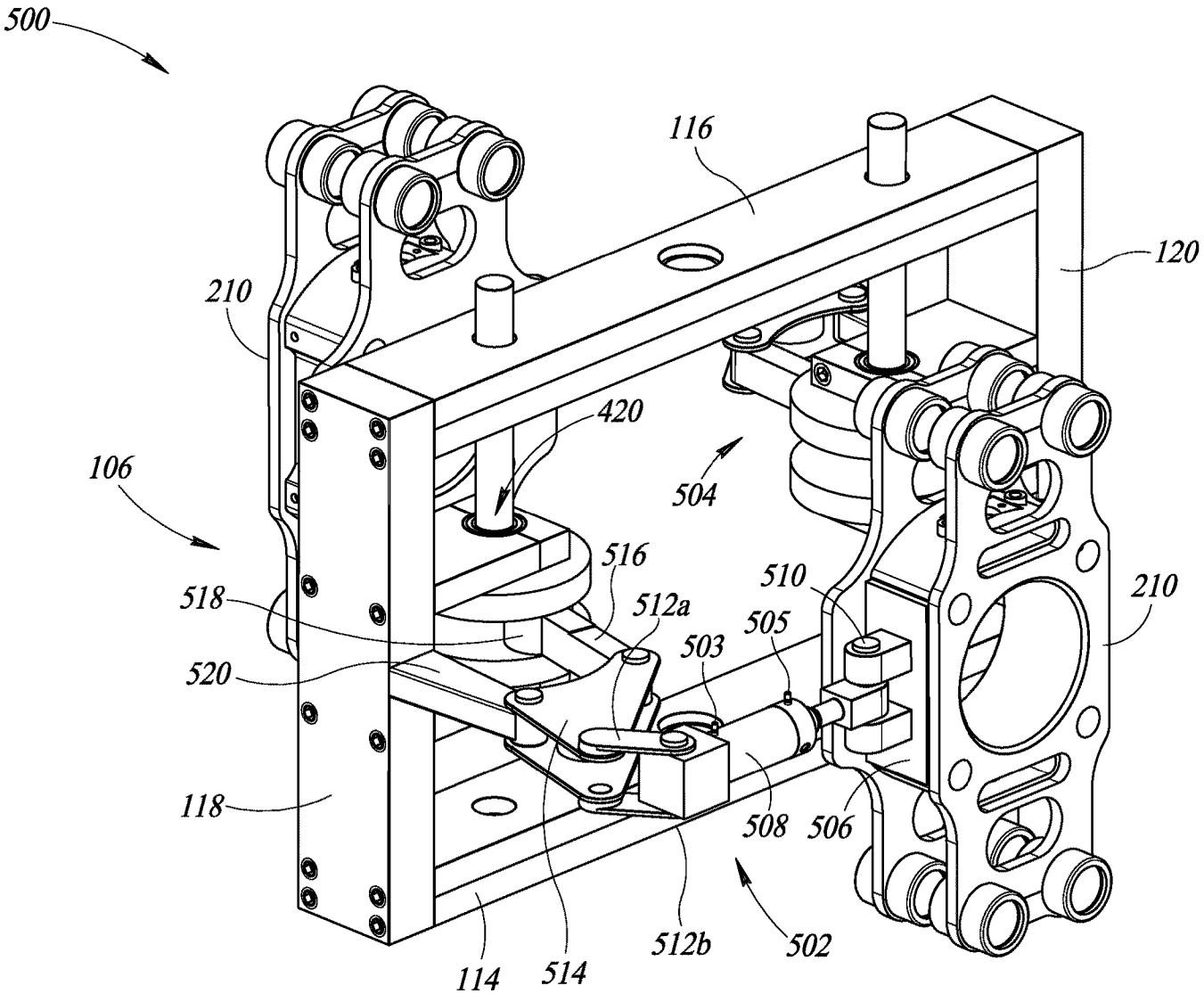
FIG. 58 is a perspective view of a pressurization system of another pressure differential engine, according to at least one illustrated embodiment.
Figure 59:
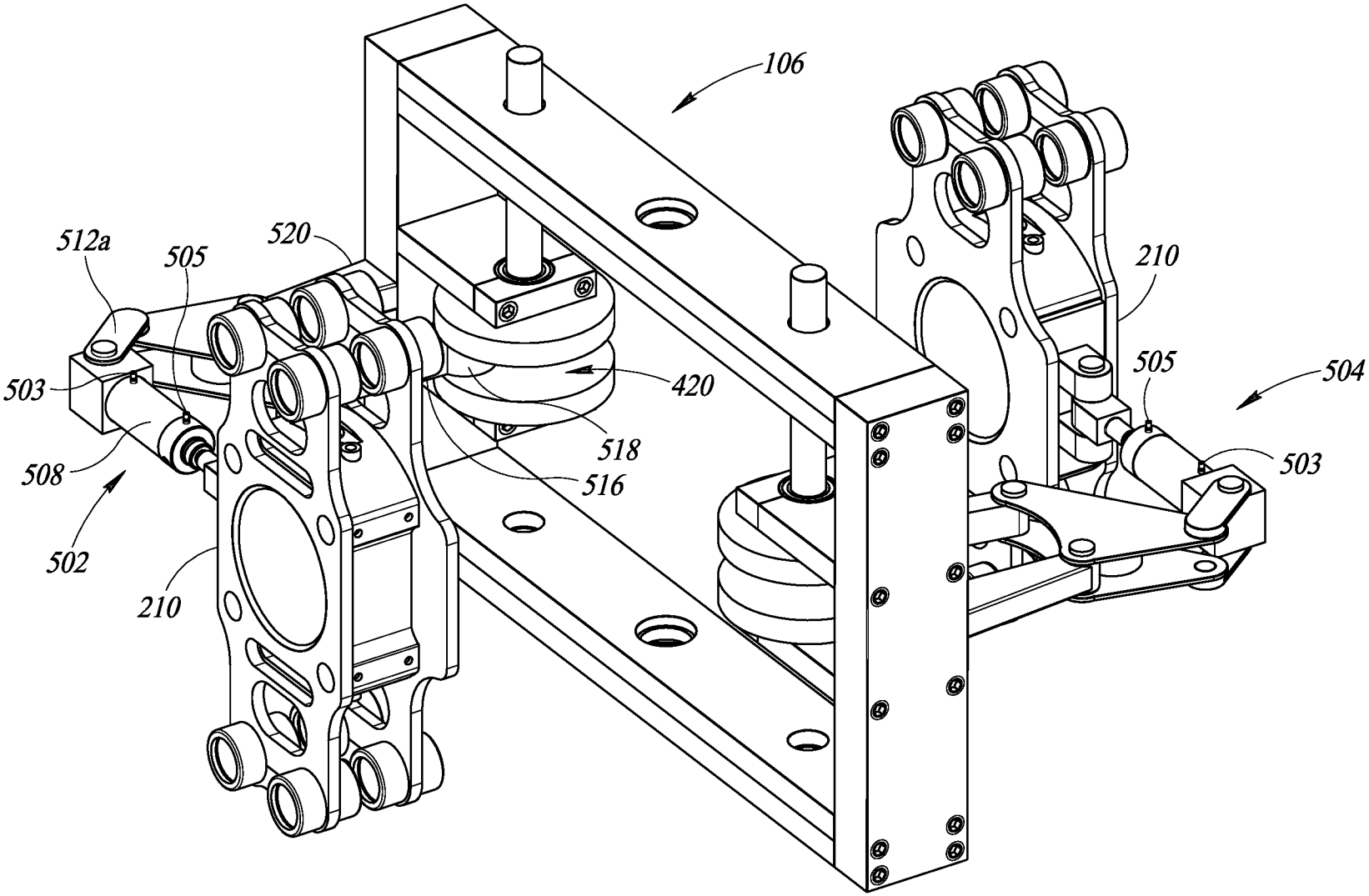
FIG. 59 is another perspective view of the pressurization system of FIG. 58, according to at least one illustrated embodiment.
Figure 60:
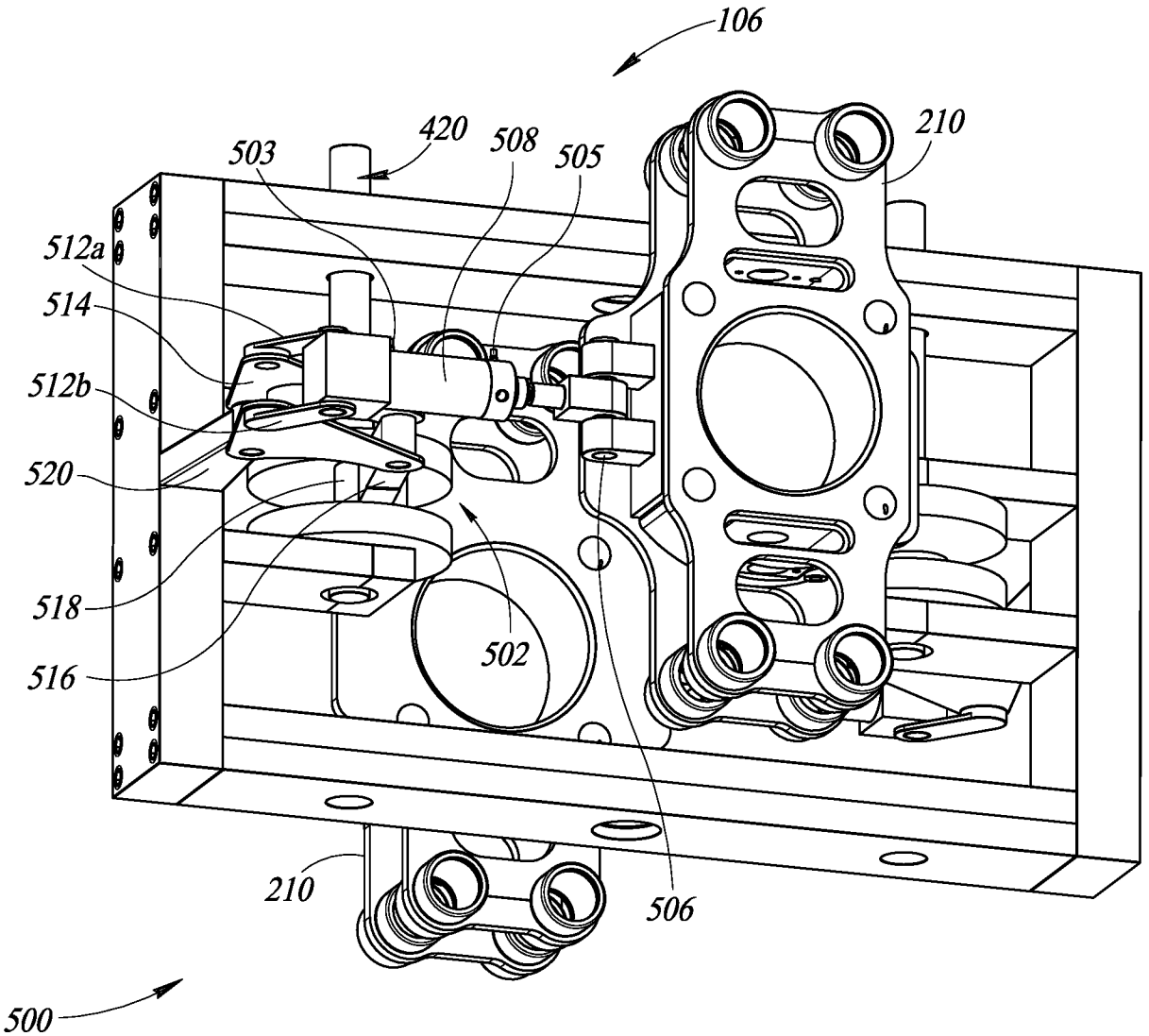
FIG. 60 is another perspective view of the pressurization system of FIG. 58, according to at least one illustrated embodiment.

FIGS. 58-60 illustrate components of another gas pressurization system 500 for use with a pressure differential engine having components similar to those described above for engine 100, as well as some components similar to those described above for gas pressurization system 400. FIGS. 58-60 illustrate that the pressurization system 500 can include a first pneumatic cylinder assembly 502 positioned on a first side of the main frame 106 and a second pneumatic cylinder assembly 504 positioned on a second side of the main frame 106 opposite to the first side. The cylinder assemblies 502 and 504 are mirror images of one another except for any other differences described herein. Thus, the following description of the pressurization system 500 focuses on the first cylinder assembly 502, and the second cylinder assembly 504 can include features similar or identical to those of the first cylinder assembly 502.

The first cylinder assembly 502 comprises a clevis 506, which can be secured to the first piston assembly 108, such as to the primary cylinder body 210 of the first piston assembly 108. The first cylinder assembly 502 also comprises a pneumatic cylinder 508 and a clevis pin 510 that rotatably couples the pneumatic cylinder 508 to the clevis 506. The pneumatic cylinder 508 can be provided with an inlet valve 503 and an outlet valve 505 (e.g., solenoid valves) to allow high pressure gas to be injected into or exhausted from, or relatively low pressure gas to be injected into or exhausted from, the pneumatic cylinder 508. The first cylinder assembly 502 also comprises a first rigid linkage 512, made up of an upper bar 512*a* and a lower bar 512*b*, a second rigid linkage 514, which has a generally triangular shape, and a connecting rod 516.

As seen in FIGS. 58-60, the pneumatic cylinder 508 is rotatably coupled, at an end thereof opposite to its connection to the clevis 506, to the first rigid linkage 512. The first rigid linkage 512 is also rotatably coupled, at an end thereof opposite to its connection to the pneumatic cylinder 508, to a first corner of the triangular second rigid linkage 514. The second rigid linkage 514 is also rotatably coupled, at a second corner thereof opposite to its first corner, to the connecting rod 516, and at a third corner thereof opposite to its first and second corners, to a bar 520 extending rigidly outward from the side post 118 of the main frame 106. The connecting rod 516 extends from the second rigid linkage 514 to a proximal end of the connecting rod 516, which includes a hollow cylinder 518 having a longitudinal bore extending vertically therethrough. The longitudinal bore of the hollow cylinder 518 can be engaged with a crankpin 418 (see FIG. 53) of a crankshaft 420 mounted to the main frame 106. For example, the crankpin 418 can travel through the longitudinal bore of the hollow cylinder 518.

Operation of the pressurization system 500 is driven by the relative motion of the primary cylinder body 210 of each of the first and second piston assemblies 108, 110, with respect to the main frame 106 as the first and second piston assemblies 108, 110 and main frame 106 rotate about the central stationary shaft 112. For example, the first and second piston assemblies 108, 110 can reciprocate back and forth with respect to the main frame 106 by sliding toward and away from the main frame 106 along the support rods 122. This relative motion can drive operation of the pressurization system 500 to realize at least two distinct benefits to a pressure differential engine such as pressure differential engine 100.

First, in operation, high-pressure gas from the high-pressure gas tank 466 can be used to drive operation of a pressure differential engine, such as described above with regard to pressure differential engine 100. Once these operations have been performed to drive rotation of the main frame 106 about the central stationary shaft 112, and the high-pressure gas has become a relatively low pressure gas, the low-pressure gas can be exhausted to the low-pressure gas tank 468. Low-pressure gas can then be fed from the low-pressure gas tank 468 and injected into the pneumatic cylinder 508 when the primary cylinder body 210 is furthest from the main frame 106 and the chamber within the pneumatic cylinder 508 is therefore at its largest, As the main frame 106 and the primary cylinder body 210 continue to rotate about the central stationary shaft 112, the primary cylinder body 210 moves toward the main frame 106, thereby compressing the gas in the pneumatic cylinder 508. When the primary cylinder body 210 is closest to the main frame 106 and the chamber within the pneumatic cylinder 508 is therefore at its smallest and the pressure of the gas in the pneumatic cylinder 508 at its highest, high-pressure gas can then be fed from the pneumatic cylinder 508 and injected back into the high-pressure tank 466, where it can be used again to drive operation of the pressure differential engine.

Second, as the primary cylinder body 210 moves toward the main frame 106, and as the pressure of the air in the pneumatic cylinder 508 increases, as described above, the pressure exerted by the pneumatic piston 508 and transferred from the pneumatic piston 508 through the first linkage 512, through the second linkage 514, and through the connecting rod 516 to the crankshaft 420, also increases. Thus, rotation of the crankshaft 420 is driven for 180 degrees of its rotation. Similarly, once the primary cylinder body 210 begins moving away from the main frame 106, the connecting rod 516 is pulled by the primary cylinder body 210 away from the crankshaft 420 to further drive rotation of the crankshaft 420 for the additional 180 degrees of its rotation, such that the connecting rod 516 drives the crankshaft 420 for 360 degrees of its rotation.

A recovery system is influenced by crank position and the relationship of the piston in the pressure/vacuum cycle. The overboard air is the focus of the recovery process, thus seizing the wasted energy that would typically be exhausted to the environment, which may thus be denominated with the term over-boarding. Instead, the air is re-introduced to the internal process of producing work thru the multiple compounding mechanical processes. The pressure/volume of air and its force is a well-timed symphony of events, designed to maximize pressure cycle timing and transfer of air towards a minimal resistance rational event.

There may, for example, be two chambers separated by three floating pistons in a moving cylinder. In such an implementation, pressure is applied to the first chamber while a vacuum is drawn in the second chamber, for half of the one cycle. A center piston then opens, allowing the pressure to equalize. Pressure is then applied to second chamber while a vacuum is drawn on the first chamber for the rest of the cycle. Any air drawn out via the vacuum system is stored in onboard external tanks and reintegrated into pressure side.

At least some implementations employ two external double acting cylinders, that provide additional vacuum and pressure to the large diameter yolk mounted piston assemblies. Compression and vacuum chambers are provided with additional filling speed and pressure and evacuation of vacuum chambers based on the yolk position. The yolk piston chambers are used as the primary air movement from chamber to chamber and back again. Proportionally, the pumps provide air to the yolk piston chambers that are relatively large in diameter and relatively short in stroke. The recompress cylinders are relatively small in diameter with a relatively long stroke as compared to the yolk piston chambers. The yolk piston assembly provides four push off points per cylinder in 360 degrees of rotational movement. Air movement must be enhanced by two recompress pumps and augmented by an external air supply tank to store air pressure and store vacuum, The recompress pumps function by being mounted and driven utilizing yolks outside pistons and linkage without producing a drag resistance of the engine. Driven by pump position, linkage geometry and its relative position in rotation of the mechanism.

In summary, the recompress is provided with a continuous draw on the vacuum side of the engine, and by utilizing the yolk as a platform to push and pull off of, but also provide functional piston area to the recompress so that the net re-compress cost comes out as a neutral or as a net positive.

The engines described herein can be highly efficient at generating mechanical work from pressure differentials. The engines described herein can use a very small volume of compressed air relative to other pneumatic engines. The engines described herein can be relatively compact and portable relative to other pneumatic engines, The engines described herein can generate very little waste heat and very little noise relative to other pneumatic engines. The engines described herein produce no carbon emissions and are thus environmentally friendly. When power is not being drawn from one of the engines described herein for end-uses, the engine can be used to compress air or pump water to higher elevations for later use. For example, when the valves of engine 100 are closed to seal off the primary inner chamber 212 and the engine 100 continues to generate mechanical work for a time as it winds down, the engine 100 can be used to compress air or pump water to higher elevations for later use.

The engines described herein can be used in automotive applications, as well as in remote, "off-grid" applications, such as in disaster areas, such as at mobile hospital locations. The engines described herein can be incorporated into propellers, such as for use in airplanes, boats, or submarines. The engines described herein can be used in very low pressure environments (e.g., outer space) or very high-pressure environments (e.g,, deep underwater). The engines described herein can be used to replace hydro-electric, wind-turbine, solar-powered, or other engines or power generators. The engines described herein can be used to power communications, desalinization, refrigeration, or other equipment, e.g., for the refrigeration of vaccines or food.

U.S. provisional patent application No. 62/146,081, filed Apr. 10, 2015, PCT application no, PCT/US2016/026784, filed Apr. 8, 2016, and U.S. provisional patent application No. 62/571,648, filed Oct. 12, 2017, are hereby incorporated herein by reference, in their entireties. Those of skill in the art will recognize that many of the methods or algorithms set out herein may employ additional acts, may omit some acts, and/or may execute acts in a different order than specified. The various embodiments described above can be combined to provide further embodiments. Aspects of the embodiments can be modified, if necessary, to employ other systems, circuits and concepts to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A pressure differential engine comprising:

a main frame rotatable about a central stationary shaft;

a first cylinder assembly coupled to a first side of the main frame, the first cylinder assembly including a first pneumatic cylinder, a first piston positioned to reciprocate within the first pneumatic cylinder, and a first rod coupled to the first piston such that the first rod extends through a first end of the first pneumatic cylinder;

a first crankshaft;

a first linkage assembly that physically couples the first cylinder assembly to the first side of the main frame and to the first crankshaft such that reciprocation of the first piston within the first pneumatic cylinder causes rotation of the first crankshaft;

a second cylinder assembly coupled to a second side of the main frame, the second side opposite the first side across a dimension of the main frame, the second cylinder assembly which comprises a second pneumatic cylinder, a second piston positioned to reciprocate within the second pneumatic cylinder, and a second rod coupled to the second piston that extends through a first end of the second pneumatic cylinder;

a second crankshaft;

a second linkage assembly that physically couples the second cylinder assembly to the second side of the main frame and to the second crankshaft such that reciprocation of the second piston within the second pneumatic cylinder causes rotation of the second crankshaft; and a number of closed loop members that respectively rotationally lock the first crankshaft and the second crankshaft to the central stationary shaft thereby rotationally locking the first crankshaft to the second crankshaft.

2. The pressure differential engine of claim 1, further comprising:

a first clevis; and a first clevis pin that rotatably couples the first rod to the first clevis.

3. The pressure differential engine of claim 2 wherein the first linkage assembly comprises: a first rigid linkage which includes an upper bar and a lower bar, a second rigid linkage which has a generally triangular shape; and a connecting rod.

4. The pressure differential engine of claim 3 wherein the upper and the lower bars of the first linkage assembly are pivotally coupled at respective first ends thereof to the first pneumatic cylinder and one of the upper and lower bars is pivotally coupled at a second end thereof to a first location of the second rigid linkage, the connecting rod of the first linkage assembly is pivotally coupled at a first end thereof to the first crankshaft and pivotally coupled at a second end thereof to a second location of the second rigid linkage, and the second rigid linkage of the first linkage assembly is pivotally coupled at a third location thereof to the first side of the main frame, the first, the second and the third locations of the second rigid linkage being non-collinear.

5. The pressure differential engine of claim 4 wherein the first, the second and the third locations of the second rigid linkage of the first linkage assembly are proximate respective ones of three corners of the generally triangular-shaped second rigid linkage.

6. The pressure differential engine of claim 4, further comprising:

a crankpin that couples the connecting rod of the first linkage assembly to the first crankshaft.

7. The pressure differential engine of claim 6 wherein the connecting rod of the first linkage assembly includes a hollow cylinder portion having a longitudinal bore extending therethrough and wherein the crankpin extends through the longitudinal bore of the hollow cylinder portion of the connecting rod of the first linkage assembly.

8. The pressure differential engine of claim 4, further comprising:

a second clevis; and a second clevis pin that rotatably couples the second rod to the second clevis.

9. The pressure differential engine of claim 8 wherein the second linkage assembly comprises: a third rigid linkage which includes a second upper bar and a second lower bar, a fourth rigid linkage which has a generally triangular shape; and a second connecting rod.

10. The pressure differential engine of claim 9 wherein the second upper bar and the second lower bar of the second linkage assembly are pivotally coupled at respective first ends thereof to the second pneumatic cylinder and one of the second upper and the second lower bars is pivotally coupled at a second end thereof to a first location of the fourth rigid linkage, the second connecting rod of the second linkage assembly is pivotally coupled at a first end thereof to the second crankshaft and pivotally coupled at a second end thereof to a second location of the fourth rigid linkage, and the fourth rigid linkage of the second linkage assembly is pivotally coupled at a third location thereof to the second side of the main frame, the first, the second and the third locations of the fourth rigid linkage being non-collinear.

11. The pressure differential engine of claim 10 wherein the first, the second and the third locations of the fourth rigid linkage of the second linkage assembly are proximate respective ones of three corners of the generally triangular-shaped fourth rigid linkage.

12. The pressure differential engine of claim 10, further comprising:

a second crankpin that couples the second connecting rod of the second linkage assembly to the second crankshaft.

13. The pressure differential engine of claim 12 wherein the second connecting rod of the second linkage assembly includes a second hollow cylinder portion having a second longitudinal bore extending therethrough and wherein the second crankpin extends through the second longitudinal bore of the second hollow cylinder portion of the second connecting rod of the second linkage assembly.

14. The pressure differential engine of claim 2, further comprising:

a piston assembly coupled to the main frame via support rods along which the piston assembly can reciprocate with respect to the main frame, wherein the first piston cylinder assembly is coupled to the first side of the main frame, by the first clevis being coupled to the piston assembly.

15. The pressure differential engine of claim 1 wherein the number of closed loop members includes:

a first chain that rotationally locks the first crankshaft to the central stationary shaft; and a second chain that rotationally locks the second crankshaft to the central stationary shaft.

16. The pressure differential engine of claim 15 wherein each of the first crankshaft and the second crankshaft includes:

an upper crank shaft rod that extends along a first central longitudinal axis;

a lower crankshaft rod that extends along a second central longitudinal axis that is parallel to the first central longitudinal axis;

an upper crankweb coupled to a bottom end of the upper crankshaft rod;

a lower crankweb coupled to an upper end of the lower crankshaft rod; and a crankpin that extends between the upper crankweb and the lower crankweb along a third central longitudinal axis that is parallel to, but offset from, the first and second central longitudinal axes.

17. The pressure differential engine of claim 1 wherein first pneumatic cylinder has an inlet valve and an outlet valve which are operable to allow high pressure gas to be injected into or exhausted from, or relatively low pressure gas to be injected into or exhausted from, the first pneumatic cylinder.

18. The pressure differential engine of claim 17 wherein second pneumatic cylinder has an inlet valve and an outlet valve which are operable to allow high pressure gas to be injected into or exhausted from, or relatively low pressure gas to be injected into or exhausted from, the second pneumatic cylinder.

19. A pressure differential engine comprising:

a primary pneumatic cylinder rotatable about a central stationary shaft;

a piston positioned to reciprocate within the primary pneumatic cylinder;

a rod coupled to the piston that extends through an end portion of the primary pneumatic cylinder;

a first cam engaged with the rod so that reciprocation of the piston within the primary pneumatic cylinder causes rotation of the first cam;

a second cam engaged with the rod so that reciprocation of the piston within the primary pneumatic cylinder causes rotation of second cam;

a first chain that rotationally locks the first cam to the second cam;

a second chain that rotationally locks the first cam and the second cam to the central stationary shaft;

a secondary pneumatic cylinder rotatably coupled to the primary cylinder;

a first rigid linkage rotatably coupled to the secondary pneumatic cylinder;

a second rigid linkage rotatably coupled to the first rigid linkage;

a connecting rod rotatably coupled to the second rigid linkage;

a crankshaft having a crankpin physically engaged with the connecting rod; and a third chain that rotationally locks the crankshaft to the central stationary shaft.

* * * * *